US012629557B2

(12) United States Patent
Mickolio et al.

(10) Patent No.: US 12,629,557 B2
(45) Date of Patent: May 19, 2026

(54) SHOULDER STRENGTHENING SYSTEMS

(71) Applicant: Titin KM Biomedical Corp., Bozeman, MT (US)

(72) Inventors: Kole Mickolio, Billings, MT (US); Kameron Mickolio, Mesa, AZ (US); Rory Maughan, Bozeman, MT (US); Seth Meyer, Bozeman, MT (US)

(73) Assignee: Titin KM Biomedical Corp., Bozeman, MT (US)

( * ) Notice: Subject to any disclaimer, the term of this patent is extended or adjusted under 35 U.S.C. 154(b) by 148 days.

(21) Appl. No.: 18/703,115

(22) PCT Filed: Oct. 5, 2022

(86) PCT No.: PCT/US2022/045755
§ 371 (c)(1),
(2) Date: Apr. 19, 2024

(87) PCT Pub. No.: WO2023/080978
PCT Pub. Date: May 11, 2023

(65) Prior Publication Data

US 2024/0416175 A1 Dec. 19, 2024

Related U.S. Application Data

(63) Continuation-in-part of application No. PCT/US2022/023150, filed on Apr. 1, 2022.
(Continued)

(51) Int. Cl.
*A63B 21/008* (2006.01)
*A63B 21/00* (2006.01)
*A63B 23/12* (2006.01)

(52) U.S. Cl.
CPC ..... *A63B 21/008* (2013.01); *A63B 21/00069* (2013.01); *A63B 21/4021* (2015.10);
(Continued)

(58) Field of Classification Search
CPC ..... A63B 21/008; A63B 21/0084; A63B 21/00069; A63B 21/4021; A63B 21/4035;
(Continued)

(56) References Cited

U.S. PATENT DOCUMENTS 3,428,311 A 2/1969 Mitchell
4,249,727 A 2/1981 Dehan
(Continued)

FOREIGN PATENT DOCUMENTS

AU 653426 9/1994
EP 1520605 4/2005
(Continued)

OTHER PUBLICATIONS

Extended European Search Report dated Oct. 16, 2025, from European Patent Application No. 22890595.6, 9 pp.
(Continued)

*Primary Examiner* — Zachary T Moore
(74) *Attorney, Agent, or Firm* — Klarquist Sparkman, LLP

(57) ABSTRACT

Shoulder strengthening systems can provide multidirectional and dynamic resistance to shoulder movement of a user. A shoulder strengthening system can include a frame, a joint pivotably coupled to the frame, a resistance mechanism coupled to the joint, and a shaft coupled to the joint. Resistance mechanisms can include a first hydraulic member and a second hydraulic member. The first hydraulic member can be configured to restrict relative motion of the joint about a first axis and the second hydraulic member can be configured to restrict relative motion of the joint about a second axis. The shaft and the joint of a shoulder strengthening system can be configured to move together relative to the frame about the first and second axes.

16 Claims, 43 Drawing Sheets

Related U.S. Application Data

(60) Provisional application No. 63/277,071, filed on Nov. 8, 2021, provisional application No. 63/170,372, filed on Apr. 2, 2021.

(52) U.S. Cl.
CPC ..... *A63B 21/4035* (2015.10); *A63B 21/4045* (2015.10); *A63B 21/4047* (2015.10); *A63B 23/1245* (2013.01); *A63B 2220/16* (2013.01); *A63B 2220/833* (2013.01)

(58) Field of Classification Search
CPC ..... A63B 21/4045; A63B 21/4047; A63B 23/1245; A63B 2220/16; A63B 2220/833
See application file for complete search history.

(56) References Cited

U.S. PATENT DOCUMENTS

| | | | | |
|---|---|---|---|---|
| 4,629,185 | A | 12/1986 | Amann | |
| 4,872,668 | A | 10/1989 | McGillis et al. | |
| 5,013,034 | A | 5/1991 | March et al. | |
| 5,058,887 | A * | 10/1991 | Patterson | A63B 21/00072 482/113 |
| 5,178,160 | A | 1/1993 | Gracovetsky et al. | |
| 5,244,444 | A | 9/1993 | Wostry | |
| 5,755,645 | A * | 5/1998 | Miller | A63B 21/153 482/903 |
| 6,676,570 | B2 | 1/2004 | Valentino | |
| 7,115,078 | B1 | 10/2006 | Kalember et al. | |
| 8,360,935 | B2 | 1/2013 | Olsen et al. | |
| 8,636,630 | B2 * | 1/2014 | Morris | A63B 23/1209 482/117 |
| 9,861,856 | B1 | 1/2018 | Miller et al. | |
| 10,010,779 | B2 * | 7/2018 | Goldberg | A63B 23/1209 |
| 10,022,578 | B2 | 7/2018 | Kelly | |
| 10,159,871 | B2 | 12/2018 | Miller et al. | |
| 10,279,210 | B2 * | 5/2019 | Ky | A63B 21/151 |
| 10,357,678 | B2 | 7/2019 | Brown | |
| 10,427,000 | B1 | 10/2019 | Miller et al. | |
| 10,449,413 | B2 | 10/2019 | Goldston et al. | |
| 10,888,732 | B2 * | 1/2021 | Miller | A63B 21/4043 |
| 11,103,751 | B2 | 8/2021 | Miller et al. | |
| 12,011,639 | B2 | 6/2024 | Miller et al. | |
| 2003/0013586 | A1 | 1/2003 | Rothschild | |
| 2007/0066918 | A1 | 3/2007 | Dewald et al. | |
| 2007/0184941 | A1 | 8/2007 | Krietzman | |
| 2008/0234116 | A1 | 9/2008 | Elzerman | |
| 2011/0300994 | A1 | 12/2011 | Verkaaik et al. | |
| 2012/0109025 | A1 * | 5/2012 | Weinberg | A63B 24/0087 601/5 |
| 2013/0338547 | A1 * | 12/2013 | Shimizuhira | A61H 1/0274 601/33 |
| 2017/0132947 | A1 | 5/2017 | Maeda et al. | |
| 2021/0291010 | A1 | 9/2021 | Miller et al. | |
| 2021/0387055 | A1 | 12/2021 | Miller et al. | |
| 2022/0143455 | A1 | 5/2022 | Miller et al. | |
| 2023/0226406 | A1 | 7/2023 | Mickolio | |
| 2024/0123289 | A1 | 4/2024 | Miller et al. | |

FOREIGN PATENT DOCUMENTS

| | | | |
|---|---|---|---|
| JP | 2007-050249 | 3/2007 | |
| WO | WO 85/01446 | 4/1985 | |
| WO | WO 96/12528 | 5/1996 | |
| WO | WO 2004/073804 | 9/2004 | |
| WO | WO 2005/074373 | 2/2005 | |
| WO | WO 2005/032663 | 4/2005 | |
| WO | WO 2021/188780 | 9/2021 | |
| WO | WO 2022/104312 | 5/2022 | |
| WO | WO 2022/212904 | 10/2022 | |
| WO | WO-2005032663 A1 * | 4/2025 | A63B 23/03541 |

OTHER PUBLICATIONS

International Search Report and Written Opinion for related International Application No. PCT/US2022/023150, mailed Jul. 5, 2022, 12 pages.

International Search Report and Written Opinion dated Jan. 27, 2023, from International Patent Application No. PCT/US2022/045755, 9 pp.

Supplementary European Search Report dated Jan. 23, 2025, from European Patent Application No. 22782330.9, 9 pp.

Notice of Reasons for Refusal dated Jan. 23, 2026, from Japanese Patent Application No. 2023-560393, 8 pp.

* cited by examiner

SHOULDER STRENGTHENING SYSTEMS

CROSS-REFERENCED TO RELATED APPLICATIONS

This application is the U.S. National Stage of Internation Application No. PCT/US2022/045755, files Oct. 5, 2022, which is a continuation-in-part of International Patent Application No. PCT/US2022/023150, filed Apr. 1, 2022, and claims the benefit of U.S. Provisional Application No. 63/277,071, filed Nov. 8, 2021. International Patent Application No. PCT/US2022/023150, filed Apr. 1, 2022, claims the benefit of U.S. Provisional Application No. 63/277,071, filed Nov. 8, 2021, and U.S. Provisional Application No. 63/170,372, filed Apr. 2, 2021. All of the above-listed applications are incorporated by reference herein.

FIELD

The present disclosure relates generally to exercise equipment, and more particularly to exercise equipment for shoulder strengthening.

BACKGROUND

Physical therapy treatment and the exercises used for shoulder strengthening are currently hampered by a lack of dynamic, weight-bearing equipment, that can isolate the shoulder joint in 360 degrees of motion. Because surgical procedures alone are unable to fully repair one's shoulder, physicians and patients are left reliant on conventional exercise equipment for rehabilitation. The existing shortcomings in shoulder rehabilitation, especially post-surgery rehabilitation, are attributable to the limited utility of elastic bands, medicine balls, dumbbells, and other conventional weight-room equipment typically used to strengthen the shoulder. Conventional exercise equipment, for instance, only allow for resistance in one plane of shoulder-joint motion at any one time, such as motion in the coronal plane about an anterior-posterior axis, and motion in the sagittal plane about a medial-lateral axis. A shoulder strengthening system that can address the significant lack of dynamic weight bearing equipment in the current field of physical therapy and shoulder recovery is needed.

SUMMARY

According to an aspect of the disclosed technology, an exercise apparatus can include a frame, a joint pivotably coupled to the frame, a resistance mechanism coupled to the joint, a shaft coupled to the joint, and a wrist-ring structure coupled to the shaft. The shaft, the wrist-ring structure, and the joint can move together relative to the frame, and the resistance mechanism can be configured to restrict movement of the joint relative to the frame.

In another representative embodiment, an exercise apparatus can include a frame, a joint pivotably coupled to the frame, and a resistance mechanism coupled to the joint. The exercise apparatus can also include a first hydraulic member and a second hydraulic member, the first hydraulic member can be configured to restrict relative motion of the joint about a first axis and the second hydraulic member can be configured to restrict relative motion of the joint about a second axis. The exercise apparatus can further include a shaft coupled to the joint and a wrist-ring structure coupled to the shaft. The shaft, the wrist-ring structure, and the joint can be configured to move together relative to the frame about the first and second axes.

In another representative embodiment, an exercise apparatus can include a frame, a joint pivotably coupled to the frame, a resistance mechanism coupled to the joint, a shaft assembly coupled to the joint, and a wrist-ring structure coupled to the shaft assembly. The shaft assembly can include a first member and a second member coaxially aligned with and slidably coupled to the first member. The shaft assembly, the wrist-ring structure, and the joint can move together relative to the frame and the resistance mechanism can be configured to restrict movement of the joint relative to the frame.

In another representative embodiment, an exercise apparatus can include a frame, a joint pivotably coupled to the frame, a resistance mechanism coupled to the joint, a shaft coupled to the joint, and a wrist-ring structure coupled to the shaft. The wrist-ring structure can include a ring, a shuttle movably coupled to the ring, and a brace coupled to the shuttle. The shuttle and brace can be configured to move along a circumference of the ring and about a first axis of the wrist-ring structure. The shaft, the wrist-ring structure, and the joint can move together relative to the frame and the resistance mechanism can be configured to restrict movement of the joint relative to the frame.

In another representative embodiment, an exercise apparatus can include a frame, a joint moveably coupled to the frame, a resistance mechanism coupled to the joint, a shaft coupled to the joint, and a wrist-ring structure coupled to the shaft. The shaft and the wrist-ring structure, and the joint can move together relative to the frame about first, second, and third axes. The resistance mechanism can be configured to restrict movement of the joint relative to the frame.

The foregoing and other objects, features, and advantages of the technology will become more apparent from the following detailed description, which proceeds with reference to the accompanying figures.

DETAILED DESCRIPTION

General Considerations

Figure 1:
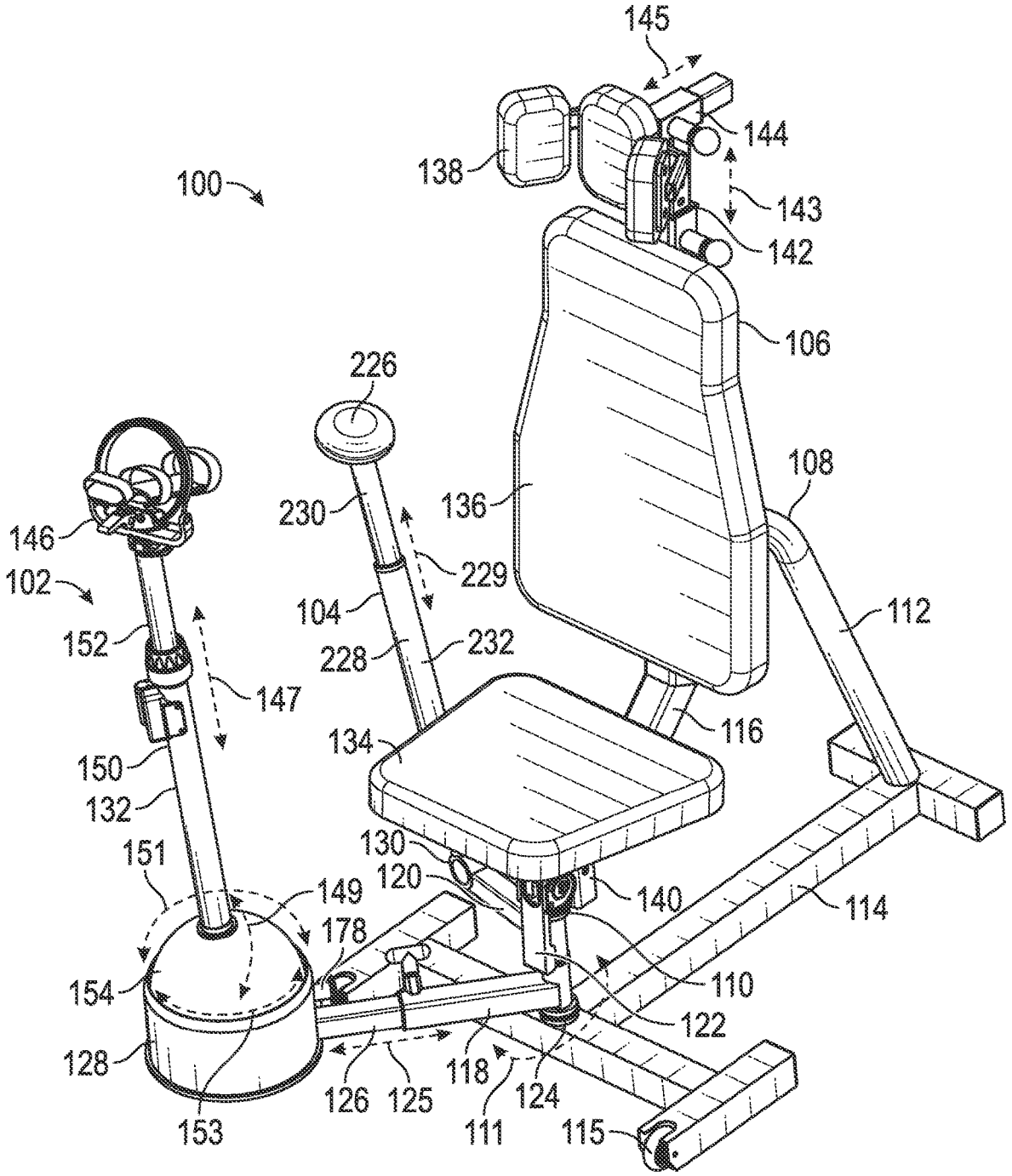
FIG. 1 is a perspective view of a shoulder strengthening system, according to one example.

The systems, apparatus, and methods described herein should not be construed as limiting in any way. Instead, the present disclosure is directed toward all novel and non-obvious features and aspects of the various disclosed examples, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present, or problems be solved. Any theories of operation are to facilitate explanation, but the disclosed systems, methods, and apparatus are not limited to such theories of operation.

In some examples, values, procedures, or apparatus are referred to as "lowest," "best," "minimum," or the like. It will be appreciated that such descriptions are intended to indicate that a selection among many used functional alternatives can be made, and such selections need not be better, smaller, or otherwise preferable to other selections.

As used in the application and in the claims, the singular forms "a," "an," and "the" include the plural forms unless the context clearly dictates otherwise. Additionally, the term "includes" means "comprises." Further, the terms "coupled" and "connected" generally mean electrically, electromagnetically, and/or physically (e.g., mechanically or chemically) coupled or linked and does not exclude the presence of intermediate elements between the coupled or associated items absent specific contrary language.

Directions and other relative references (e.g., inner, outer, upper, lower, etc.) may be used to facilitate discussion of the drawings and principles herein, but are not intended to be limiting. For example, certain terms may be used such as "inside," "outside," "top," "down," "interior," "exterior," and the like. Such terms are used, where applicable, to provide some clarity of description when dealing with relative relationships, particularly with respect to the illustrated examples. Such terms are not, however, intended to imply absolute relationships, positions, and/or orientations. For example, with respect to an object, an "upper" part can become a "lower" part simply by turning the object over. Nevertheless, it is still the same part and the object remains the same. As used herein, "and/or" means "and" or "or," as well as "and" and "or."

Examples of the Disclosed Technology

There is a growing consensus among physical therapists and medical practitioners that the use of elastic bands and other conventional equipment used for shoulder rehabilitation show a lack of efficacy. The shoulder joint is a ball-in-socket joint that has nearly 360 degrees of motion in multiple planes, making it the most dynamic and unstable joint in the body. Indeed, the most common muscles and joint injuries among athletes and the general population are the various muscles that attach around the shoulder joint as well as the surrounding cartilage and the labrum. For this reason, an exercise system which can advance the current state of available equipment for shoulder rehabilitation is needed.

The shoulder strengthening systems disclosed herein can provide multidirectional and dynamic resistance to shoulder movement of a user. Resistance mechanisms of the shoulder strengthening systems can utilize a hydraulic system to apply a resistive force to a joint and a telescoping shaft coupled to the joint. The shaft can be maneuverable along the full range of motion provided by the joint, but the movement of the shaft can be limited or restricted in all planes of motion by the hydraulic system which can apply variable resistance. A wrist-ring structure at the end of the telescoping shaft can allow a user of the shoulder strengthening system to manipulate the shaft while the resistive force is applied, providing dynamic resistance to the user's shoulder as the user manipulates the shaft. The wrist-ring structure can also be configured to support a user's hand and wrist, while allowing relatively free motion of the wrist when such movement is desired and restricting movement of the wrist when such movement is undesired.

The disclosed shoulder strengthening systems can provide dynamic and seamless motion via the shaft and wrist-ring structures which closely reflects the natural motion of the human arm and shoulder joint. The shoulder joint rarely acts in a vacuum and in a single plane of motion at a time. By having a shoulder strengthening system that can provide resistance at each physiological plane and angle, this will reproduce as closely to physiologically possible, what the shoulder joint experiences during motion, which can provide significant advantages over conventional equipment used in shoulder strengthening and rehabilitation.

Figure 3:
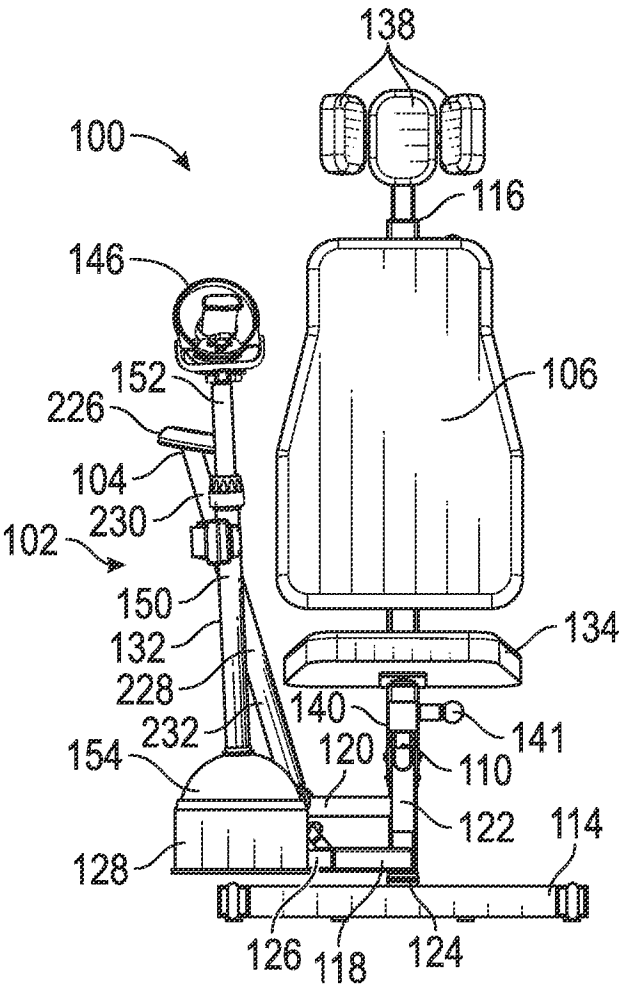
FIG. 3 is a front plan view of the shoulder strengthening system of FIGS. 1-2.
Figure 2:
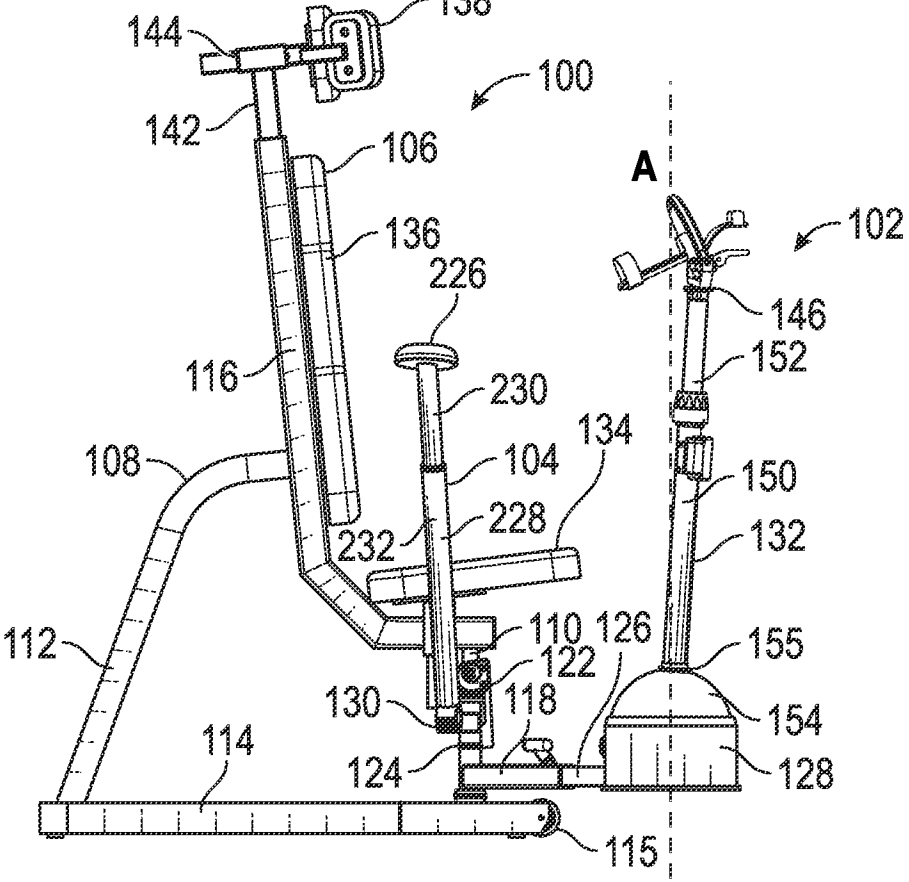
FIG. 2 is a side view of the shoulder strengthening system of FIG. 1.

FIGS. 1-8D depict an exemplary shoulder strengthening system 100 according to one example. As depicted in FIGS. 1-3, the shoulder strengthening system 100 can include a resistance system 102, a support 104, and chair structure 106 mounted to a frame 108. The frame 108 can have a pair of interconnected, upwardly extending posts 110, 112 coupled to the frame's base 114 at the front and rear. The front and rear posts 110, 112 are interconnected by a strut 116. The strut 116 extends from the front post 110 to the rear post 112 and upwardly beyond the upper most end of the rear post 112 to form the backbone of the chair structure 106. The front post 110 can be vertical or substantially vertical relative to the base 114 of the frame 108, while the rear post 112 can extend upwardly at an angle relative to the base 114 and curve toward the strut 116. In some examples, the base 114 includes one or more wheels 115 at the front (FIGS. 1-3) and/or rear of the base 114 configured to allow the shoulder strengthening system 100 to be readily moved from one location to another.

As illustrated in FIGS. 1-3, the resistance system 102 and support 104 are coupled to the front post 110 of the frame 108 via outwardly extending arms 118, 120, respectively. Each arm 118, 120, for instance, is hinged to the front post 110 of the frame 108 and configured to freely rotate (e.g., clockwise and counterclockwise) about the front post 110 and relative to one another, as well as the frame 108 and the chair structure 106. As illustrated in FIG. 1, the arms 118, 120 extend over the first post 110 and are stacked atop one another. For example, the arm 120 coupled to the support 104 is located above and proximate the arm 118 coupled to the resistance system 102. In this way, the arms 118, 120 can be referred to as lower and upper arms, which rotate about the same axis formed by the front post 110. The frame 108 also includes a lever 122 located just above the upper arm 120 and is configured to apply a downward force on the upper arm 120 such that the upper arm 120 applies a downward force on the lower arm 118 and the base 114 of the frame 108. A pair of interlocking washers 124 can be coaxially aligned with the front post 110 and positioned between the lever 122 and the upper arm 120, the lower and upper arms 118, 120, and/or the lower arm 118 and the base 114.

Each washer of a pair of interlocking washers 124 can be coupled to its respective adjacent structure, such as the base 114, lower arm 118, upper arm 120, or the lever 122. For example, one washer can be coupled to the bottom end of the upper arm 120 and another washer can be coupled to the upper end of the lower arm 118. In this arrangement, the arms 118, 120 and thereby both the resistance system 102 and support 104 can be locked into a desired position relative to the chair structure 106 and one another when the lever 122 applies a downward force on the arms 118, 120. By way of example, when the lever 122 is in a first position (e.g., in a downward direction; FIGS. 1-3) the lever 122 exerts downward pressure to the upper and lower arms 120, 118. The downward pressure acting on the arms 118, 120 causes the interlocking washers 124 to mate and interlock to prevent the rotation of the lower and upper arms 118, 120 and lock them into a desired position. Inversely, when the lever 122 is in a second position (e.g., directed in an outward direction) the lower and upper arms 118, 120 are free to rotate about the front post 110. In this configuration, the arms 118, 120, and therefore the resistance system 102 and support 104, are configured to rotate 360 degrees about the front post 110, as indicated by arrow 111, but can be placed and locked into a variety of desired positions.

In some examples, the arms 118, 120 can be positioned in an opposite arrangement. For instance, the arm 120 coupled to the support 104 can be stacked below the arm 118 coupled to the resistance system 102 such that the arm 120 is a lower arm and the arm 118 is an upper arm. In still further examples, each washer of each pair of washers 124 can include teeth or ridges which are configured to mate and interlock with a corresponding washer such that movement of the arms are restricted when pressure applied by the lever forces the pair of washers to contact one another.

As shown in FIGS. 1-3, the lower arm 118 can be configured as one half of an adjustable assembly. The lower arm 118 can be configured, for instance, to receive a corresponding slidable structure 126 of the adjustable assembly extending outwardly from a base 128 of the resistance system 102. In this way, the resistance system 102 can be positioned at varied lengths or distances relative to the front post 110 of the frame 108 and the chair structure 106, as indicated by arrows 125 (FIG. 1). A clamping screw, for example, can be operable to engage and release the slidable structure 126 of the resistance system 102. This, for instance, allows the distance between the base 128 and the front post 110 to be increased and decreased, thereby rendering the position of the resistance system 102 adjustable relative to the chair structure 106. In other examples, however, the lower arm 118 and/or corresponding structure of the resistance system 102 can be configured in a variety of ways, including various adjustable assemblies and systems, which allow the resistance system 102 and its base 128 to be positioned relative to the chair structure 106.

As illustrated in FIG. 1, the support 104 and upper arm 120 can be coupled in such a way as to allow the support 104 to be positioned in a variety of different orientations relative to the chair structure 106. For instance, the upper arm 120 and support 104 can be coupled by way of a pivotable joint 130 such that the support 104, and a shaft 228 thereof, can pivot relative to the upper arm 120, including toward and away from the chair structure 106. In this way, the support 104 can also be adjustable relative to the chair structure 106 and the other components of the shoulder strengthening system 100. In some examples, the upper arm 120 can also be configured as an adjustable assembly such that the distance between the front post 110 and the joint 130 can also be adjustable. For example, this can be achieved in a similar fashion as the adjustable assembly configured to adjust the relative distance between the resistance system 102 and the front post 110. In still further examples, a portion of the upper arm 120 can be configured to rotate from side-to-side such that the support 104 can move in a clockwise and counterclockwise direction relative to the upper arm 120, such as in a frontward and rearward direction (e.g., clockwise and counterclockwise in a vertical plane parallel to the chair structure 106).

Referring to FIGS. 1-3, the chair structure 106 coupled to the frame 108 can include a seat 134, a backrest 136, and a headrest 138, each of which can be formed of padded structure. As depicted in the illustrated examples, the seat 134 and headrest 138 can each be adjustable to accommodate the height and size of a user seated in the chair structure 106. The seat 134, for instance, can be coupled to the strut 116 via a pull-pin adjustable assembly 140 (FIGS. 1 and 3), permitting the seat 134 to be adjusted upward and downward relative to the base 114 of the frame 108 via a pin 141 (FIG. 3). The pin 141 (e.g., a T-handle pin, spring-loaded pin, clamping screw, etc.) can be operable to engage and release the slidable structure of the seat 134, such as by mating the pin with one or more apertures along the surface of the slidable structure. Similarly, the headrest 138 can be adjusted upward and downward, as indicated by arrows 143, relative to the backrest 136 and seat 134 via a pull-pin adjustable assembly 142. The pull-pin adjustable assembly 142 in this instance, can be integrated in combination with the upper end of the strut 116 (e.g., the strut 116 can receive a slidable portion of the assembly). Moreover, the headrest 138 can be adjusted frontward and rearward, as indicated by arrows 145, via a pull-pin adjustable assembly 144 (FIGS. 1-2).

As illustrated in FIGS. 1 and 3, the headrest 138 includes three padded structures, the first padded structure being oriented similarly to the backrest 136, while the other two padded structures are angled outwardly relative to the first. In this curved-like arrangement, the headrest 138 is configured to provide stability and support to the neck and head of a user seated in the chair structure 106. Providing support and stability through limiting rearward motion of the head and neck for example. The two angled, outer padded structures, in some examples, can also act to limit lateral movement of the head to help the user seated in the shoulder strengthening system 100 to maintain a desired posture, such as in maintaining proper alignment of the head, neck, and spine. Maintaining alignment of the head, neck, and spine can encourage focused engagement of the user's arm, shoulder, and/or those portions of the anatomy surrounding the shoulder joint (e.g., surrounding muscle tissue). In other words, maintaining alignment can limit a user's engagement of the anatomy outside of the shoulder area (e.g., hips, lower back, etc.), which can otherwise detract from the focused and isolated movement of exercises directed to shoulder strengthening. Nonetheless, the headrest 138 can be configured to allow any body movement of the user, if desired. Although, the headrest 138 is described herein as including three padded structures, in other examples, the headrest 138 can include any fewer or greater number of padded structures.

In addition to, or in lieu of, using the outer padded structures of the headrest 138 to help the user seated at the shoulder strengthening system 100 to maintain a desired posture, the chair structure 106 can also include one or more fasteners (not shown) configured to restrict movement of the head, torso, and/or legs. For instance, the backrest 136 and/or headrest 138 can include a strap which extends across the corresponding anatomy of the user to reduce or prevent forward and/or lateral movement of the torso and/or head relative to the chair structure 106 while in use. Similarly, the seat 134 can include a strap to extend across the legs of the user seated, to reduce or prevent upward movement and/or maintain leg spacing and alignment relative to the user's hips.

Though the frame 108, chair structure 106, arms 118, 120, and their respective components, are described and depicted with particularity, it should be appreciated that these features can be constructed and/or arranged in a number of different ways in accordance with the functionality and principles described herein. As one example, the arms 118, 120 need not be stacked atop each other or coupled to the same element of the frame, but rather can be spaced from one another along the base, and pivot and/or rotate about separate axes.

Still referring to FIGS. 1-3, the resistance system 102 can include a base 128, a shaft 132 coupled to the base 128 via a pivotable joint 156 (FIG. 4), and a wrist-ring structure 146 coupled to the shaft 132. The resistance system 102 can also include a resistance mechanism 148 (FIG. 4) configured to restrict movement of the shaft 132 and the wrist-ring structure 146 relative to the base 128. The base 128 can form a housing and structural support for the pivotable joint 156 and resistance mechanism 148. The base 128 can also include the outwardly-extending slidable structure 126 received by the lower arm 118 that forms one half of the corresponding adjustable assembly. In this configuration, and as mentioned previously, the resistance system 102 and the components thereof, can be adjusted relative to and rotate about an axis formed by the front post 110, and be secured in a desired position via the lever 122 and interlocking washers 124.

As depicted in FIG. 2, the base 128 can include a central longitudinal axis A extending upwardly from the base 128. The longitudinal axis A can be perpendicular to the bottom surface of the base 128 or a ground surface on which the shoulder strengthening system 100 is located. The longitudinal axis A can also define an origin in which movement of the other components of the resistance system 102, including the shaft 132 and wrist-ring structure 146, can be described. For instance, movement of the individual or collective components of the resistance system 102 can be described relative to the longitudinal axis A.

Figure 7B:
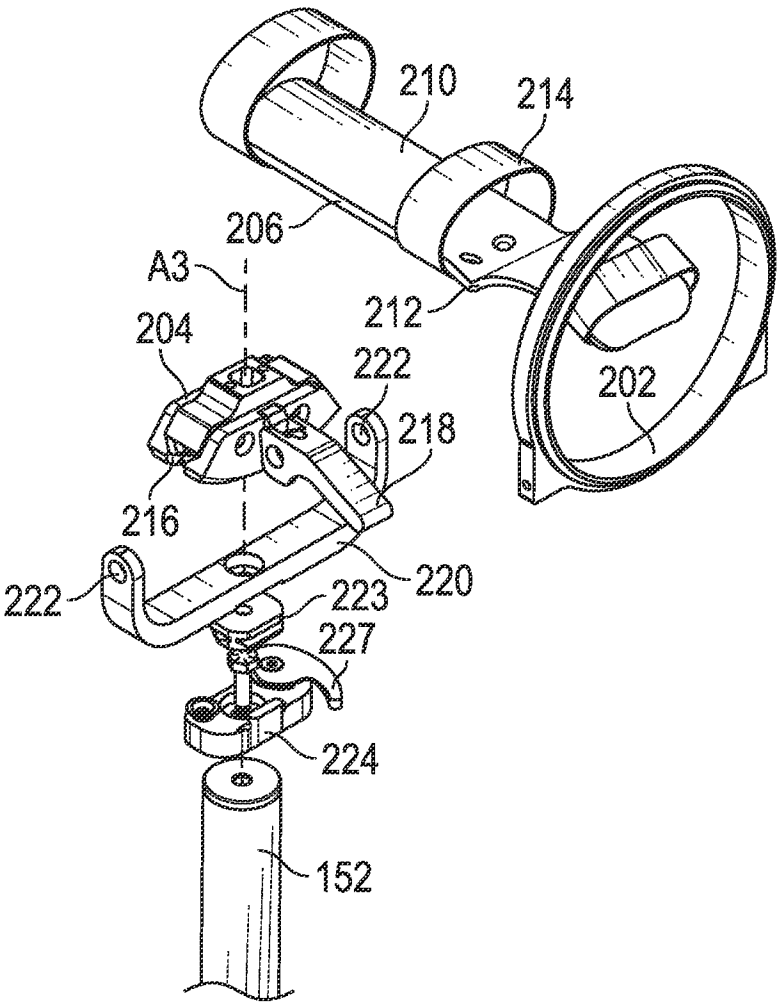
FIG. 7B is an exploded view of the wrist-ring structure of FIG. 7A.
Figure 7A:
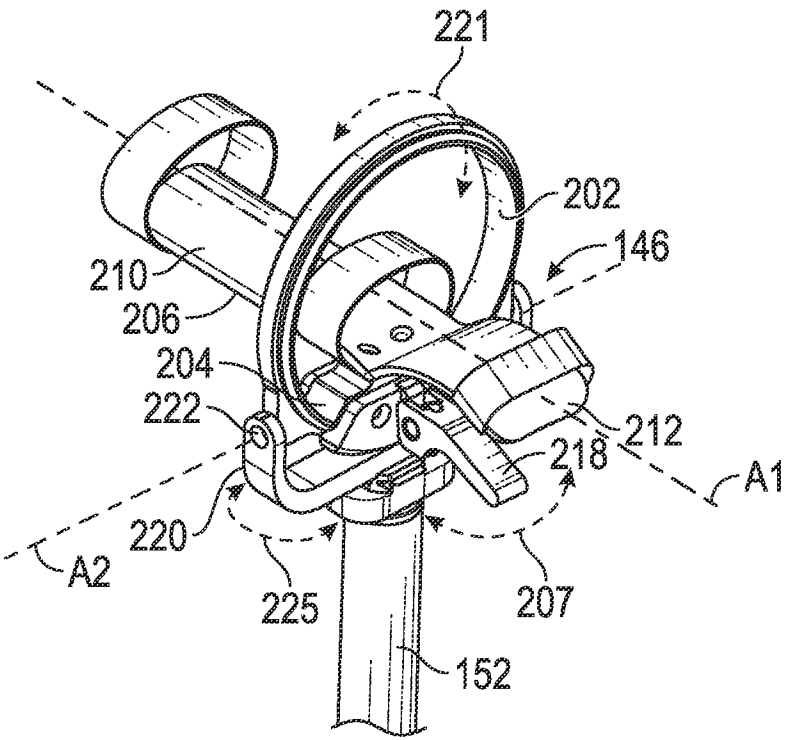
FIG. 7A is a perspective view of a wrist-ring structure of the shoulder strengthening system of FIGS. 1-3.
Figure 8A:
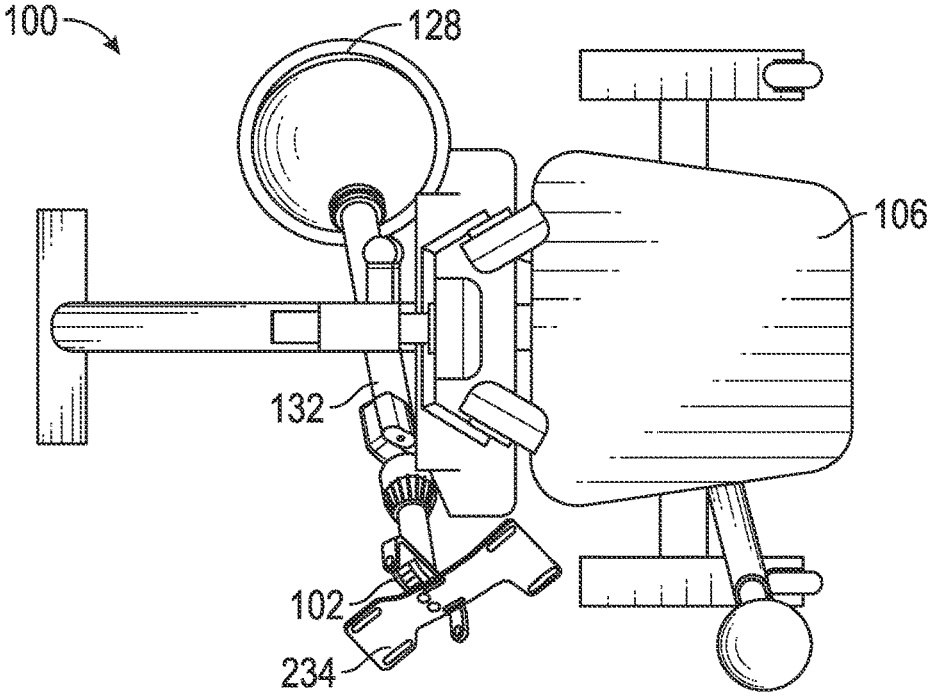
FIG. 8A is a top-down view of the shoulder strengthening system, according to a second configuration.
Figure 8B:
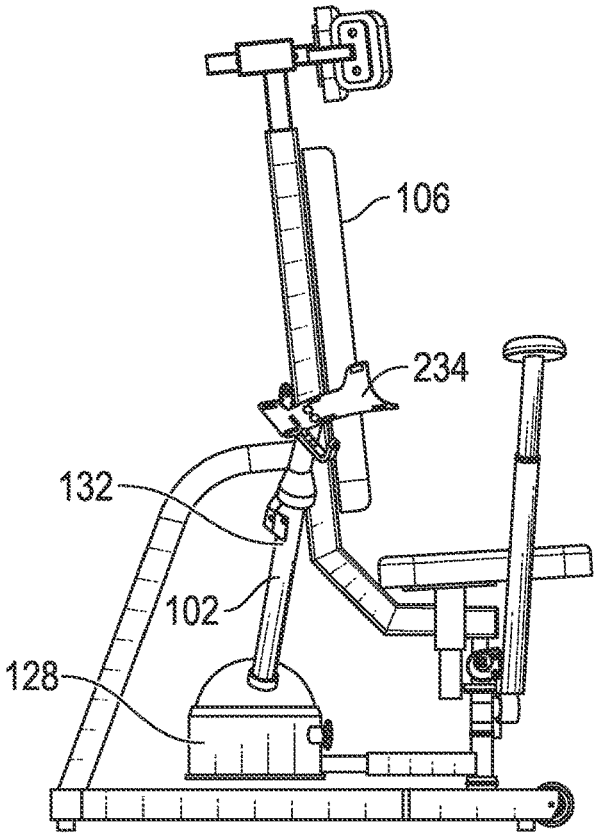
FIG. 8B is a side view of the shoulder strengthening system of FIG. 8A.
Figure 8C:
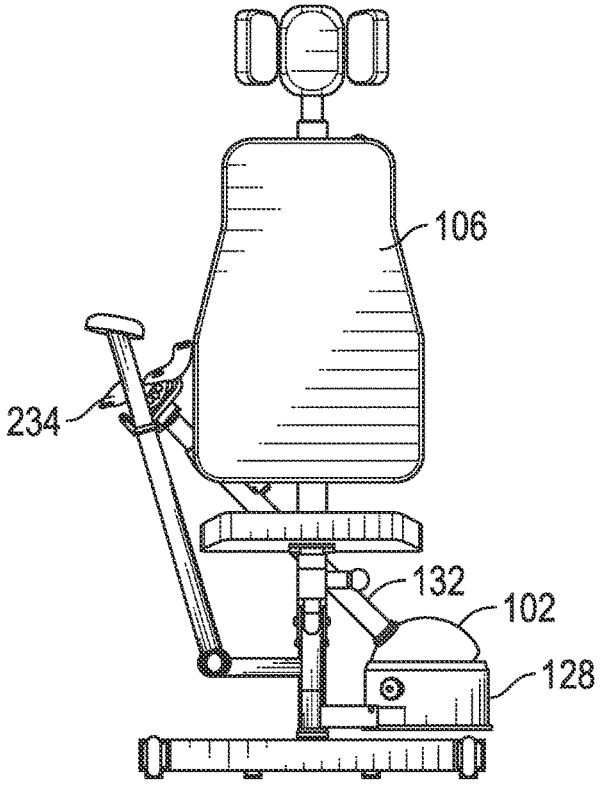
FIG. 8C is a front plan view of the shoulder strengthening system of FIGS. 8A-8B.
Figure 8D:
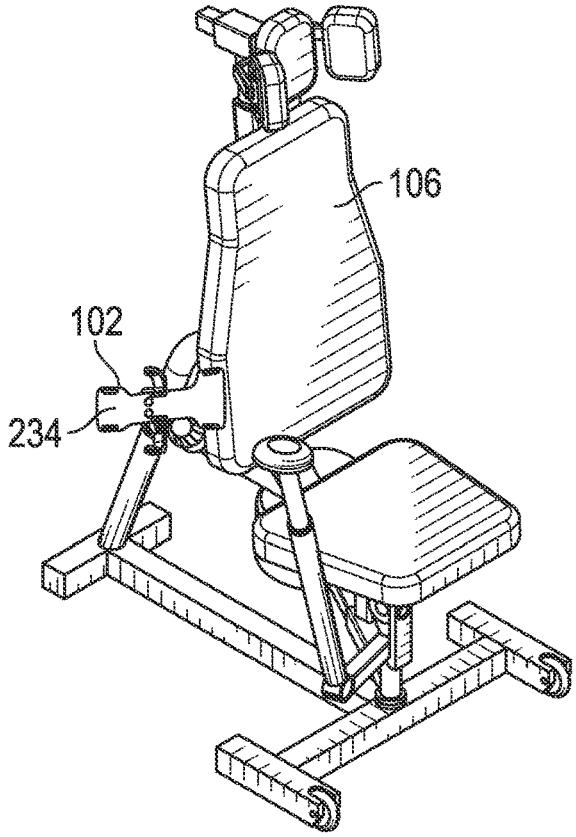
FIG. 8D is a perspective view of the shoulder strengthening system of FIGS. 8A-8C.

As shown in FIGS. 1-3, the shaft 132 can include an outer, first member 150 and an inner, second member 152 which can be slidably coupled to the first member 150, as generally indicated by arrows 147. The first member 150 can be coupled to the universal joint 156 (FIG. 4), and a cover 154 (e.g., via a nut 155 in FIG. 4) that encloses the universal joint 156 and resistance mechanism 148 within the body of the base 128. The upper end of the second member 152 can be coupled to the wrist-ring structure 146. The wrist-ring structure 146 can be configured to brace the wrist and thereby the arm and hand of a user and permit the wrist to rotate and pivot about multiple axes (FIGS. 7A-7B). The wrist-ring structure 146 can also be configured to restrict or limit certain wrist movement, such as when certain wrist or arm movement is undesirable for a given exercise. As described herein, the shaft 132 and wrist-ring structure 146 are capable of multidirectional movement relative to the longitudinal axis A and base 128 via the operation of the universal joint 156. This multidirectional movement is generally indicated, for example, by arrows 149, arrows 151, and arrows 153 (FIG. 1). The resistance mechanism 148 can be operable to apply a resistive force to the universal joint 156 to restrict the movement of the shaft 132 and wrist-ring structure 146 relative to the base 128 and chair structure 106 (e.g., the longitudinal axis A) as a user manipulates the shaft 132 and wrist-ring structure 146 along the range of motion provided by the joint 156.

Figure 4:
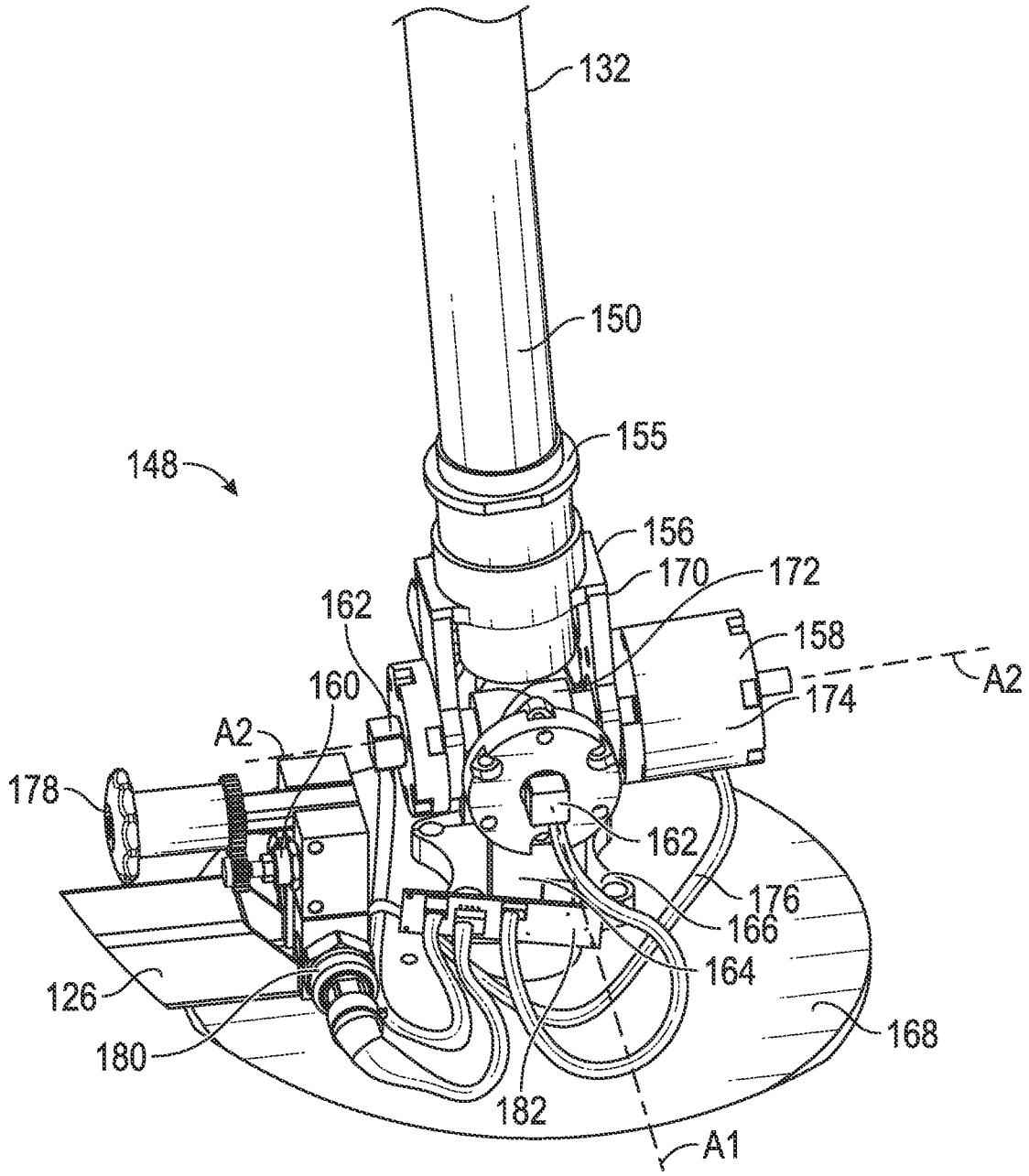
FIG. 4 is a perspective view of a resistance mechanism according to one example.

FIG. 4 depicts the universal joint 156 and resistance mechanism 148 enclosed within the base 128 and cover 154 according to one example. As illustrated in FIG. 4, the shaft 132 and the resistance mechanism 148, which can include a pair of hydraulic members 158, one or more variable flow valves 160, and one or more sensors 162, can be coupled to the universal joint 156. The universal joint 156 can include a first fork or yoke 164 integrated with a bracket 166 and coupled to a base plate 168 (e.g., bolted, screwed, welded, etc.). The base plate 168, for instance, can form the bottom surface of the base 128 and/or be coupled to the slidable structure 126 which extends through and outwardly from the base 128 to mate with the lower arm 118. In some examples, the base plate 168 can be situated within the base 128. In this configuration, the universal joint 156 can be said to be coupled to the frame 108 of the shoulder strengthening system 100.

The universal joint 156 can also include a second fork or yoke 170 coupled to the first member 150 of the shaft 132 and the first yoke 164 of the joint via a spider or cross 172. In this configuration, the first yoke 164 and cross 172 form a first pivot axis A1, while the second yoke 170 and the cross 172 form a second pivot axis A2 perpendicular to the first pivot axis A1. In some examples, the cross 172 can be constructed of one or more components and/or can be configured to prevent or allow the shaft 132 to extend therethrough (e.g., as shown in FIGS. 4 and 5A, respectively).

The configuration of the universal joint 156 can allow the shaft 132 to move or pivot relative to the base 128 and about the longitudinal axis A (FIG. 2) in multiples directions and planes of motion. As an example, via its coupling to the universal joint 156, the shaft 132 is configured to freely move 360 degrees in both clockwise and counterclockwise directions about the longitudinal axis A (e.g., looking down or up the axis A). The universal joint 156 also allows the shaft 132 and wrist-ring structure 146 to be positioned in alignment with and at various angles relative to the longitudinal axis A. For example, the shaft 132 can be aligned with and moved in any direction away from the longitudinal axis A such that the shaft 132 forms an angle relative to the longitudinal axis A (e.g., the slight angle the shaft 132 forms with longitudinal axis A in FIG. 2). In this way, the shaft 132 can move seamlessly between any number of positions within the range of movement permitted by the universal joint 156. This configuration, for example, allows a user whose hand or wrist is secured to the wrist-ring structure 146 to move the shaft 132 along a relatively full range of arm and shoulder motion relative to the chair structure 106.

In some examples, the shaft 132 can move in any direction and form an angle relative to the longitudinal axis A at angles greater than 90 degrees. In other examples, the range of motion of the shaft 132 can be more restricted, such that an angle the shaft 132 can form relative to the longitudinal axis A can be any angle ranging from 0 degrees to 90 degrees, or any angle ranging from 0 degrees to 60 degrees, or within a relatively more restricted range.

In some examples, the first member 150 of the shaft 132 can be fixed relative to the second yoke 170 in such a way that the first member 150 does not rotate relative to the second yoke 170. The orientation of the first member 150, as well as the second member 152, in this example can be maintained while the shaft 132 moves about the longitudinal axis A. In other examples, however, the first member 150 can be coupled to the second yoke 170 in such a way that the first member 150 is free to rotate relative to the second yoke 170.

A resistance applied to the movement of the shaft 132 and thereby the resistance applied to a user's shoulder and arm, can be provided by the resistance mechanism 148. The resistance mechanism 148 operates to restrict movement of the universal joint 156 via the hydraulic members 158 and flow valves 160. The hydraulic members 158, for instance, can act to create a load between the cross 172 and the first and second yokes 164, 170 to provide variable resistance at the first and second pivot axes A1, A2 of the universal joint 156. In other words, the hydraulic members 158 act to restrict the movement of each yoke 164, 170 relative to the cross 172 in order to generate the resistance. While only one hydraulic member 158 is shown in FIG. 4, it should be understood that the second hydraulic member 158 can be coupled to the first yoke 164 on the opposite side of the resistance mechanism 148 shown in FIG. 4, such that the hydraulic members 158 lie within a common plane and form a 90-degree angle relative to one another.

Each hydraulic member 158 can include an axle (not shown) extending through a respective yoke and coupled to a corresponding point of the cross 172. Specifically, the axle or shaft of one hydraulic member 158 can extend through an opening of the first yoke 164 and into the cross 172, while the axle or shaft of the second hydraulic member 158 can extend through an opening of the second yoke 170 and into the cross 172 (e.g., the hydraulic member 158 shown in FIG. 4). In this arrangement, one hydraulic member 158 lies along the first pivot axis A1 formed by the first yoke 164 and cross 172, and the second hydraulic member 158 lies along the second pivot axis A2 formed by the second yoke 170 and cross 172. The hydraulic members 158 in this way, are operative to produce restrictive rotational forces acting between the first yoke 164 and the first pivot axis A1, and the second yoke 170 and second pivot axis A2 to provide the resistance to the user's movement of the shaft 132.

The housing 174 of each hydraulic member 158 can be coupled to the outer surface of its respective yoke 164, 170 and configured to rotate relative to its central axle or shaft. As such, the housing 174 of each hydraulic member 158 and its respective yoke move with one another in combination as the yoke pivots about the corresponding central axle and pivot axis (e.g., the first and second pivot axes A1, A2 of the universal joint 156).

Each hydraulic member 158, via hydraulic pressure, can be configured to restrict the relative rotation between its respective axle and housing 174 such that movement of the universal joint 156 about the first and second pivot axes A1, A2 can be restricted as the housing 174 resists movement of its corresponding yoke. Consequently, a resistive force can be applied to the shaft 132 in such a way that the multidirectional movement of the shaft 132 can be restricted, but the shaft 132 remains operable to move about the full range of motion provided by the universal joint 156. In particular, the shaft 132 can be manipulated along the full range of motion of the universal joint 156, but the ease or difficulty to which the shaft 132 is able to move can be modified via the force applied by the hydraulic members 158. For example, rotational movement of the universal joint 156 about the first and/or second pivot axes A1, A2 drives the hydraulic members 158, moving fluid through the hoses coupled to the members and variable flow valves 160 to generate the resistance. As such, the resistive force, or the degree to which the movement of the universal joint 156 and thereby movement of the shaft 132 is restricted, can be proportional to the hydraulic pressure of the hydraulic members 158. This hydraulic pressure can be regulated via hydraulic fluid delivered to the hydraulic members 158 by the flow valves 160, to increase and decrease the flow of hydraulic fluid and therefore, the degree of resistance applied to the movement of the shaft 132 and wrist-ring structure 146.

As shown in FIG. 4, each hydraulic member 158 can be coupled to a respective variable flow valve 160 by way of a hose 176. Each flow valve 160 can be linked via gearing to an adjustment knob 178. The knob 178 can, for instance, control both flow valves 160 at the same time to ensure the flow of hydraulic fluid to each member 158 is the same. Having the same flow rate of hydraulic fluid to the hydraulic members 158 can, for example, ensure the resistance applied to the universal joint 156 at the first and second pivot axes is equal (or substantially equal) and thereby, can restrict movement of the shaft 132 uniformly or substantially uniformly across the range of motion provided by the joint 156. As shown in FIG. 1, the knob 178 can be accessible external to the base 128 and therefore, can be easily adjusted.

FIG. 4 also shows the resistance mechanism 148 can include one or more transducers and/or rotational sensors communicatively coupled to a processor board 182. For instance, each hydraulic loop formed of a hydraulic member 158, hose 176, and flow valve 160, can also include a pressure transducer 180. These transducers 180 can be configured to measure pressure differences in the hydraulic loop that result from adjusting the resistance in flow via the adjustment knob 178 and can communicate those measurements to a processor board 182. In addition, the resistance mechanism 148 can also include one or more rotational position sensors 162 (e.g., digital and/or analog rotary encoders) configured to track the angular movement of the first and/or second pivot axes formed by the cross 172 and the first and second yokes 164, 170. In particular, a rotational position sensor 162 can be coupled to the first and second yokes 164, 170 and configured to measure the angular movement of the first and second yokes 164, 170 relative to the cross 172. These angular movements can also be communicated to the processor board 182.

As mentioned, the processor board 182 can be in communication with each transducer 180 and rotational position sensor 162. The processor board 182 can also be in wireless communication, for example, with an optical processor board 184 (FIG. 6B) on the shaft 132 to receive and record the telescoping motion and resistance load. In some examples, the processor board 182 can also be in wireless communication with one or more local or network processing environments (e.g., personal computer(s), mobile device (s), handheld device(s), etc.), web-based applications, and/or cloud computing environments, such that the data from the measurements from the transducers 180, rotational sensors 162, and/or data from the optical processor board 184 can be viewed in real time and/or post measurement. In such instances and in some examples, the flow of the hydraulic fluid can also be adjusted via a web-based application and/or a processing and/or computing environments.

Figure 5B:
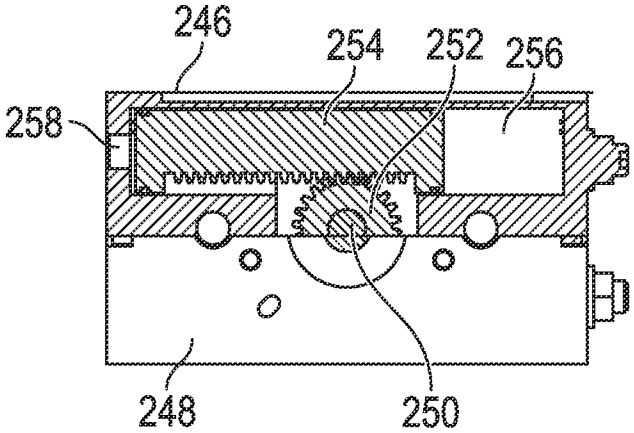
FIG. 5B is a half cross-sectional view of a hydraulic member of the resistance mechanism of FIG. 5A.
Figure 5A:
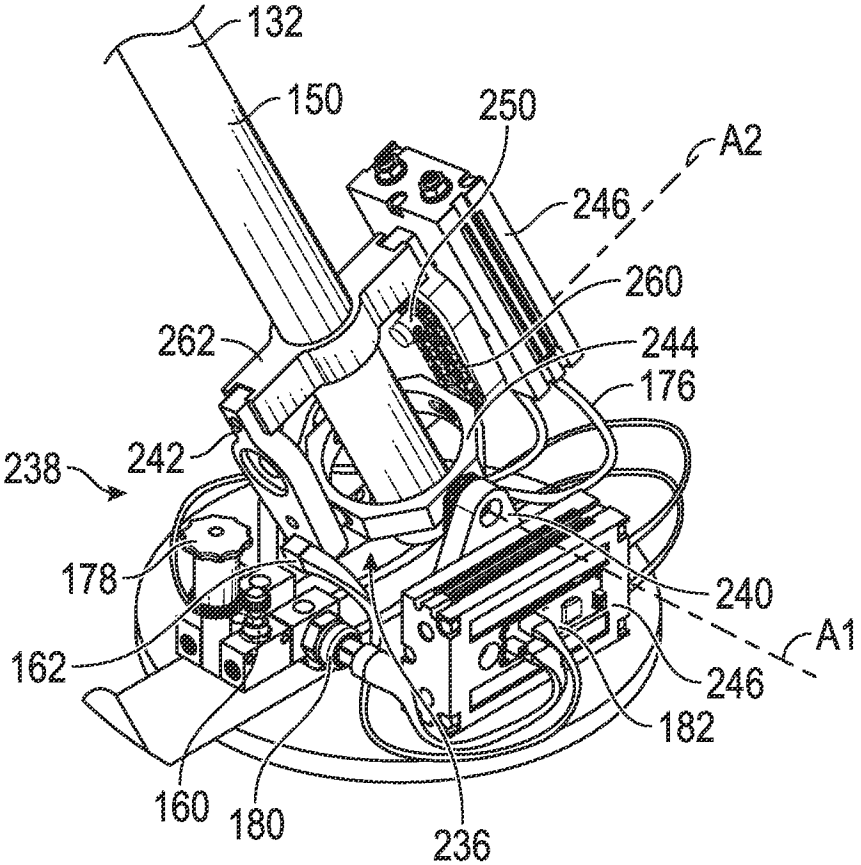
FIG. 5A is a perspective view of a resistance mechanism according to another example.

FIGS. 5A and 5B illustrate a universal joint 236 and resistance mechanism 238 according to another example. The universal joint 236 and resistance mechanism 238 can be structurally and functionally similar to the universal joint 156 and resistance mechanism 148 described herein. For instance, the universal joint 236 can include a first yoke 240 (or bracket) and a second yoke 242 coupled to the first yoke 240 via a central member 244, which operates similarly to the spider or cross 172. In this configuration, the first yoke 240 and the central member 244 form a first pivot axis A1', and the second yoke 242 and the central member 244 form a second pivot axis A2' perpendicular to the first pivot axis A1'.

As shown in FIG. 5A, the first member 150 of the shaft 132 can be coupled to the second yoke 242 via a cross member 262 of the yoke and extend through the opening formed by the central member 244. The opening of the central member 244 can be sized and shaped, for instance, to accommodate movement of the shaft 132 within the space of the opening when the shaft 132 and second yoke 242 are manipulated and moved about the second pivot axis A2'.

Still referring to FIG. 5A, the resistance mechanism 238 can also include all and/or any combination of components of the resistance mechanism 148, including one or more rotational position sensors 162, flow valves 160, pressure transducers 180, hoses 176, knobs 178, and processor boards 182. One difference between the resistance mechanism 238 and the resistance mechanism 148, however, is the hydraulic members used to generate the resistance. Specifically, the hydraulic members 158 of the resistance mechanism 148 are generally described as being configured as a hydraulic radial cylinders or actuators, while the hydraulic members 246 of the resistance mechanism 238 are configured as hydraulic gear assemblies.

As illustrated in FIG. 5B, which shows a half cross-sectional view of one of the hydraulic members 246, each hydraulic member 246 can include a housing 248, a shaft or axle 250, a pinion gear 252 coaxially aligned with and coupled to the axle 250, and a pair of cylinders 254. In the illustrated configuration, as the axle 250 and pinion gear 252 are rotated, the teeth of the pinion gear 252 which mate with corresponding teeth of the cylinders 254 (or gear rack thereof) drive the cylinders 254 back and forth and in opposite directions of one another as the axle 250 and pinion gear 252 rotate clockwise and counterclockwise relative to the housing 248. This linear movement of the cylinders 254 and the interaction between the cylinders 254 and hydraulic fluid flowing in and out of the respective cylinder barrels 256 through fluid ports 258, creates hydraulic pressure which restricts the rotation of the axle 250 and pinion gear 252 relative to the housing 248. This restricted rotation of the axle 250 and pinion 252 can provide the resistance to the universal joint 236 about the first and second pivot axes A1', A2' in the same or similar manner as the hydraulic members 158 described above.

Referring again to FIG. 5A, the housing 248 of each hydraulic member 246 can be coupled to the outer surface of its respective yoke 240, 242 such that each hydraulic member 246 and its respective yoke move with one another in combination. The axle 250 of one hydraulic member 246 can extend through an opening of the first yoke 240, and the axle 250 of the second hydraulic member 246 can extend through an opening of the second yoke 242. As shown in FIG. 5A, each axle 250 of the hydraulic members 246 can be coupled to the central member 244 via a belt and sprocket assembly 260. Each belt and sprocket assembly 260, for instance, can include two or more sprockets, including one sprocket fixed to the axle 250 of the hydraulic member 246 and another sprocket fixed to the central member 244 at a respective pivot axis. In other words, a first sprocket of each assembly 260 can be fixed to the central member 244 and coaxially aligned with a respective pivot axis of the joint 236, and a second sprocket of each assembly 260 can be coaxial with and fixed to the axle 250 of the corresponding hydraulic member 246. The belt of each assembly 260 in this configuration can extend around respective sprockets such that relative movement between the first and second yokes 240, 242 and the central member 244 causes the belts to rotate the axles 250 and pinion gears 252 of the hydraulic members 246. Stated another way, differential rotation of the yokes 240, 242 relative to the central member 244 drives the belt and sprocket assemblies 260 and thereby drives the axles 250 and pinion gears 252 of the hydraulic members 246 via their connection. Although described as a belt and sprocket system, it should be appreciated that in some examples, a chain, pulley, and/or other similar system can be used to drive the axles 250 and pinion gears 252.

Hydraulic pressure of the hydraulic members 246 can be operative to restrict the clockwise and counterclockwise rotation of the axles 250 and pinion gears 252. As a result, the ability of the belt and sprocket assemblies 260 to drive the axles 250 of the hydraulic member 246 can be restricted, thereby restricting relative rotation between the central member 244 and the first and second yokes 240, 242. As such, movement of the universal joint 236 about the first and second pivot axes A1', A2' can be restricted, and a resistive force can be applied to the shaft 132 in such a way that the multidirectional movement of the shaft can be restricted, but the shaft 132 remains operable to move about the full range of motion provided by the universal joint 236. In particular, the shaft 132 can be manipulated along the full range of motion of the universal joint 236, but the ease or difficulty to which the shaft 132 is able to move can be modified via the restriction applied by the hydraulic members 246. Accordingly, the resistive force, or the degree to which the movement of the universal joint 236 and thereby the shaft 132 is restricted can be proportional to the hydraulic pressure of hydraulic members 246. This hydraulic pressure can be regulated, for instance, via the hydraulic fluid delivered to the hydraulic members 246 by the flow valves 160, as described herein.

Although the disclosed universal joints 156, 236 and resistance mechanisms 148, 238 are described as being configured and/or arranged in a specified manner, it should be understood that a variety of other configurations and arrangements can be used to achieve the same or similar functionality as described herein. The joints for instance, need not be a universal joint, but can be any joint, such as a ball-and-socket joint or other joint, that can provide the same or similar range of motion of the disclosed universal joint 156 and universal joint 236. Also, the hydraulic members 158, 246 need not be the hydraulic cylinders or the hydraulic gear assemblies described herein but can be any hydraulic member and/or system configured to restrict movement of the joint and/or shaft. By way of example, the hydraulic members 246 can be configured to include a single cylinder, rather than a pair of cylinders, such that the hydraulic members 246 can be oriented and/or one or more components of the belt and sprocket assembly removed, while still providing the desired resistance to joint movement. As another example, one or more linear cylinders and/or pistons can be used in conjunction with or in place of the hydraulic members. It should also be appreciated that in addition to, or in lieu of, the hydraulic members, one or more additional mechanical and/or electrical components can be included to restrict the movement of the joint and/or shaft.

Figure 6B:
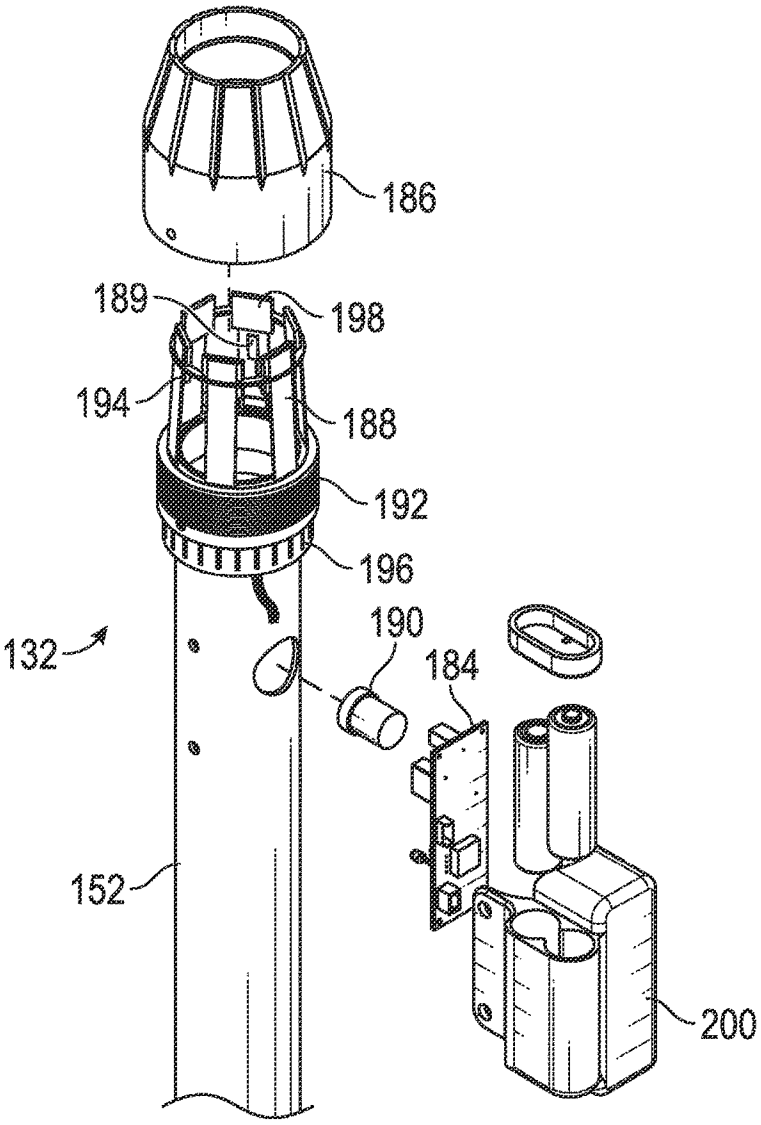
FIG. 6B is an exploded view of a first member of the telescoping shaft of FIG. 6A.
Figure 6A:
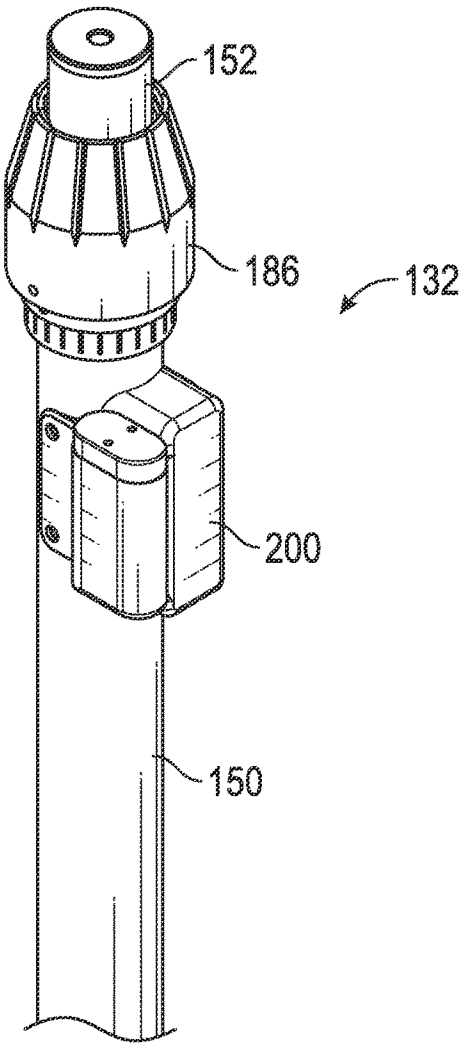
FIG. 6A is a perspective view of a telescoping shaft of the shoulder strengthening system of FIGS. 1-3.

Now turning to FIGS. 6A and 6B, the shaft 132 can include the first member 150, the second member 152, an adjustment ring 186, a plurality of leaf spring fingers 188, and an optical sensor 190. As previously mentioned, the second member 152 can be slidably coupled to the first member 150. As shown in FIG. 6A, the second member 152 has a diameter that is less than a diameter of the first member 150 such that the second member 152 can be configured to readily slide in and out of the first member 150. In this way, the shaft 132 can be said to be a telescoping shaft.

The second member 152 can be coupled to the first member 150 by way of the adjustment ring 186 and the plurality of leaf spring fingers 188 (FIG. 6B). As illustrated in FIG. 6B, the leaf spring fingers 188 can extend axially from and be circumferentially spaced from one another along the upper end of the first member 150. Each of the leaf spring fingers 188 can be angled inwardly in such a way as to contact and apply to the outer surface of the second member 152 a variable mechanical load, such as a frictional force, as the adjustment ring 186, that holds captive the slip ring 194, is adjusted. For instance, the adjustment ring 186 can be coaxially aligned with and extend over the second member 152 and leaf spring fingers 188. The adjustment ring 186 can be configured to mate with external helical ridges or threads 192 located on the outer surface of the first member 150 and proximate the leaf spring fingers 188. The adjustment ring 186 can, for example, include internal helical ridges or threads disposed on its inner surface which are configured to mate with the external ridges or threads 192 at the upper end of the first member 150. In this way, the adjustment ring 186 can be rotatably coupled to the first member 150 and rotation of the of the adjustment ring 186 can produce relative axial motion between the adjustment ring 186 and both the leaf spring fingers 188 and first member 150. The relative axial motion of the adjustment ring 186 can drive a slip ring 194 down the leaf spring fingers 188 (e.g., toward the threads 192), causing the angled spring fingers 188 to move inwardly to contact and apply a frictional force to the second member 152.

In this manner, the relative frictional force applied to the second member 152 can be proportional to the axial travel of the adjustment ring 186. For instance, the further the adjustment ring 186 travels along the external threads 192, the relatively greater the mechanical load/force is that is applied to the second member 152. Inversely, the further the adjustment ring 186 travels toward the leaf spring fingers 188, the relatively lower the mechanical load/force is that is applied to the second member 152. As such, the combination of the adjustment ring 186 and leaf spring fingers 188 can be configured to apply a variable frictional force to the second member 152 as the second member 152 slides in and out of the first member 150 such that the combination provides smooth and adjustable resistance to the telescoping motion of the shaft 132. In this way, a user seated at the shoulder strengthening system 100 is able, for example, to engage in exercises such as raises, presses, and overhead extensions because of this telescoping motion, the applied resistance of which can be adjusted via the adjustment ring 186.

In some examples, the adjustment ring 186 can be configured to travel the extent of the external threads 192 and couple to a lower fixed attachment ring 196 of the first member 150. In this configuration, the adjustment ring 186 can be configured to fix the position of the second member 152 relative to the first member 150 in such a way the second member 152 is stopped and prevented from sliding in and out of the first member 150. This can be useful in instances where the telescoping motion for an exercise or series of exercises, is undesired, and/or a fixed positioning of the user's arm is desired. For example, the fixed relative positioning of the second member 152 to the first member 150 can position the user's arm at an upward angle as the user moves the shaft 132 through the range of motion provided by a corresponding joint in order to target desired portions of the user's shoulder. Additionally or alternatively, the adjustment ring 186 can be configured to couple to the lower fixed attachment ring 196, but still allow the telescoping motion occur. In such instances, the coupling between adjustment ring 186 and the attachment ring 196 can indicate a maximum frictional force is applied to the second member 152.

In still further examples, the free end of one or more of the leaf spring fingers 188 can include a felt pad 198. The felt pads 198 can create friction between the leaf spring fingers 188 and second member 152, but prevent direct contact between these rigid components, contact which might otherwise cause undesired wear and increase in frictional forces. In this way, the felt pads 198 can provide consistent frictional forces over extended periods of use and prolong the longevity of the components and functionality of the shaft 132. The felt pads 198 can also contribute to the smooth telescoping motion of the shaft 132 despite the presence of friction.

Although the first member 150 is described as being coupled to the universal joint 156 and the second member 152 described as being coupled to the wrist-ring structure 146, it should be appreciated that this arrangement of the first and second members 150, 152 of the shaft 132 can be reversed. For instance, the first member 150 can be coupled to the wrist-ring structure 146 and the second member 152 coupled to the universal joint 156. In this arrangement, the shaft 132 maintains the same telescoping and resistance functionality as described herein. In this alternative arrangement, the second member 152 can be referred to as an inner, first member, and the first member 150 referred to as an outer, second member.

FIG. 6B shows the shaft 132 can also include one or more sensors and/or gauges. Specifically, the first member 150 can include an optical processor board 184 with a communicatively coupled optical sensor 190 configured to track and measure the telescoping position/motion of the second member 152 relative to the first member 150. The optical sensor 190 can, for instance, utilize an ultraviolet light-emitting diode (UV-LED) lens to capture the motion of the second member 152 in and out of the first member 150. In addition, a strain gauge 189 can be mounted to one or more leaf spring fingers 188 and configured to measure the deflection of, or in other words, the bending load applied to, the specified leaf spring fingers 188 by way of the adjustment ring 186 and slip ring 194. As such, the strain gauge 189 can measure the resistance applied to the second member 152. The strain gauge 189 in this case, can also be communicatively coupled to the optical processor board 184.

As previously mentioned, the optical processor board 184 can be in wireless communication with the processor board 182 (FIG. 4) of the resistance mechanism 148. In this manner, the optical processor board 184 can be configured to capture and transmit the data corresponding to the telescoping position and/or deflection measurements to the processor board 182. Accordingly, this data can be communicated via the processor board 182 to one or more web-based applications, computer processing environments, cloud computing environments, or a combination thereof. In some examples, however, the optical processor board 184 can communicate directly with one or more of those channels immediately described above (e.g. via wireless communication, such as Bluetooth).

As shown in FIG. 6B, the optical processor board 184 can be enclosed and coupled to the first member 150 via a housing 200 that is also configured to encase one or more batteries to power the processor board 184. Although the processor board 184 can be powered in a variety of ways. For instance, one or more dry cell batteries, hardwired power source, and/or one or more rechargeable batteries (e.g., via a universal serial bus) can be used.

Although the disclosed should strengthening system 100 is described as having one or more transducers, sensors, or gauges, it should be appreciated the system need not include these features to function but is enhanced by the added functionality and benefits they provide. Moreover, though quantities of individual components described herein are specified with particularity, it should be understood one or more components may be added or removed while still allowing the shoulder strengthening system to fully function in accordance with the present disclosure.

FIGS. 7A and 7B depict the wrist-ring structure 146 coupled to the upper end of the second member 152 of the shaft 132. The wrist-ring structure 146 can include a ring 202, a shuttle 204 movably coupled to the ring 202, and a brace 206 coupled to the shuttle 204. As shown in FIGS. 7A and 7B, the brace 206 can be configured to support and secure the hand and wrist of an individual user of the shoulder strengthening system 100. For instance, the brace 206 can include a rearward portion 210 configured to securely support the wrist and forearm of the user, and a frontward, curved portion 212 configured to securely support the palm and fingers. The curved portion 212 in this case, causes the palm and fingers to arc toward the forward end of the brace 206. This configuration of the frontward portion 212 which curls the palm and fingers of the user's hand can provide significant benefits, such as by ensuring the user's movement is primarily isolated to shoulder movement, rather than other parts of the arm. In particular, in their relaxed state, the flexor muscles of the hands and forearms flex the digits of the hand with greater force than the extensors, thus by allowing the hand to remain as ergonomically natural as possible, muscle tension and the forces across unwanted joints, such as in the wrist and elbow, decrease and allow further isolation of the shoulder joint.

The brace 206 can also include one or more fastening mechanisms 214, such as a strap or an elastic component to securely retain and restrict the movement of the user's arm, wrist, and hand relative to the brace 206. The fastening mechanisms 214 in this configuration can prevent the hand from moving in an upward direction, such as when the hand wants to draw or lift away from the surface of the brace 206. This also ensures user movement is directed primarily to isolated shoulder movement, as opposed to relying too heavily on hand movement to manipulate the positioning of the shaft 132 and thereby detracting from the intended dynamic 360-degree shoulder movement.

In some examples, the rearward portion 210 and/or the curved portion 212 can also be molded or formed to receive and better retain the corresponding anatomy. This, among other things, allows the brace 206 to be suited for general support and comfort. Although described as a brace to support and secure the wrist and hand of the user, it should be appreciated the brace 206 can be configured in a variety of ways. For example, in addition to or in lieu of the brace 206, a brace can be constructed to securely support the upper forearm, the upper arm, and/or the elbow joint. As an example, and as will be described in reference to FIGS. 8A-8D, a brace 234 can be configured to secure the upper arm while the shoulder strengthening system 100 is oriented in such a way as to target portions of the shoulder not generally targeted by conventional equipment.

As shown in FIGS. 7A and 7B, the brace 206 can be coupled to the shuttle 204 movably coupled to the ring 202. The shuttle 204 can include a jaw structure 216 configured to receive and engage with the edges of the ring 202. The inner surface of the jaw structure 216 can include one or rollers (not shown) to engage the surface of the ring 202 such that the shuttle is operable to move along the path formed by the edges of the ring 202 in a smooth continuous motion. In this manner, the shuttle 204 and the brace 206 can be free to move clockwise and counterclockwise along the circumference of the ring 202. As such, the brace 206 and shuttle 204 can be configured to rotate, as indicated by arrow 207, about a longitudinal axis of the ring 202 extending through the center of the ring 202 and perpendicular to the plane of the ring 202. In this way, the shuttle 204 and brace 206 can be said to move or rotate about a first axis of the wrist-ring structure 146.

FIGS. 7A and 7B show the shuttle 204 can also include a control lever 218, which can control the movement of the shuttle 204 about the ring 202. The control lever 218, for instance, can be configured to both fix the positioning of the shuttle 204 relative to the ring 202 and to enable the shuttle 204 to move freely about the circumference of the ring 202. By way of example, when the control lever 218 is in an upward, first position (FIGS. 7A-7B), the shuttle 204 and thereby the brace 206 can be in a fixed position relative to the ring 202. In this way, the shuttle 204 and brace 206 can be positioned and fixed at any point along the circumference of the ring 202. Inversely, while the control lever 218 is in a second, downward position (e.g., directed toward the second member 152 in FIG. 7A), the shuttle 204 and brace 206 can be in a "free rotation" state, meaning the shuttle and brace are free to rotate about the first axis of the wring structure 146 and circumference of the ring 202.

The control lever 218 can also be configured to toggle between the first position and a third position such that the shuttle 204 can be quickly switched between a fixed state and a free rotation state. Specifically, the control lever 218 can be pulled upward from the first position and into the third position (e.g., toward the brace 206), to switch the shuttle 204 from a fixed state to a momentarily free rotation state until the control level 218 is returned to the first position. In this case, the control lever 218 can be spring loaded to automatically return the control lever 218 to the first position from the third position. The control lever 218 configured to toggle in this way can, for example, allow an individual user whose hand and wrist are secured to the brace 206 to switch between the fixed state and free rotation state by pulling up on the control lever 218 with one or more fingers extending past the frontward end of the brace 206.

As depicted in FIGS. 7A and 7B, the ring 202 can be coupled to a pair of upwardly extending arms of a U-shaped bracket 220. The ring 202 can be coupled to the bracket 220 via the openings 222 of the arms. Each opening 222 of the bracket 220 can, for example, include a bushing (not shown) such that the ring 202 is configured to pivot relative to the bracket 220 in a fore-and-aft motion about an axis extending through the openings 222. This fore-and-aft motion is indicated by arrows 221. As such, the shuttle 204 and brace 206 are also configured to pivot backward and forward relative to bracket 220 as the ring 202 pivots about the axis extending through the openings 222. In this way, the ring 202, shuttle 204, and brace 206 can all be said to move or pivot about a second axis of the wrist-ring structure 146.

Still referring to FIGS. 7A and 7B, the ring 202 and U-shaped bracket 220 can be coupled to the upper end of the second member 152 via a release mechanism 224. The bracket 220, for example, can be coupled (e.g., bolted) to an attachment block 223. A spring lever 227 of the release mechanism 224 can then be configured to seize and hold firmly the attachment block 223 whereby the bracket 220 is securely coupled to the release mechanism 224 in a way that is free of shaking or rattling. The release mechanism 224 can be coupled to the upper end of the second member 152 by way of a bolt and a T-bushing such that the release mechanism 224, bracket 220, and ring 202 are able to rotate clockwise and counterclockwise about a longitudinal axis of the second member 152, bracket 220, and release mechanism 224. In this manner, the wrist-ring structure 146 and each component thereof, including the brace 206 and shuttle 204, can be said to move or rotate about a third axis of the wrist-ring structure 146, as indicated by arrows 225. The movement of the wrist-ring structure 146 about the first, second, and third axes A1, A2, A3 can provide ample movement relative to the shaft 132 so that the user can freely move their hand, wrist, and arm as the user acts to manipulate the shaft 132 in various directions.

Although described as being coupled to a wrist-ring structure, it should appreciated that, in some examples, the shafts described herein need not include the wrist-ring structure, but can be coupled to a member or structure which is stationary relative to the shaft.

As mentioned, the shoulder strengthening system 100 can also include a support 104 rotatably coupled to the front post 110 of the frame 108. Referring again to FIGS. 1-3, the support 104 can include a padded structure 226 coupled to its upper most end. The support 104 and the padded structure 226 can be configured to bear the weight of and/or limit rearward motion of the arm of an individual user during use of the shoulder strengthening system 100. The padded structure 226, for instance, can abut and support the posterior of the arm to limit rearward motion of the individual user's arm when avoidance of such rearward movement is desired. In this way. the padded structure 226 can immobilize the upper-extremity joint motion around the elbow which directs and isolates the acting forces toward the shoulder. Moreover, the padded structure 226 can also brace the elbow and forearm of the user. As an example, while the hand of the user is retained by the wrist-ring structure 146, the user can move or pivot their hand, wrist, and forearm relative to the padded structure 226 as the user manipulates the positioning of the shaft 132. In some examples, the padded structure 226 can be moveably coupled to the support 104 such that the padded structure 226 can be positioned at a variety of angles and orientations relative to the upper end of the support 104. For example, the padded structure 226 can be tilted toward the chair structure 106 or the shaft 132.

As shown in FIGS. 1-3, the support 104 can also be constructed of a telescoping shaft 228 that allows the length of the shaft 228 to be adjusted. In some examples, the shaft 228 can include a lever or handle (not shown) configured to allow the relative position of an inner, second member 230 and an outer, first member 232 to be adjusted, as indicated by arrows 229. In such examples, the lever can be configured in such a way as to allow an individual whose hand and wrist are secured by the wrist-ring structure 146, to adjust the length of the shaft 228 with their free hand. In this configuration, a biasing member, such as a spring or like mechanism, can bias the second member 230 such that the second member 230 extends automatically upward without external influence while the said lever is in a first position. While the handle is in this first position, the user can also press downward against the upward movement of the second member 230, such as with their elbow, to place the second member 230 and padded structure 226 in a desired position. Once in a desired position, the handle can be moved to a second position to fix the position of the second member 230 relative to the first member 232. In other examples, the shaft 228 can be structurally and functionally similar to the shaft 132, such as by including an adjustment ring and a plurality of leaf spring fingers.

Though FIGS. 1-3 show the resistance system 102 and support 104 of the shoulder strengthening system 100 in a particular configuration, e.g., generally to the right of the chair structure 106, it should be appreciated the resistance system 102 and support 104 can be positioned in a variety of configurations. For instance, the resistance system 102 and support 104 can be positioned to accommodate both the left and right sides of the body and to target specific anatomy of the shoulder.

Referring to FIGS. 8A-8D and by way of example, the base 128 and resistance system 102 can be positioned back behind and to the left rear of the chair structure 106 with the shaft 132 angled behind and to the right. In this configuration, a brace 234 formed to secure and support the upper arm and/or forearm of a user can replace the wrist-ring structure 146 and be positioned proximate the right side of the chair structure 106. The wrist-ring structure 146 and the brace 234, for instance, can be interchangeable via their coupling to the release mechanism 224. An individual seated in the chair structure 106 and whose arm is fastened to the brace 234 in this configuration can abduct their arm, i.e., move the arm from a position parallel to the torso to a position perpendicular to the torso. This abduction can be done, for example, under resistance via the mechanical load applied to the second member 152 by the adjustment ring 186 and leaf spring fingers 188, to target the muscles responsible for this action. In particular, the two primary muscles in control of the 90-degree abduction can be targeted, including the supraspinatus (e.g., initial 15 degrees of abduction) and the deltoid (e.g., the remaining 75 degrees). This, among other things, provides a significant advantage over conventional methods and exercise equipment which are typically unable to directly target the supraspinatus muscle.

FIGS. 9A-13B depict a shoulder strengthening system 300 according to another example. As illustrated in FIGS. 9A-13B, the shoulder strengthening system 300 can include a resistance system 302, a frame 304, and a platform 306 movably coupled to the frame 304. The frame 304 can include a base 308 and an adjustment mechanism 310 coupled to the resistance system 302 and the base 308. The platform 306 can be pivotably coupled (e.g., hinged) to the base 308 such that the platform 306 can be moved between a stowable state (FIGS. 9A-9C) and an operational state (FIGS. 10A-13B).

Figure 9C:
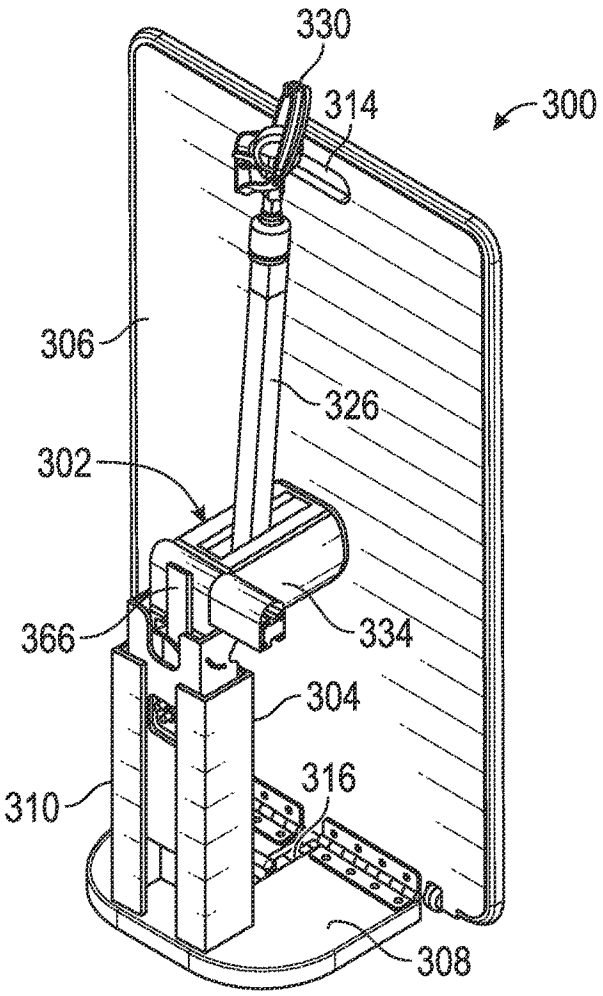
FIG. 9C is a perspective view of the shoulder strengthening system of FIGS. 9A-9B.
Figure 9B:
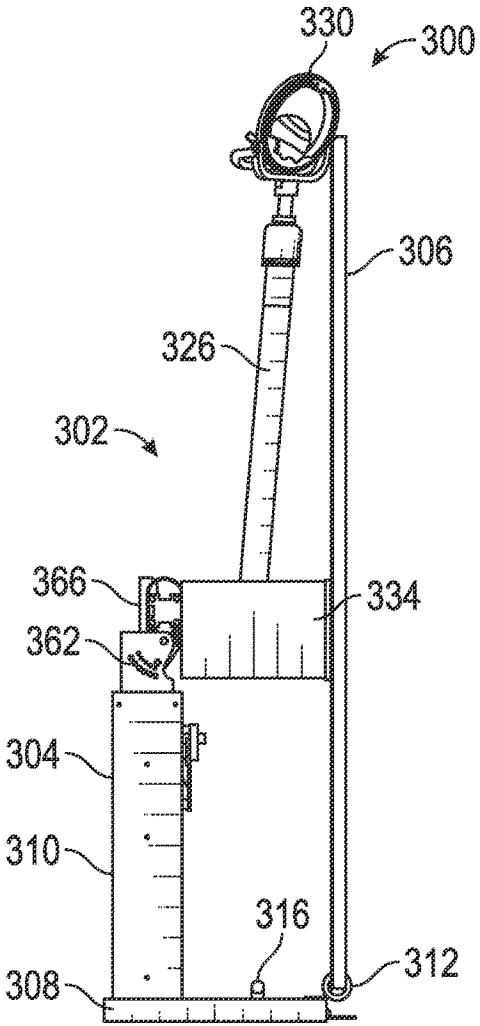
FIG. 9B is another side view of the shoulder strengthening system of FIG. 9A.
Figure 9A:
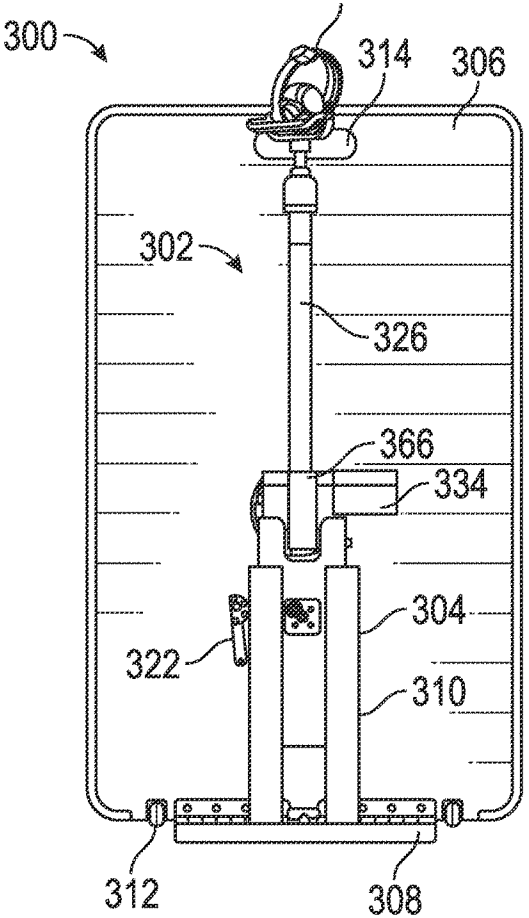
FIG. 9A is a side view of a shoulder strengthening system according to another example.

As shown in FIGS. 9A-9C, while in the stowable state, the platform 306 can be positioned in a "vertical" or longitudinal orientation such that the shoulder strengthening system 300 has a relatively low profile and decreased footprint for stowing or packing the system 300. The shoulder strengthening system 300 can, for example, be packed and stowed in a corresponding case for storage or transport when in the stowable state. The total depth of the shoulder strengthening system 300 while in the stowable state can also be relatively equal or nearly equal to the depth of the base 308 and/or the other components described herein (e.g., FIG. 9B). In some examples, the platform 306 and/or base 308 can include one or more wheels 312 and/or handles 314 such that the shoulder strengthening system 300 can be readily moved from one location to another. A locking assembly 316 of the base 308 and/or platform 306 can be included and used to lock in and move the platform 306 between the stowable and operational states.

Figure 10A:
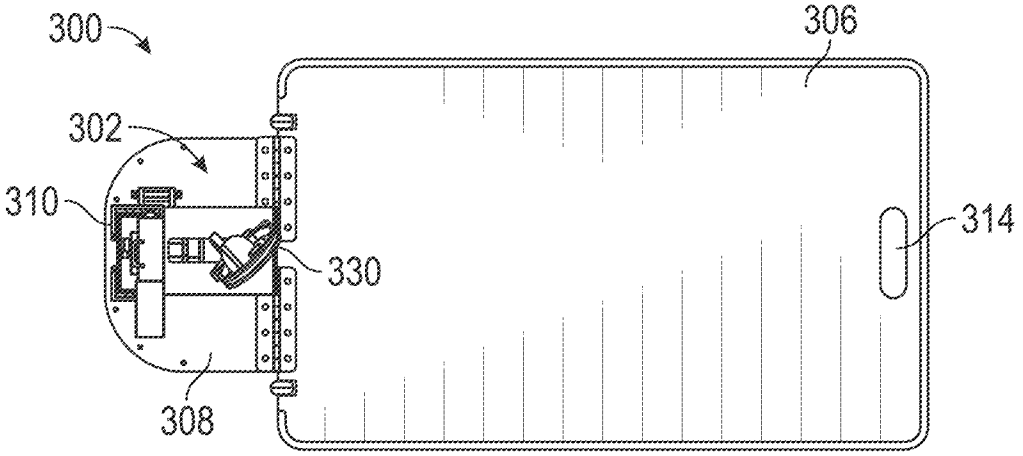
FIG. 10A is a top-down view of the shoulder strengthening system of FIGS. 9A-9C in an operational state.
Figure 10C:
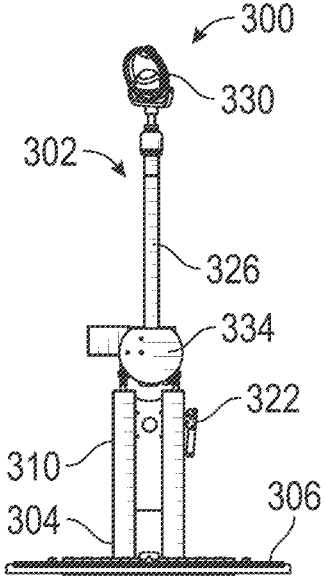
FIG. 10C is another side view of the shoulder strengthening system of FIGS. 9A-10B.
Figure 10B:
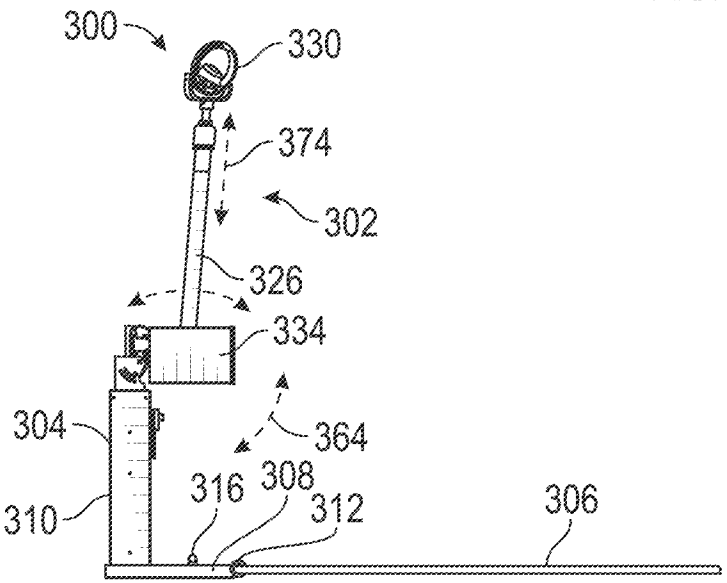
FIG. 10B is a side view of the shoulder strengthening system of FIGS. 9A-10A.
Figure 11:
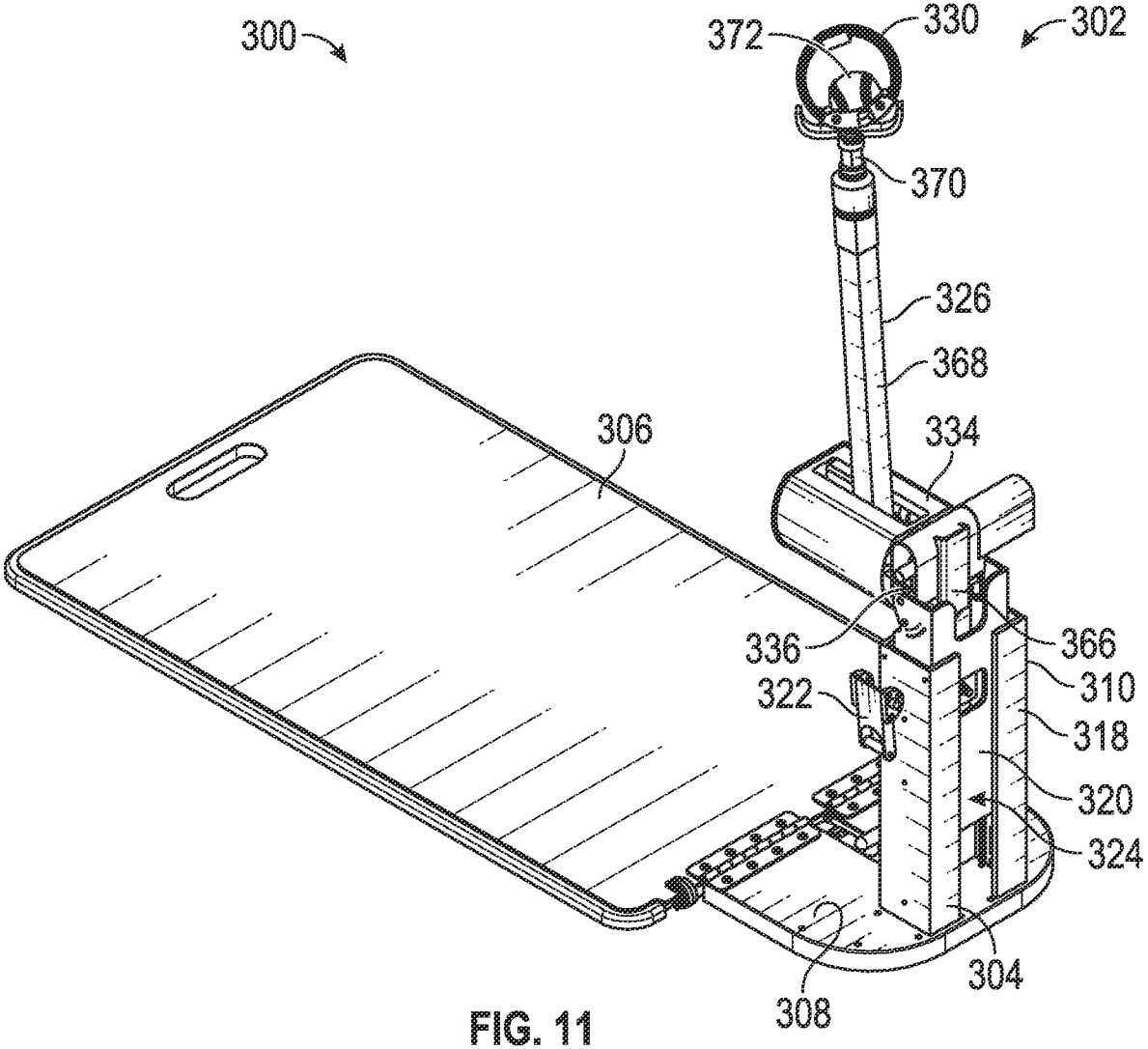
FIG. 11 is a perspective view of the shoulder strengthening system of FIGS. 9A-10C.
Figure 12B:
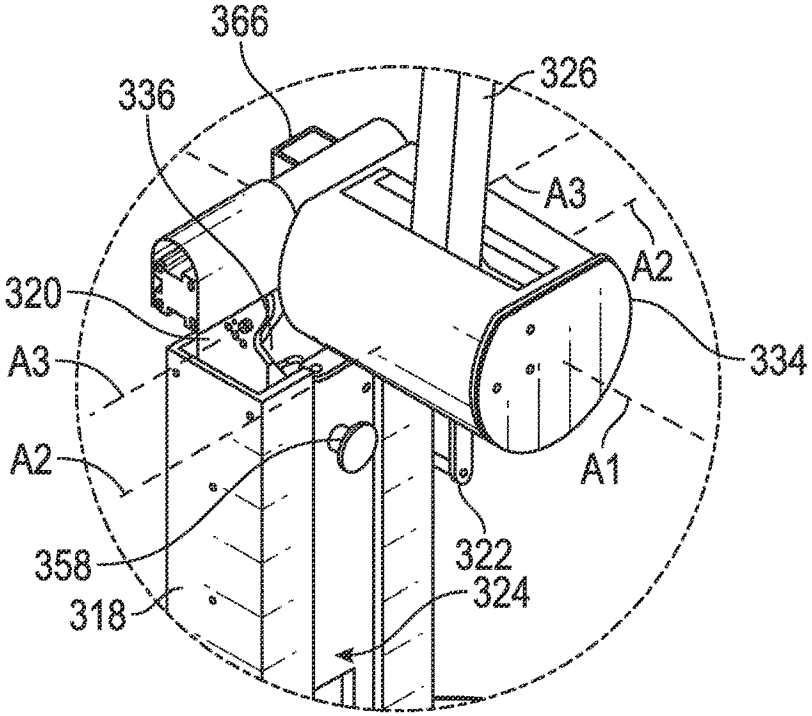
FIG. 12B is a magnified view of a resistance system of the shoulder strengthening system of FIG. 12A.
Figure 12A:
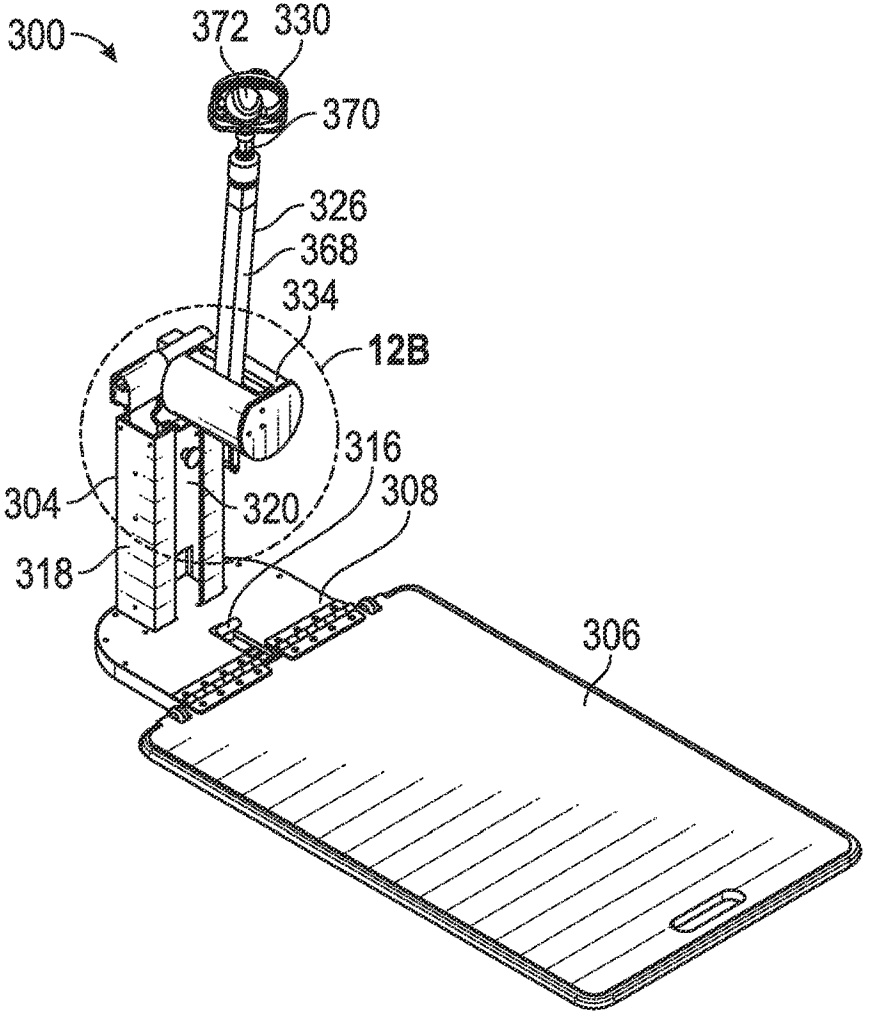
FIG. 12A is another perspective view of the shoulder strengthening system of FIGS. 9A-11.

Referring to FIGS. 10A-10C, when in the operational state, the platform 306 can be positioned in a "horizontal" orientation, i.e., parallel to the ground surface, to provide users a place to stand and position themselves while interacting with the resistance system 302. In some examples, the weight of the user atop the platform 306 can be suitable to provide stability and anchor the shoulder strengthening system 300 to the ground surface while the user is interacting with the resistance system 302. In such examples, the overall weight of the shoulder strengthening system 300 can be reduced, such as to optimize the weight of the system for stowing and packing, while taking advantage of users' weight to anchor the strengthening system 300 to the ground surface. In other examples, the weight of the platform 306 and/or surface area of the platform 306 in contact with the ground can itself be suitable to stabilize and anchor the shoulder strengthening system 300. Other components such as ties, fasteners, or weights can also be included and used to secure the strengthening system 300 to the ground surface.

Although described as including a movable platform 306, in some examples, the platform 306 need not be coupled to the frame or movable. For instance, the platform 306 can be secured to the ground surface separately of the base 308 and/or immovably coupled to the base 308 during setup of the strengthening system 300. In other examples, the platform 306 need not be included and the base 308 can be secured to the local ground surface and/or be sized and weighted to stabilize and anchor the shoulder strengthening system 300.

As shown in FIGS. 11-13B, the adjustment mechanism 310 can include a first adjustment member 318 and a second adjustment member 320 movably coupled to the first adjustment member 318. The first adjustment member 318 can be coupled to the base 308 such that the combination of the first adjustment member 318, second adjustment member 320, and base 308 form the principal support for the shoulder strengthening system 300. As illustrated in FIGS. 11-13B, the first adjustment member 318 can have a hollow body configured to receive the second adjustment member 320. The second adjustment member 320 can be coaxially aligned with and slidably coupled to the first adjustment member 318 such that the second adjustment member 320 and resistance system 302 can move axially relative to the first adjustment member 318 and base 308. For instance, the second adjustment member 320 can move axially in and out of the hollowed body of the first adjustment member 318. As such, the height or vertical positioning of the resistance system 302 relative to the base 308 and platform 306 can be adjusted by moving the second adjustment member 320 and resistance system 302 in an axial "upward" direction away from the base 308 and in an axial "downward" direction toward the base 308.

Vertical positioning of the resistance system 302 relative to the base 308 and platform 306 can be adjusted via lever 322 (e.g., a cam handle or lever). For instance, when positioned in a first position, the lever 322 is configured to fix the position of the second adjustment member 320 relative to the first adjustment member 318. When positioned in a second position, the lever 322 is configured to release the second adjustment member 320 such that the second adjustment member 320 moves axially relative to the first adjustment member 318 and base 308. An axially extending gap 324 within and along the sidewalls of the first adjustment member 318 can allow the resistance system 302 and components thereof to move with the second adjustment member 320 as the second adjustment member 320 moves toward the base 308 and below an upper most edge of the first adjustment member 318. In other words, components of the resistance system 302 coupled to the second adjustment member 320 (e.g., movable joint 328 and resistance mechanism 332) can extend outwardly and between the gap 324 without contacting the first adjustment member 318 as the second adjustment member 320 moves axially toward the base 308.

In the above example, the first adjustment member 318 forms a stationary outer adjustment member (e.g., stationary relative to the base 308) while the second adjustment member 320 forms a movable inner adjustment member configured to move or slide relative to the first adjustment member 318 and the base 308. However, in some examples, the second adjustment member 320 can be a stationary inner adjustment member while the first adjustment member 318 can be a movable outer adjustment member configured to move or slide relative to and along an outer surface the inner adjustment member. In such examples, the resistance system 302 can be coupled to the movable outer adjustment member.

As shown in FIGS. 11-13B, coupled to the second adjustment member 320 is the resistance system 302. The resistance system 302 can include a shaft 326 coupled to the frame 304 via a movable joint 328 (FIGS. 13A-13B), a wrist-ring structure 330 coupled to the shaft 326, and a resistance mechanism 332 (FIGS. 13A-13B) configured to restrict movement of the shaft 326 and wrist-ring structure 330 relative to the frame 304 of the system. As illustrated in FIGS. 9A-12B, one or more covers 334 can be situated as to conceal and enclose the movable joint 328 and resistance mechanism 332.

Figure 13A:
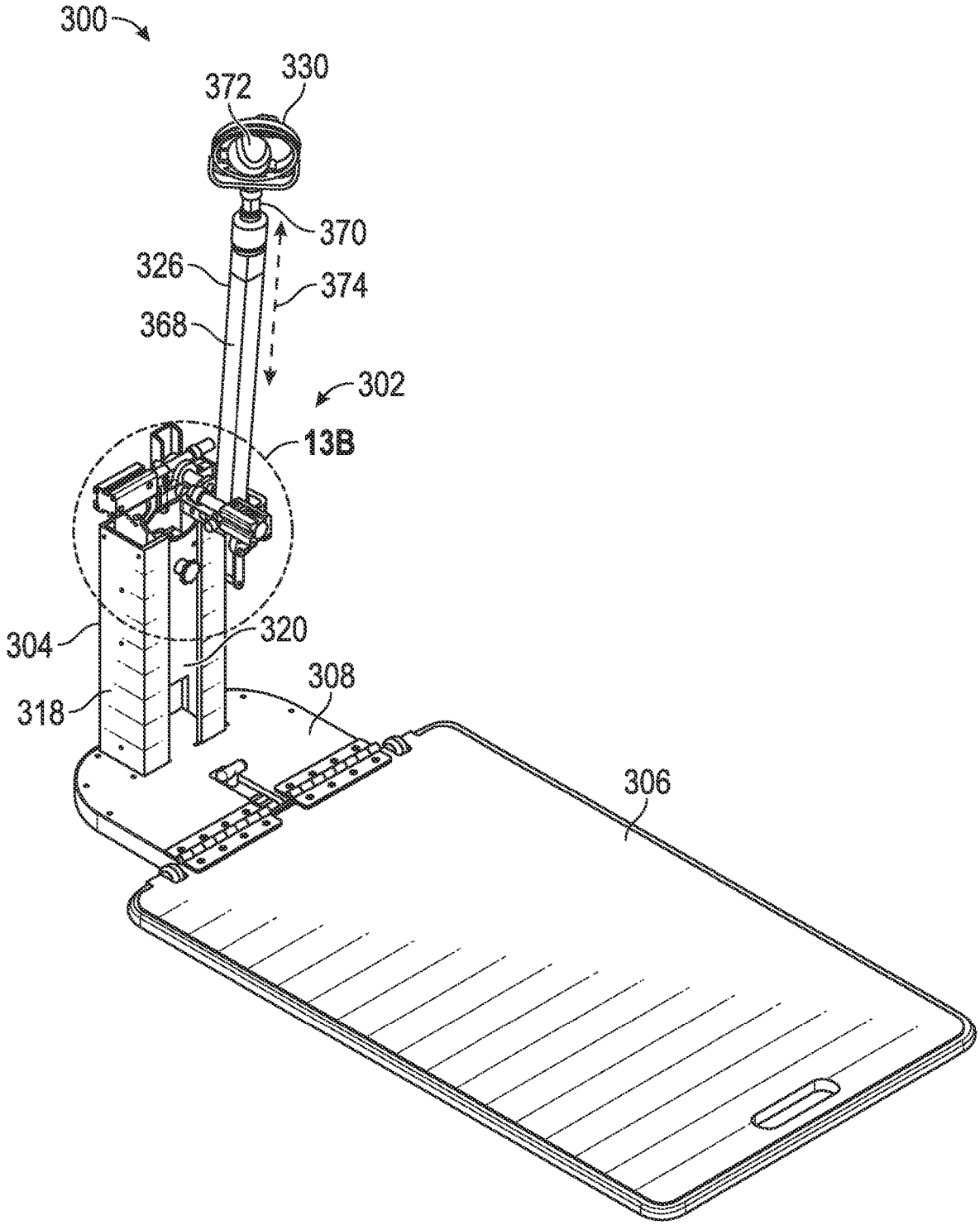
FIG. 13A is another perspective view of the shoulder strengthening system of FIGS. 9A-12B.
Figure 13B:
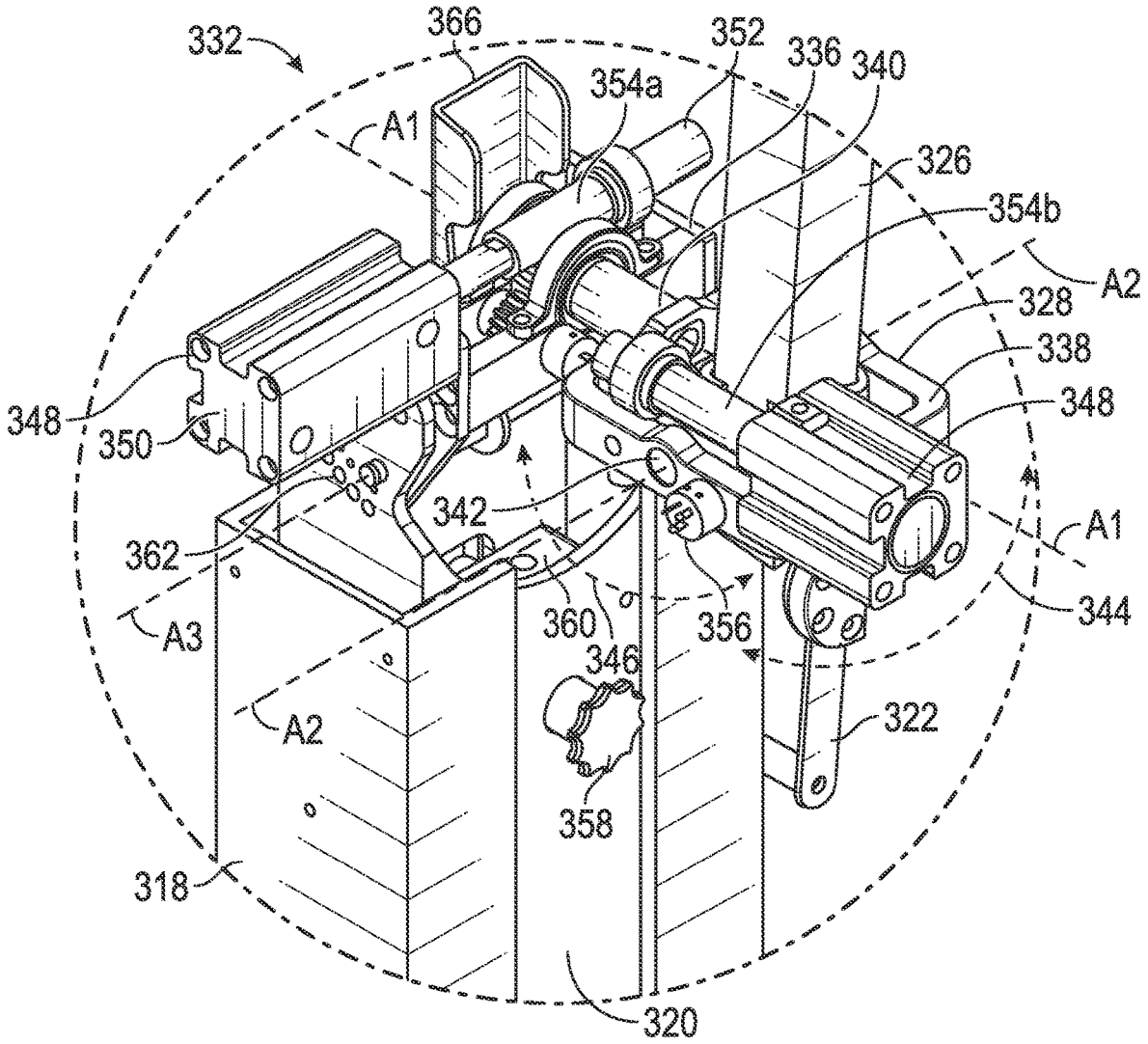
FIG. 13B is a magnified view of the resistance system of the shoulder strengthening system of FIG. 12B with a cover removed.

FIG. 13B shows a magnified view of the movable joint 328 and resistance mechanism 332 of the resistance system 302 with the cover 334 removed. The movable joint 328 and resistance mechanism 332 can provide the same or similar functionality as the universal joint 156 and resistance mechanism 148 (FIG. 4) and the universal joint 236 resistance mechanism 238 (FIGS. 5A-5B) described herein. For instance, the movable joint 328 and resistance mechanism 332 of the resistance system 302 are configured to provide the same range of multidirectional movement and resistance to that multidirectional movement as those joints and resistance mechanisms already described. In particular, the movable joint 328 includes a first support or bracket 336 coupled to the second adjustment member 320 of the adjustment mechanism 310, and a second support or bracket 338 movably coupled to the first bracket 336 and the shaft 326. The second bracket 338 can, for example, be a cantilevered bracket rotatably coupled to the first bracket 336. The portion of the second bracket 338 coupled to the first bracket 336 can form a first axle or gear shaft 340 and a first pivot axis A1 of the movable joint 328. In a similar manner, the shaft 326 can be rotatably coupled to the second bracket 338 via a second axle or gear shaft 342 forming a second pivot axis A2 by which the shaft 326 pivots relative to the second bracket 338.

In this configuration, the second bracket 338 and shaft 326 are configured to pivot clockwise and counterclockwise relative to the first bracket 336 and adjustment mechanism 310 about the first pivot axis A1, while the shaft 326 is configured to pivot relative to the first and second brackets 336, 338 and the adjustment mechanism 310 about the second pivot axis A2. The shaft 326, for instance, can be configured to pivot about the second pivot axis A2 toward and away from the first bracket 336 and adjustment mechanism 310. This movement of the movable joint 328 about the first and second pivot axes A1, A2 is generally indicated by arrows 344 (e.g., about the first pivot axis and first gear shaft 340) and arrows 346 (e.g., about the second pivot axis and second gear shaft 342), respectively, in FIG. 13B. The movement of the movable joint 328 can be measured via one or more rotational position sensors 356 (e.g., rotational sensors 162), such as digital and/or analog rotary encoders.

As shown in FIG. 13B, the resistance mechanism 332 can include a pair of hydraulic members 348 coupled to the first and second brackets 336, 338 of the movable joint 328. Each hydraulic member 348 can include a respective housing 350, a cylinder (not shown) received within the housing 350, and a rack and pinion assembly 354 coupled to the cylinder and a corresponding gear shaft, such that the hydraulic members 348 are situated to restrict rotation of the first and second gear shafts 340, 342. For instance, a pinion gear of the rack and pinion assembly 354*a* of the hydraulic member 348 coupled to the first bracket 336 can be coupled to and coaxially aligned with the first gear shaft 340. Likewise, a pinion gear of the rack and pinion assembly 354*b* of the hydraulic member 348 coupled to the second bracket 338 can be coupled to and coaxially aligned with the second gear shaft 342 coupling the shaft 326 to the second bracket 338. A gear rack 352 of each rack and pinion assembly 354 can also be coupled to and coaxially aligned with a respective cylinder in such a way that the teeth of each gear rack 352 mates with the teeth of a respective pinion gear.

In the configuration illustrated in FIG. 13B, as the first and second gear shafts 340, 342 are rotated clockwise and counterclockwise relative to the first and second brackets 336, 338, the rack and pinion assemblies 354 drive the cylinders in a linear fashion within a respective housing 350. This linear movement of the cylinders and the interaction between the cylinders and a hydraulic fluid within the housing 350 creates hydraulic pressure operative to restrict the clockwise and counterclockwise rotation of the first and second gear shafts 340, 342 and pinion gears. As such, the ability of the first and second gear shafts 340, 342 and rack and pinon assemblies 354 to drive the cylinders can be restricted, thereby restricting relative rotation between the second bracket 338 and the first bracket 336 and between the shaft 326 and the second bracket 338. As a result, the movement of the movable joint 328 about the first and second pivot axes A1, A2 can be restricted, and a resistive force is applied to the shaft 326 in such a way that the multidirectional movement of the shaft is restricted, but the shaft 326 remains operable to move about the full range of motion provided by the movable joint 328. The shaft 326 can be manipulated along the full range of motion of the movable joint 328, but the ease or difficulty to which the shaft 326 is able to move can be modified via the restriction applied by the hydraulic members 246. Accordingly, the resistive force, or the degree to which the movement of the movable joint 328 and thereby the shaft 326 is restricted can be proportional to the hydraulic pressure of hydraulic members 348. This hydraulic pressure can be regulated, for instance, via the hydraulic fluid delivered to the hydraulic members 348 by a knob 358 and flow valves (e.g., the flow valves 160), as described herein.

Though not depicted in FIGS. 12A-12B and 13A-13B, the resistance mechanism 332 can also include all and/or any combination of components of the resistance mechanism 148 and resistance mechanism 238, including one or more flow valves, pressure transducers, hoses, and processor boards, which are generally indicated at 360. One or more of the listed components can, for example, be positioned and/or mounted within the first adjustment member 318 or second adjustment member 320, and/or be coupled to the movable joint 328 or resistance mechanism 332. Any processor board included in the shoulder strengthening system 300 can also be in wireless communication with one or more local or network processing environments (e.g., personal computer (s), mobile device(s), handheld device(s), etc.), web-based applications, and/or cloud computing environments, such that the data from the measurements from the transducers, rotational sensors, and/or data from a processor board can be viewed in real time and/or post measurement. In such instances and in some examples, the flow of the hydraulic fluid can also be adjusted via a web-based application and/or a processor and/or computing environment.

One advantage of the shoulder strengthening system 300, is that the entirety of the resistance system 302 can also be angled relative to the adjustment mechanism 310. As shown in FIG. 13B, for instance, the first bracket 336 can be pivotably coupled to the second adjustment member 320 of the adjustment mechanism 310 such that the resistance system 302 can be positioned relative to the adjustment mechanism 310 at various angles. Specifically, the first bracket 336 can be hinged to the second adjustment member 320 and configured to disengage and engage one of a plurality of openings 362 along the upper portion of the second adjustment member 320. The openings 362 can allow for incremental angle adjustments of the movable joint 328 and resistance mechanism 332 relative to the adjustment mechanism 310. For example, the movable joint 328 and resistance mechanism 332 of the resistance system 302 can be tilted at a downward slope toward the platform 306 and base 308 from the position of the joint 328 and mechanism 332 depicted in FIGS. 9A-13B. As generally indicated by the arrows 364 of FIG. 10B, in particular, the resistance system 302 can be angled relative the adjustment mechanism 310 such that the movable joint 328 and resistance mechanism 332 can form an angle relative to the adjustment mechanism 310 ranging from approximately 90 degrees (e.g., FIGS. 9A-13B) to approximately 60 degrees when at a downward slope. In some examples, the configuration of the second adjustment member 320 and first bracket 336 can be in such a way that the movable joint 328 and resistance mechanism 332 can be adjusted to form an angle less than 60 degrees relative to the adjustment mechanism 310 and/or greater than 90 degrees relative to the adjustment mechanism 310, such as to tilt the resistance system 302 at an upward slope.

Configured in this way, the shaft 326, movable joint 328, and resistance mechanism 332 can be said to pivot relative to the frame 304 about a third pivot axis A3 of the resistance system 302. The third pivot axis A3 being formed by the hinge or other suitable connection between the first bracket 336 and the second adjustment member 320 which permits the first bracket 336 to pivot relative to the second adjustment member 320 and adjustment mechanism 310. This third pivot axis A3 can also be used to position the resistance system 302 at a sloped, downward angle suitable for particular arm and shoulder movements. As an example, the movable joint 328 can be tilted at a downward slope such that the shaft 326 and wrist-ring structure 330 can be positioned and maneuvered as to allow a user to replicate particular body movements. A user, for instance, can position themselves in a standing position on the platform 306, with their back and/or side directed toward the adjustment mechanism 310. In this position, the user can secure their hand and/or wrist within the wrist-ring structure 330 and engage in overhand, sidearm, and/or underhand pitching motions. This configuration is desirable, for example, for diagnosing the extent of a pitcher's shoulder injury and/or monitoring the health of the pitcher's shoulder through movement which reproduces a natural pitching motion. The same or similar orientations of the resistance system 302 can be used for other athletic and/or occupational movements.

As shown in FIGS. 9A-13B, a lever 366 coupled to the first bracket 336 and/or second adjustment member 320 can be configured to engage and disengage one or more pins (and/or other fasteners) with the openings 362 and/or another portion of the second adjustment member 320. In some examples, the openings 362 need not be a plurality of openings but can be a single curved opening which tracks the possible motion of the first bracket 336 about the third axis A3.

The shaft 326 and wrist-ring structure 330 shown in FIGS. 9A-13B, can be structurally and functionally similar to the shaft 132 and wrist-ring structure 146 described herein (FIGS. 1-8D). For instance, as illustrated in FIGS. 11-13B, the shaft 326 can include an outer, first member 368 and an inner, second member 370 slidably coupled to the first member 368, as generally indicated by arrows 374 (FIGS. 10B and 13A). The first member 368 can be coupled to the movable joint 328 (FIGS. 13A-13B) and the upper end of the second member 370 coupled to the wrist-ring structure 330. In some examples, the shaft 326 can include a third member moveably coupled to and situated between the first member 368 and second member 370. The shaft 326 can also include a bi-directional spring and/or cables to provide smooth and adjustable resistance to the telescoping motion of the shaft 326, such as in lieu or in addition to the adjustable resistance provided by an adjustment ring (e.g., adjustment ring 186).

The wrist-ring structure 330 can be structurally and functionally similar as wrist-ring structure 146 described herein, such that the wrist-ring structure 330 can also be configured to brace the wrist and thereby the arm and hand of a user, permitting the wrist to rotate and pivot about multiple axes (e.g., FIGS. 7A-7B). The wrist-ring structure 330 can also be configured to restrict or limit certain wrist movement, such as when wrist or arm movement is undesirable for a given exercise. The shaft 326 and wrist-ring structure 330, as described, are also capable of multidirectional movement relative to the adjustment mechanism 310, base 308, and platform 306 via operation of the movable joint 328.

One difference between the wrist-ring structure 146 and the wrist-ring structure 330, however, is that the brace 206 has been replaced by a ball 372, or a portion thereof. As shown in FIGS. 11-13B for instance, the ball 372 can replicate the size, shape, and seams of a baseball, such as to further assist the user to reproduce the natural motion of pitching. In other examples, however, the ball 372 can replicate any other type of athletic equipment, such as a football or handle (e.g., of a racket or club), as just a couple of examples. The ball 372 can also be replaced with other objects which replicate other occupational tools.

In some examples, the ball 372 can be removably coupled to the shuttle of the wrist-ring structure 330 (e.g., shuttle 204) and/or be integrated with the shuttle. As such, the ball 372 can be interchangeable with one or more other braces (e.g., brace 206 or brace 234) and/or the wrist-ring structure 330 can be interchangeable with one or more other wrist-ring structures (e.g., wrist-ring structure 146). In other examples, the ball 372 can be independent of the shuttle or other components of the wrist-ring structure and be coupled directly to the shaft 326.

It should be appreciated that the shoulder strengthening system 100 and shoulder strengthening system 300 can include all and/or any combination of components described in reference to the other. As an example, in some examples, the shoulder strengthening system 100 can include the resistance system 302, such that shoulder strengthening system 100 includes the movable joint 328, resistance mechanism 332, and shaft 326 as described herein.

Although the resistance systems described herein can include hydraulic mechanisms to provide resistance, it should be appreciated that the materials making up the individual components of the resistance systems can also provide adequate resistance without a resistive force applied by the hydraulic mechanisms. For instance, in some cases, the weight and rigidity of the components of the resistance system 102 and resistance system 302 can provide ample resistance, particularly to those users just beginning rehabilitation. For this reason, one or more of the components of the resistance systems can be constructed of relatively light weight materials so as to ensure the components are able to be manipulated by a user whose shoulder is in a weakened state and vulnerable to reinjury. As one example, the members of shaft 132 and shaft 326 can be made of a lightweight, anodized aluminum which provides little weight to the resistance system.

Figure 14:
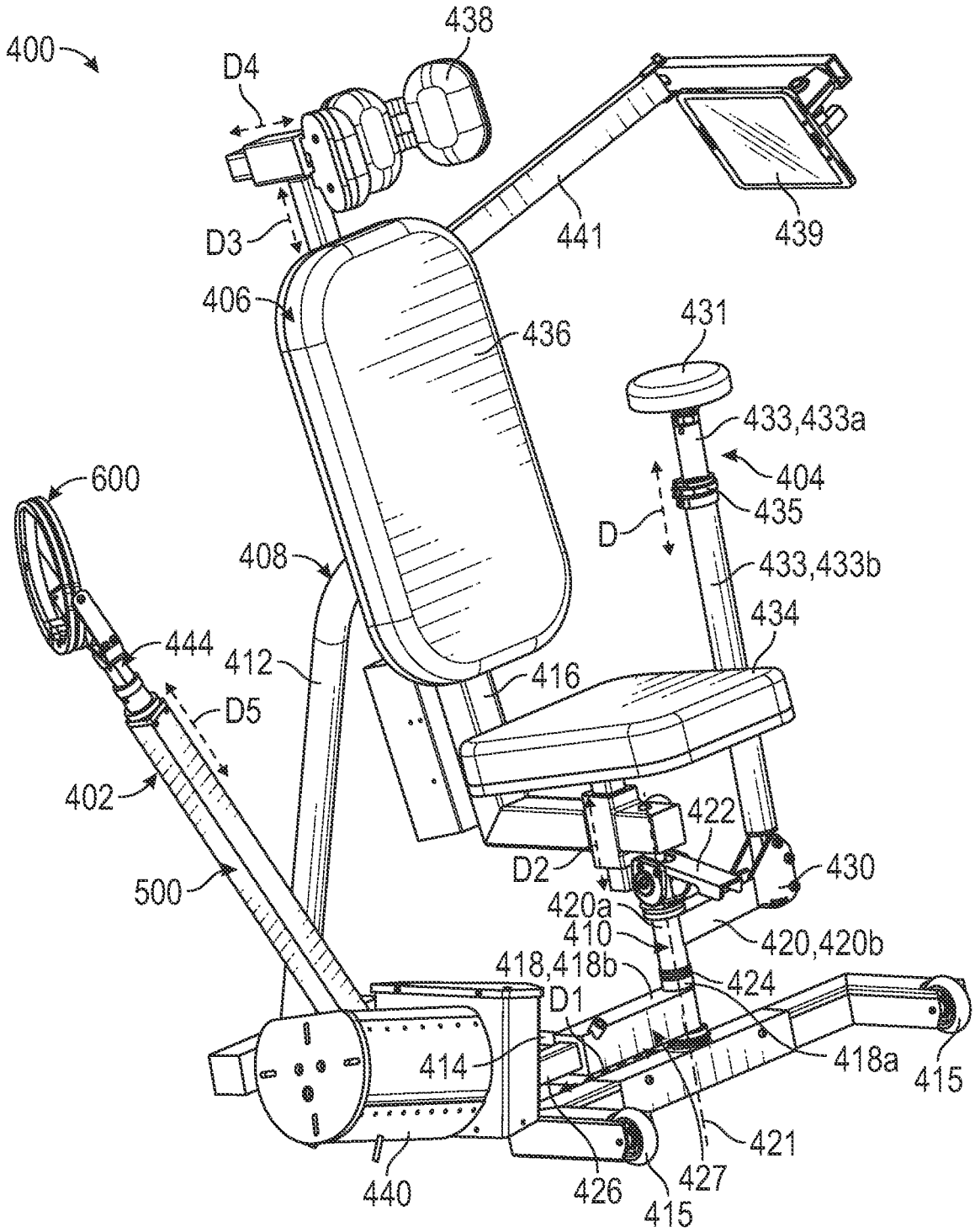
FIG. 14 is a perspective view of a shoulder strengthening system, according to one example.

FIGS. 14-29 depict a shoulder strengthening system 400 and components thereof, according to one example. As depicted in FIG. 14, the shoulder strengthening system 400 can include a resistance system 402, a support 404, and a chair structure 406 mounted to a frame 408. The frame 408 can include a base 414 and a pair of interconnected, upwardly extending posts 410, 412 coupled to the base 414, for example, at the front and rear. The front and rear posts 410, 412 are interconnected by a strut 416. The strut 416 extends from the front post 410 to the rear post 412 and upwardly beyond the upper-most end of the rear post 412 to form the backbone of the chair structure 406. The front post 410 can be vertical or substantially vertical relative to the base 414 of the frame 408, while the rear post 412 can extend upwardly at an angle relative to the base 414 and curve toward the strut 416. In some examples, the base 414 includes one or more wheels 415 at the front (FIG. 14) and/or rear of the base 414 configured to allow the shoulder strengthening system 400 to be readily moved from one location to another.

In some instances, the front post 410 can be integrally formed as a single, unitary component. In other instances, as depicted, the front post 410 can comprise one or more segments that are formed as separate components that are coupled together (e.g., via fasteners, adhesive, mating features, and/or other means for coupling). For example, the front post 410 can comprise arms 418, 420 and one or more interlocking washers 424.

As illustrated in FIG. 14, the resistance system 402 and support 404 are coupled to the frame 408 via arms 418, 420, respectively. Each arm 418, 420 comprises a shaft portion 418*a*, 420*a* and an arm extension 418*b*, 420*b*, respectively. For example, the resistance system 402 can be coupled to the arm extension 418*b* and the support 404 can be coupled to the arm extension 420*b*. Each arm 418, 420 is configured to freely rotate (e.g., clockwise and counterclockwise) about the longitudinal axis 421 of the front post 410 and relative to one another, as well as the frame 408 and the chair structure 406.

The shaft portions 418*a*, 420*a* are coaxial with the longitudinal axis 421 of the front post 410 and are spaced apart along the longitudinal axis 421, such that the arms 418, 420 are stacked atop one another. In some examples, as shown, the arm 420 is located above the arm 418. Specifically, the arm 420 is positioned closer to the strut 416 than the arm 418, and the arm 418 is positioned closer to the base 414 than the arm 420. In this way, the arms 418, 420 can be referred to as lower and upper arms, which rotate about the longitudinal axis 421.

The arm extensions 418*b*, 420*b* extend outwardly from the shaft portions 418*a*, 420*a*, respectively. In some examples, as illustrated in FIG. 14, the arm extensions 418*b*, 420*b* extend outwardly in perpendicular directions from the shaft portions 418*a*, 420*a*, such that the arm extensions 418*b*, 420*b* are parallel to the base 414 of the frame 408. As shown, the arm extensions 418*b*, 420*b* are spaced apart along the longitudinal axis 421.

The frame 408 includes a lever 422 located just above the upper arm 420, that is, axially between the strut 416 and the upper arm 420 (e.g., along the longitudinal axis 421). The lever 422 is configured to selectively apply a compressive force along the longitudinal axis 421 (e.g., a downward force) to front post 410 to lock the rotational positioning of the arms 418, 420 (and therefore, the resistance system 402 and the support 404, respectively) relative to the base 414. Specifically, the lever 422 can apply the force such that the arms 418, 420 and the interlocking washers 424 are compressed in an axial direction (e.g., along the longitudinal axis 421) between the lever 422 and the base 414.

A pair of interlocking washers 424 can be coaxially aligned with the longitudinal axis 421 and positioned between the lever 422 and the upper arm 420, the lower and upper arms 418, 420, and/or the lower arm 418 and the base 414. Each washer of a pair of interlocking washers 424 can be coupled to its respective adjacent structure, such as the base 414, lower arm 418, upper arm 420, or the lever 422. For example, one washer can be coupled to the bottom end of the shaft portion 420*a* of the upper arm 420 and another washer can be coupled to the upper end of the shaft portion 418*a* of the lower arm 418. In this arrangement, the arms 418, 420 and thereby both the resistance system 402 and support 404 can be locked into a desired position relative to the chair structure 406 and one another when the lever 422 applies a downward, compressive force on the arms 418, 420. By way of example, when the lever 422 is in a first position (e.g., in a downward direction, parallel to the longitudinal axis 421, etc.), the lever 422 exerts downward pressure to the upper and lower arms 420, 418. The downward pressure acting on the arms 418, 420 causes the interlocking washers 424 to mate and interlock to prevent the rotation of the lower and upper arms 418, 420 and lock them into a desired position. Inversely, when the lever 422 is in a second position (e.g., directed in an outward direction, etc. (see FIG. 14)), the lower and upper arms 418, 420 are free to rotate about the longitudinal axis 421. In this configuration, the arms 418, 420, and therefore the resistance system 402 and support 404, are configured to rotate 360 degrees about the longitudinal axis 421 and can be placed and locked into a variety of desired positions.

In some examples, the arms 418, 420 can be positioned in an opposite arrangement. For instance, the arm 420 coupled to the support 404 can be stacked below the arm 418 coupled to the resistance system 402 such that the arm 420 is a lower arm and the arm 418 is an upper arm. In some examples, each washer of each pair of washers 424 can include teeth or ridges which are configured to mate and interlock with a corresponding washer such that movement of the arms 418, 420 are restricted when pressure applied by the lever forces the pair of washers to contact one another.

In some examples, the frame 408 can include an adjustable assembly 427 configured to adjust a distance between the chair structure 406 (and/or frame 408) and the resistance system 402, as indicated by directional arrows D1 (FIG. 14). As shown in FIG. 14, the lower arm 418 can be configured as a component of the adjustable assembly 427. For example, the arm extension 418*b* can be configured to receive a corresponding slidable structure 426 of the adjustable assembly 427, such that the structure 426 translates relative to the arm 418. In some examples, as shown, the slidable structure 426 comprises a faceted shaft (e.g., a square shaft) and the arm extension 418*b* comprises a corresponding faceted opening, such that the structure 426 is prevented from rotating relative to the arm 418. The adjustable assembly 427 can include a clamping screw, for example, that is operable to engage and release the slidable structure 426 of the resistance system 402. The adjustable assembly 427 allows the distance between the resistance system 402 and the front post 410 to be increased and decreased, thereby rendering the position of the resistance system 402 adjustable relative to the chair structure 406. In other examples, however, the lower arm 418 and/or corresponding structure of the resistance system 402 can be configured in a variety of ways, including various adjustable assemblies and systems, which allow the resistance system 402 to be positioned relative to the chair structure 406.

The support 404 and upper arm 420 can be coupled in such a way as to allow the support 404 to be positioned in a variety of different orientations relative to the chair structure 406. For example, the support 404 can be coupled to the arm extension 420*b* by way of a pivotable joint 430 such that the support 404 can pivot relative to the upper arm 420, including toward and away from the chair structure 406. In this way, the support 404 can also be adjustable relative to the chair structure 406 and the other components of the shoulder strengthening system 400. In some examples, the upper arm 420 can be configured as a component of an adjustable assembly (e.g., similar to the adjustable assembly 427, etc.) such that the distance between the front post 410 and the joint 430 can also be adjustable.

The support 404 can include a padded structure 431 coupled to its upper most end. The support 104 and the padded structure 431 can be configured to bear the weight of and/or limit rearward motion of the arm of an individual user during use of the shoulder strengthening system 400. The padded structure 431, for instance, can abut and support the posterior of the arm to limit rearward motion of the individual user's arm when avoidance of such rearward movement is desired. In this way, the padded structure 431 can immobilize the upper-extremity joint motion around the elbow which directs and isolates the acting forces toward the shoulder. Moreover, the padded structure 431 can also brace the elbow and forearm of the user. As an example, while the hand of the user is coupled to the resistance system 402 (e.g., retained by a wrist-ring structure 600 described below), the user can move or pivot their hand, wrist, and forearm relative to the padded structure 431 as the user manipulates the positioning of the resistance system 402 (e.g., a shaft assembly 444 of the resistance system 402, described below). In some examples, the padded structure 431 can be moveably coupled to the support 404 such that the padded structure 431 can be positioned at a variety of angles and orientations relative to the upper end of the support 104. For example, the padded structure 431 can be tilted toward the chair structure 406 and/or towards the resistance system 402.

Figure 15:
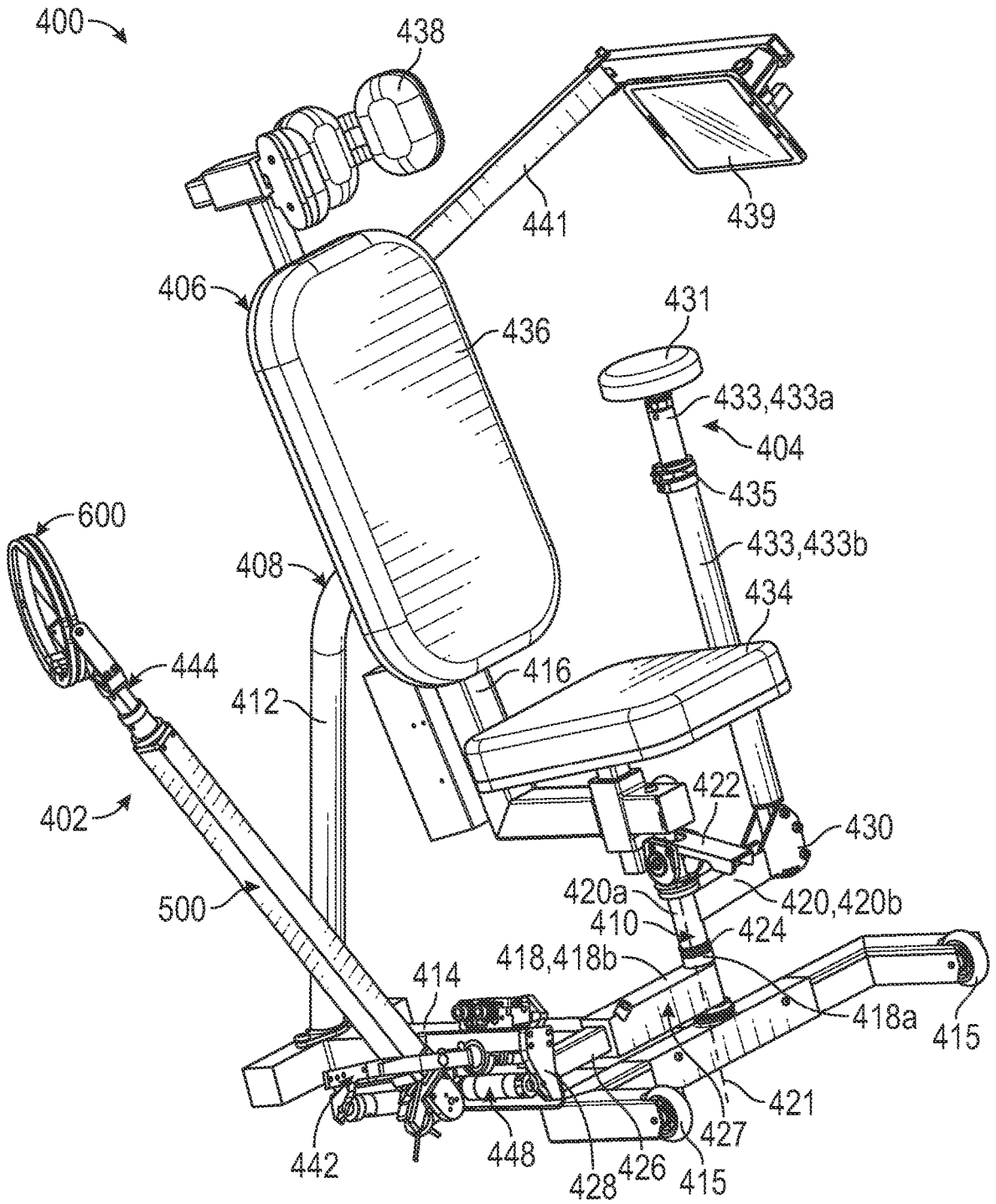
FIG. 15 is a perspective view of the shoulder strengthening system of FIG. 14 with a cover removed from a resistance system.

As shown in FIGS. 14-15, the support 404 can also be constructed of a telescoping shaft 433 that allows the length of the shaft 433 to be adjusted. In some examples, the shaft 433 can include a lever 435 configured to allow the relative position of an inner, second member 433*a* and an outer, first member 433*b* to be adjusted, as indicated by directional arrows D (FIG. 14). In such examples, the lever 435 can be configured in such a way as to allow an individual whose hand and wrist are secured to the resistance system 402 (e.g., by a wrist-ring structure 600), to adjust the length of the shaft 433 with their free hand. In this configuration, a biasing member, such as a spring or like mechanism, can bias the second member 433*a* such that the second member 433*a* extends automatically upward without external influence while the said lever 435 is in a first position. While the lever 435 is in this first position, the user can also press downward against the upward movement of the second member 433*a*, such as with their elbow, to place the second member 433*a* and padded structure 431 in a desired position. Once in a desired position, the lever 435 can be moved to a second position to fix the position of the second member 433*a* relative to the first member 433*b*. In other examples, the shaft 433 can have other configurations to enable a length of the shaft 433 to be adjusted, for example, as including an adjustment ring and a plurality of leaf spring fingers similar to shaft 132 of FIGS. 1-3.

Referring to FIG. 14, the chair structure 406 coupled to the frame 408 can include a seat 434, a backrest 436, and a headrest 438, each of which can be formed of padded structure. As depicted in the illustrated examples, the seat 434 and headrest 438 can each be adjustable to accommodate the height and size of a user seated in the chair structure 406. In some instances, one or more components of the chair structure can be omitted. For example, in some examples, the chair structure comprises a seat and omits the backrest and/or headrest. The seat 434, for instance, can be coupled to the strut 416 via a pull-pin adjustable assembly (e.g., similar to pull-pin adjustable assembly 140 (FIGS. 1 and 3)), permitting the seat 434 to be adjusted upward and downward relative to the base 414 of the frame 408, as indicated by directional arrows D2 (FIG. 14). Similarly, the headrest 438 can be coupled to the strut 416 and can be adjusted upward and downward, as indicated by directional arrows D3 (FIG. 14), relative to the backrest 436 and seat 434 via a pull-pin adjustable assembly (e.g., similar to pull-pin adjustable assembly 142 (FIGS. 1-2)). Moreover, the headrest 438 can also be adjusted frontward and rearward, as indicated by directional arrows D4 (FIG. 14), via a pull-pin adjustable assembly (e.g., similar to pull-pin adjustable assembly 144 (FIGS. 1-2)).

As illustrated in FIG. 14, the headrest 438 can includes three padded structures, similar to headrest 138. In some examples, the headrest 438 can include any fewer or greater number of padded structures.

In some examples, to help the user seated at the shoulder strengthening system 400 to maintain a desired posture, the chair structure 406 can also include one or more fasteners configured to restrict movement of the head, torso, and/or legs. For instance, the backrest 436 and/or headrest 438 can include a strap which extends across the corresponding anatomy of the user to reduce or prevent forward and/or lateral movement of the torso and/or head relative to the chair structure 406 while in use. Similarly, the seat 434 can include a strap to extend across the legs of the user seated, to reduce or prevent upward movement and/or maintain leg spacing and alignment relative to the user's hips.

As shown in FIGS. 14-15, the shoulder strengthening system 400, in some examples, can include a computer interface 439 (e.g., a touch screen display, a tablet, etc.) that is coupled to the frame 408. In some examples, as depicted, the computer interface 439 is coupled to a multi-linked, adjustable arm 441 of the frame 408. The adjustable arm 441 can be coupled to the strut 416 via a pull-pin adjustable assembly, similar to those described above. In this way, the computer interface 439 can be moved and/or adjusted relative to the chair structure 406 to enable a user to adjust the orientation of computer interface 439 relative to the user. In some examples, the computer interface 439 can be detachable from the adjustable arm 441.

The computer interface 439 can be configured to control components of the shoulder strengthening system 400 and/or display data relevant to the shoulder strengthening system 400. For example, in some instances, the computer interface 439 can be operatively coupled (e.g., wirelessly, etc.) to the resistance system 402 to control a resistance of the resistance system 402. This resistance can be experienced by the user as the user operates (e.g., moves) the resistance system 402, as described in more detail below. In some examples, the computer interface 439 can be configured to display metrics regarding the movement of the resistance system 402 by a user, various output from sensors (e.g., sensors 470, 580 described below) and/or other data relevant to use of the shoulder strengthening system 400.

Though the frame 408, chair structure 406, arms 418, 420, 441 and their respective components, are described and depicted with particularity, it should be appreciated that these features can be constructed and/or arranged in a number of different ways in accordance with the functionality and principles described herein. As one example, the arms 418, 420 need not be stacked atop each other or coaxially aligned, but rather can be coupled to discrete locations on the base, and pivot and/or rotate about separate axes.

Though FIGS. 14-15 show the resistance system 402 and support 404 of the shoulder strengthening system 400 in a particular configuration, e.g., generally to the right of the chair structure 406, it should be appreciated the resistance system 402 and support 404 can be positioned in a variety of configurations. For instance, the resistance system 402 and support 404 can be positioned to accommodate both the left and right sides of the body and to target specific anatomy of the shoulder.

The resistance system 402 can include an outer housing 440, a joint assembly 442 and a resistance mechanism 448 (FIGS. 15-17) disposed within the housing 440, and a shaft assembly 444 coupled to the joint assembly 442. In some examples, as depicted, the shaft assembly 444 can include a shaft 500 and a wrist-ring structure 600 coupled to the shaft 500. The outer housing 440 is removed from the shoulder strengthening system 400 in FIG. 15 for purposes of illustration. The joint assembly 442 is configured to enable multidirectional movement of the shaft assembly 444 relative to the frame 408. For example, the joint assembly 442 can include a base 428 coupled to the frame 408 and the shaft assembly 444 can be permitted to move in multiple directions relative to the base 428. The resistance mechanism 448 (FIGS. 15-17) is configured to selectively restrict movement of the shaft assembly 444 relative to the base 428. As such, the shoulder strengthening systems described herein (e.g., shoulder strengthening system 400) can provide omnidirectional muscle resistance to a user's shoulder.

Figure 16:
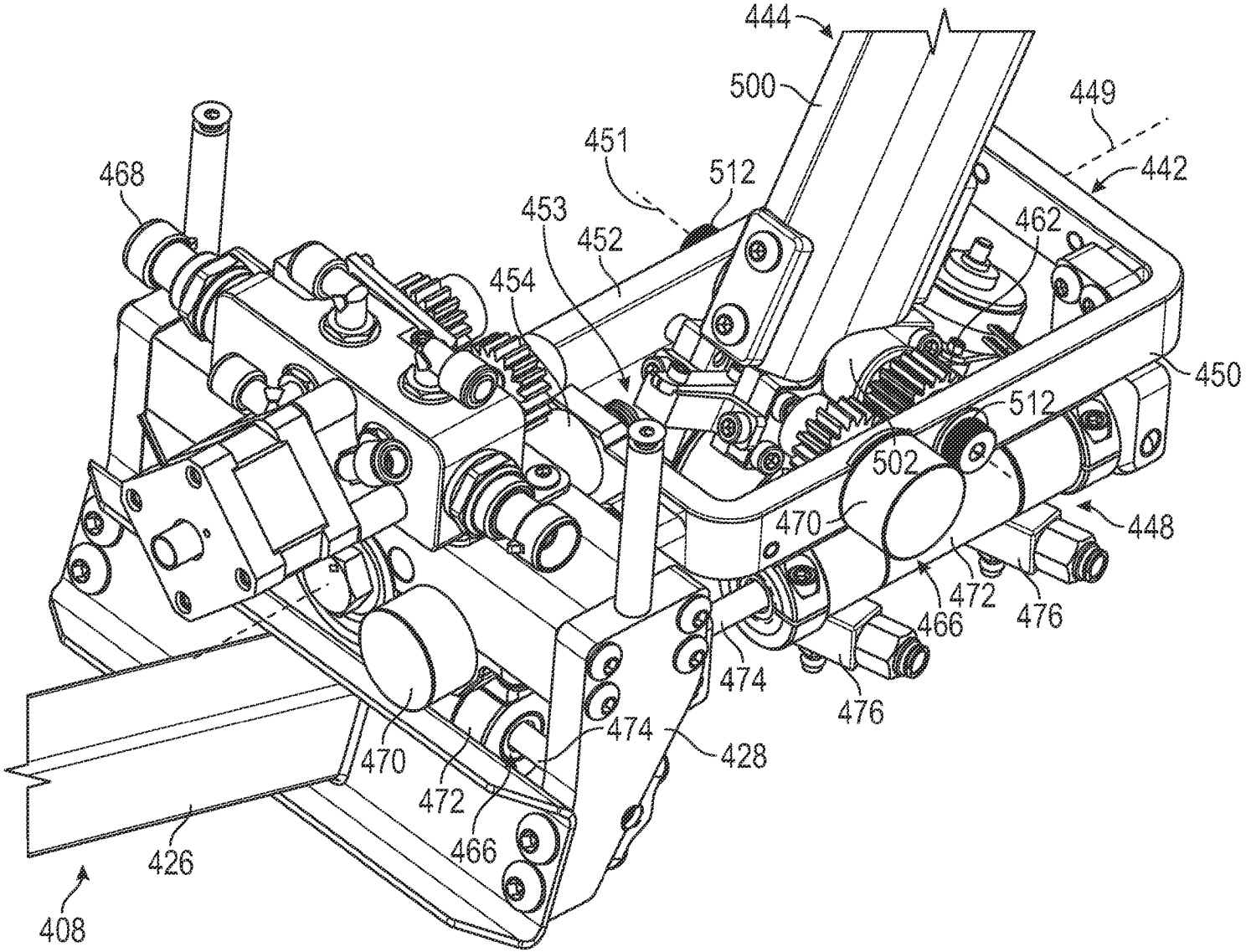
FIG. 16 is a perspective view of the shoulder strengthening system of FIG. 14 showing additional details of the resistance system of FIG. 15.
Figure 17:
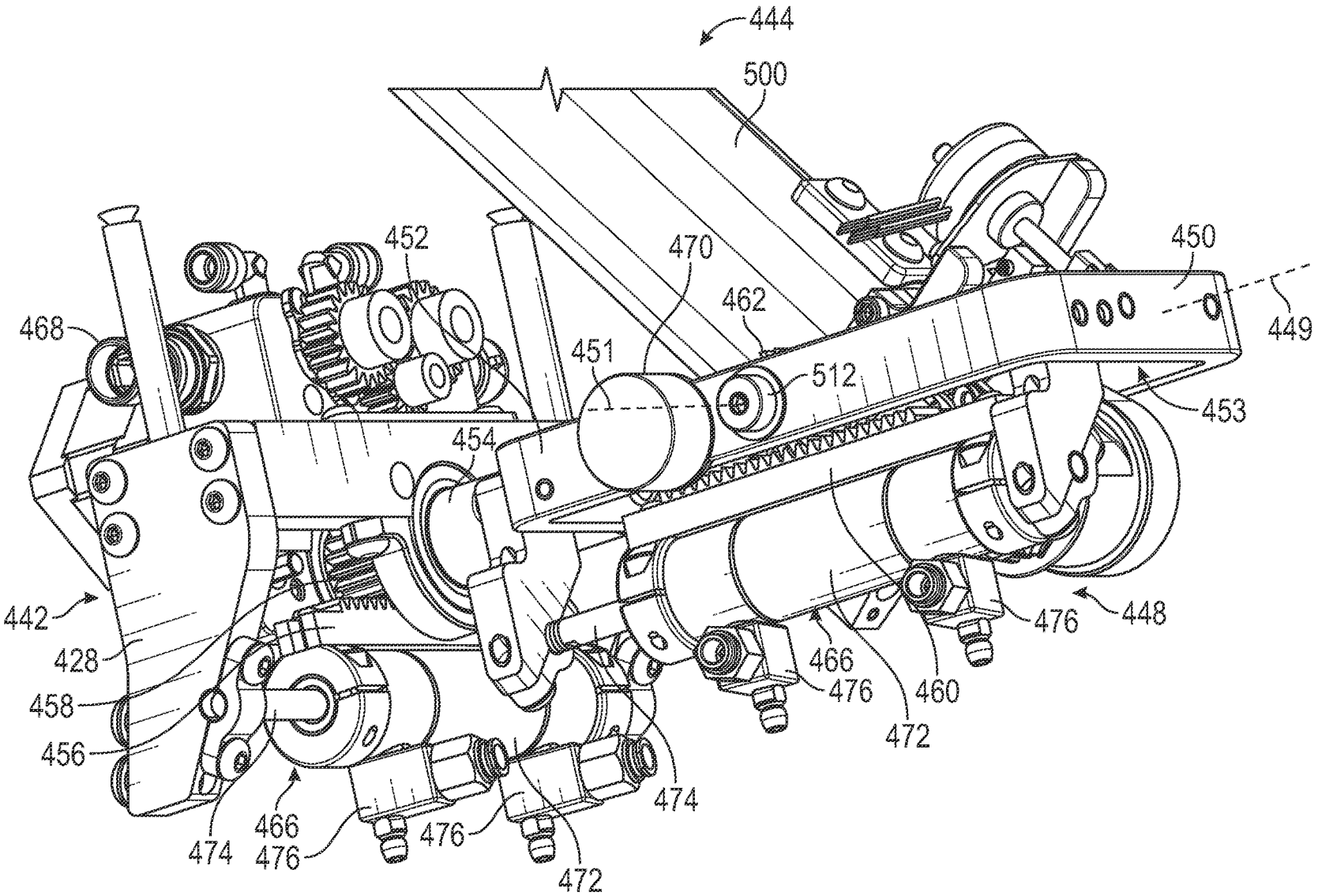
FIG. 17 is another perspective view of the shoulder strengthening system of FIG. 14 showing additional details of the resistance system of FIG. 15.

FIGS. 16 and 17 depict the joint assembly 442 and the resistance mechanism 448 in greater detail. As illustrated in FIG. 16, the base 428 of the joint assembly 442 is coupled to the slidable structure 426 of the frame 408. As discussed above, the slidable structure 426 is coupled to the arm 418 as part of an adjustable assembly 427, such that a distance between the chair structure 406 and the base 428 of the joint assembly 442 (and therefore the resistance system 402) can be adjusted by translating the slidable structure 426 relative to the arm 418.

The configuration of the joint assembly 442 can allow the shaft assembly 444 to move or pivot relative to the base 428 (and therefore the frame 408) in multiples directions and planes of motion. In some examples, as depicted, the joint assembly 442 can function as a universal joint, such that the joint assembly 442 enables movement of the shaft assembly 444 about two perpendicular axes. As such, the joint assembly 442 is also referred to herein as a "universal joint." For example, the joint assembly 442 includes a bracket 450 that is coupled to the base 428 and rotatable relative to the base 428 about a first axis 449. The shaft assembly 444 is coupled to the bracket 450 and rotatable relative to the bracket 450 about a second axis 451. As shown, the first and second axes 449, 451 are perpendicular to each other. Because the shaft assembly 444 is coupled to the bracket 450, rotation of the bracket 450 about the first axis 449 results in rotation of the shaft assembly 444 about the first axis 449. As such, the joint assembly 442 enables the shaft assembly 444 to rotate about both the first axis 449 and the second axis 451 simultaneously.

In this way, the shaft assembly 444 can move seamlessly between any number of positions within the range of movement permitted by the joint assembly 442. Thus, the shoulder strengthening system 400, for example, allows a user whose hand or wrist is secured to the wrist-ring structure 600 to move the shaft assembly 444 along a relatively full range of arm and shoulder motion relative to the chair structure 406. In other words, the user can move the wrist-ring structure 600 along at least a portion of a spherical surface, where the radius of the sphere is defined by a length of the shaft assembly 444. In some examples, as described in more detail below, the length of the shaft assembly 444 can be adjustable. In this way, the joint assembly 442 and the shaft assembly 444 enable a user to move the wrist-ring structure 600 within a spherical sector (or spherical cone).

As introduced above, the base 428 is fixedly coupled to the frame 408 (e.g., the slidable structure 426), such that the base 428 does not move and/or rotate relative to the slidable structure 426. In some examples (e.g., the example of FIGS. 31A-31B), the base 428 of the joint assembly 442 can be hingedly coupled to a component of a frame (e.g., frame 804) such that the base 428 can pivot relative to the frame about a third axis (e.g., axis 814 (FIGS. 31A-31B)). In this way, similar to the shoulder strengthening system 300, the shaft assembly 444 can be moveable about three axes (e.g., the first axis 449, the second axis 451, and a third axis that extends through the base 428 and/or is parallel to the second axis 451 but offset from the second axis 451, etc.).

As shown in FIGS. 16-17, the bracket 450 includes a body 452 having an opening 453 therein. In some examples, as depicted, the body 452 and the opening 453 are generally rectangular in shape. The shaft assembly 444 is positioned within the opening 453 and coupled to the body 452 via the joint assembly 442, as described in more detail below. A pinion shaft 454 extends from the body 452 of the bracket 450.

To enable rotation of the bracket 450 about the first axis 449, the joint assembly 442 includes a first rack 456 and a first pinion 458 (collectively, a "first rack and pinion system") (FIG. 17). The first rack 456 and the first pinion 458 each include teeth that are meshed together, such that rotation of the first pinion 458 drives linear movement of the first rack 456. The first rack 456 is coupled to the base 428 (e.g., via components of the resistance mechanism 448) and the first pinion 458 is coupled to the bracket 450. Specifically, the first pinion 458 is coupled to the pinion shaft 454 of the bracket 450, such that rotation of the bracket 450 about the first axis 449 (e.g., based on movement of the shaft assembly 444) can drive linear movement of the first rack 456.

To enable rotation of the shaft assembly 444 about the second axis 451, the joint assembly 442 includes a second rack 460 and a second pinion 462 (collectively, a "second rack and pinion system"). The second rack 460 and the second pinion 462 each include teeth that are meshed together, such that rotation of the second pinion 462 drives linear movement of the second rack 460. The second rack 460 is coupled to the bracket 450 (e.g., via components of the resistance mechanism 448) and the second pinion 462 is coupled to the shaft assembly 444. Specifically, the second pinion 462 is coupled to a base portion 502 of the shaft 500, such that rotation of the shaft assembly 444 about the second axis 451 can drive linear movement of the second rack 460.

As described above, based on the configuration of the joint assembly 442, a user can move the wrist-ring structure 600 (and therefore the shaft assembly 444). The movement of the wrist-ring structure 600 can be along at least a portion of a spherical surface, and in some examples, within a spherical sector. The range of motion of the shaft assembly 444 can be defined in part on the gear ratio of the first and second rack and pinion systems (e.g., based on the length of the first and second racks 456, 460, etc.). In some examples, the range of motion of the shaft assembly 444 can be limited or restricted by the size and/or shape of the opening 453 of the body 452 of the bracket 450 as well as a distance between a surface on which the shoulder strengthening system 400 is located and the first axis 449.

As shown in FIGS. 16-17, the first axis 449 is coaxial with the pinion shaft 454 of the bracket 450. The second axis 451 is coaxial with the second pinion 462 and extends through the base portion 502 of the shaft 500 and the body 452 of the bracket 450 (e.g., through a central portion of the body 452).

As described above, the resistance mechanism 448 is configured to resist movement of the shaft assembly 444, and thereby applying a resistance to a user's shoulder and arm. The resistance mechanism 448 is coupled to the joint assembly 442 and can include hydraulic members 466, one or more variable flow valves 468, and one or more sensors (e.g., pressure transducers, etc.). The resistance mechanism 448 operates to restrict movement of the joint assembly 442 via the hydraulic members 466 and flow valves 468.

The resistance mechanism 448 includes two hydraulic members 466 (e.g., a first hydraulic member 466 and a second hydraulic member 466) corresponding to the first and second rack and pinion systems. Specifically, each hydraulic member 466 can act to create a load on the respective rack and pinion system to provide variable resistance at each axis 449, 451 of the joint assembly 442. In other words, the hydraulic members 466 act to restrict the movement of the first rack 456 relative to the first pinion 458 and the second rack 460 relative to the second pinion 462, in order to generate the resistance.

Each hydraulic member 466 includes a housing 472, a rod 474 coupled to the housing 472, and one or more fluid ports 476 coupled to the housing 472. Each fluid port 476 is coupled via a tube or hose to a port of the variable flow valves 468. The rod 474 is configured to translate relative to the housing 472, for example, based on movement of the shaft assembly 444. As shown in FIGS. 16-17, the first and second racks 456, 460 are each coupled to the housing 472 of a respective hydraulic member 466. The rod 474 of the first hydraulic member 466 (e.g., the hydraulic member 466 corresponding to the first rack and pinion system 456, 458) is coupled to the base 428 (e.g., the structure supporting the first rack and pinion system 456, 458). The rod 474 of the second hydraulic member 466 (e.g., the hydraulic member 466 corresponding to the second rack and pinion system 460, 462) is coupled to the bracket 450 (e.g., the second rack and pinion system 460, 462). In this way, the housing 472 of the first hydraulic member 466 is permitted to translate along its corresponding rod 474 relative to the base 428 (e.g., perpendicular to first axis 449). Similarly, the housing 472 of the second hydraulic member 466 is permitted to translate along its corresponding rod 474 relative to the bracket 450 (e.g., perpendicular to second axis 451). Because the racks 456, 460 are each coupled to a housing 472 of a respective hydraulic member 466, rotational movement of a pinion causes translation of a rack as well as translation of the corresponding housing 472 relative to its supporting structure (e.g., the base 428 for the first rack and pinion system and the bracket 450 for the second rack and pinion structure).

Each hydraulic member 466, via hydraulic pressure, can be configured to restrict the relative translation between its respective rod 474 and housing 472 such that movement of the joint assembly 442 about the first and second axes 449, 451 can be restricted as the hydraulic member 466 resists movement of its corresponding rack. Consequently, a resistive force can be applied to the shaft assembly 444 in such a way that the multidirectional movement of the shaft assembly 444 can be restricted, while the shaft assembly 444 remains operable to move about the full range of motion provided by the joint assembly 442. In particular, the shaft assembly 444 can be manipulated along the full range of motion of the joint assembly 442, but the ease or difficulty to which the shaft assembly 444 is able to move can be modified via the force applied by the hydraulic members 466. For example, rotational movement of the joint assembly 442 about the first and/or second axes 449, 451 drives the hydraulic members 466, moving fluid through the hoses coupled to the members 466 and variable flow valves 468 to generate the resistance. As such, the resistive force, or the degree to which the movement of the joint assembly 442 and thereby movement of the shaft assembly 444 is restricted, can be proportional to the hydraulic pressure of the hydraulic members 466. This hydraulic pressure can be regulated via hydraulic fluid delivered to the hydraulic members 466 by the flow valves 468, to increase and decrease the flow of hydraulic fluid and therefore, the degree of resistance applied to the movement of the shaft assembly 444.

In some examples, as depicted, the hydraulic members 466 are double-acting hydraulic members (e.g., dual action hydraulic cylinders, etc.) and include two fluid ports 476. In this way, a selected resistance can be applied by the hydraulic members 466 to the first and second racks 456, 460 in both directions of travel of each rack 456, 460. This can enable the resistance applied by the hydraulic members 466 to the shaft assembly 444 to be different in the different directions of travel. For example, the first hydraulic member 466 can apply a first resistance to the shaft assembly 444 when the shaft assembly 444 is rotated in a first direction (e.g., clockwise) about the first axis 449 and can apply a second, different resistance to the shaft assembly 444 when the shaft assembly 444 is rotated in a second rotational direction (e.g., counterclockwise) about the first axis 449. In some examples, the resistance created by each hydraulic member 466 can be the same in both directions. By controlling the resistance in both directions of travel, in some examples, the hydraulic member 466 can provide improved precision of resistance for the joint assembly 442 and/or smoother articulation of the shaft assembly 444 as the user moves the shaft assembly 444 about the first axis 449 and/or the second axis 451.

Hydraulic pressure of the hydraulic members 466 can be operative to restrict the rotation of the first pinion 458 (and therefore the shaft assembly 444) about the first axis 449 and the second pinion 462 (and therefore the shaft assembly 444) about the second axis 451. As a result, the ability of the first and second pinions 458, 462 to drive the first rack 456 and the second rack 460 (and the corresponding housings 472 of the hydraulic members 466) relative to the respective rods 474 can be restricted, thereby restricting relative rotation between a pinion (e.g., first pinion 458, second pinion 462) about its respective axis (e.g., first axis 449, second axis 451) relative to its supporting structure (e.g., the base 428, the bracket 450). As such, movement of the joint assembly 442 about the first and second axes 449, 451 can be restricted, and a resistive force can be applied to the shaft assembly 444 in such a way that the multidirectional movement of the shaft assembly 444 can be restricted, while the shaft assembly 444 remains operable to move about the full range of motion provided by the joint assembly 442. In particular, the shaft assembly 444 can be manipulated along the full range of motion of the joint assembly 442, but the ease or difficulty to which the shaft assembly 444 is able to move can be modified via the restriction applied by the hydraulic members 466. Accordingly, the resistive force, or the degree to which the movement of the joint assembly 442 and thereby the shaft assembly 444 is restricted can be proportional to the hydraulic pressure of hydraulic members 466. This hydraulic pressure can be regulated, for instance, via the hydraulic fluid delivered to the hydraulic members 466 by the flow valves 468, as described herein.

Although not shown, the resistance mechanism 448 can include one or more transducers communicatively coupled to a processor board (e.g., similar to processor board 182) and/or the computer interface 439. For example, each hydraulic loop formed of a hydraulic member 466, a flow valve 468, and a hose connecting the hydraulic member 466 to the flow valve 468, can also include a pressure transducer (e.g., similar to pressure transducer 180). These pressure transducers can be configured to measure pressure differences in the hydraulic loop that result from adjusting the resistance in flow (e.g., via an adjustment knob or other input device such as one included on the computer interface 439) and can communicate those measurements to a processor board and/or the computer interface 439.

In some examples, the shoulder strengthening system 400 can also include one or more position sensors 470 coupled to the resistance system 402 that are configured to track the movement of the shaft assembly 444. For example, the position sensors 470 can be coupled to the joint assembly 442 and configured to detect and/or measure a position of the shaft assembly 444 relative to the base 428 of the joint assembly 442. In some examples, as depicted in FIGS. 16-17, the position sensors 470 can be rotational position sensors (e.g., a digital and/or analog rotary encoder) and can be configured to measure a rotational position of the shaft assembly 444 relative to the first axis 449 and the second axis 451. For example, as shown, each position sensor 470 can include a toothed gear that is coupled to (e.g., meshed with) either the first rack 456 or the second rack 460. As the racks 456, 460 are translated due to rotation of their respective pinions 458, 462, the position sensors 470 are likewise rotated due to their connection with the racks 456, 460. In this way, the rotation of the position sensors 470 corresponds to rotation of the shaft assembly 444 about a respective axis 449, 451, such that the position sensors 470 can measure a corresponding rotational movement of the shaft assembly 444. The output from the position sensors 470 can be communicated to the processor board and/or the computer interface 439.

In some examples, the position sensors 470 can be directly coupled to the pinions 458, 462, rather than coupled to the racks 456, 460 as described above. In some examples, not shown, the position sensors 470 can be linear position sensors and can be configured to measure a position of the shaft assembly 444 based on a linear position of each rack 456, 460 relative to its respective supporting structure (e.g., the base 428 for the first rack 456, and the bracket 450 for the second rack 460). The linear position can be used to determine the rotational positioning of the shaft assembly 444 about the first axis 449 and the second axis 451.

Although the disclosed joint assembly 442 and resistance mechanism 448 are described as being configured and/or arranged in a specified manner, it should be understood that a variety of other configurations and arrangements can be used to achieve the same or similar functionality as described herein. The joints for instance, need not be a universal joint, but can be any joint, such as a ball-and-socket joint or other joint, that can provide the same or similar range of motion of the disclosed joint assembly 442. Also, the hydraulic members 466 need not be dual-action hydraulic cylinders described herein but can be any hydraulic member and/or system configured to restrict movement of the joint and/or shaft. By way of example, the hydraulic members 466 can be configured to as single action hydraulic cylinders, while still providing the desired resistance to joint movement. As another example, one or more linear cylinders and/or pistons can be used in conjunction with or in place of the hydraulic members. It should also be appreciated that in addition to, or in lieu of, the hydraulic members, one or more additional mechanical and/or electrical components can be included to restrict the movement of the joint and/or shaft.

Figure 18:
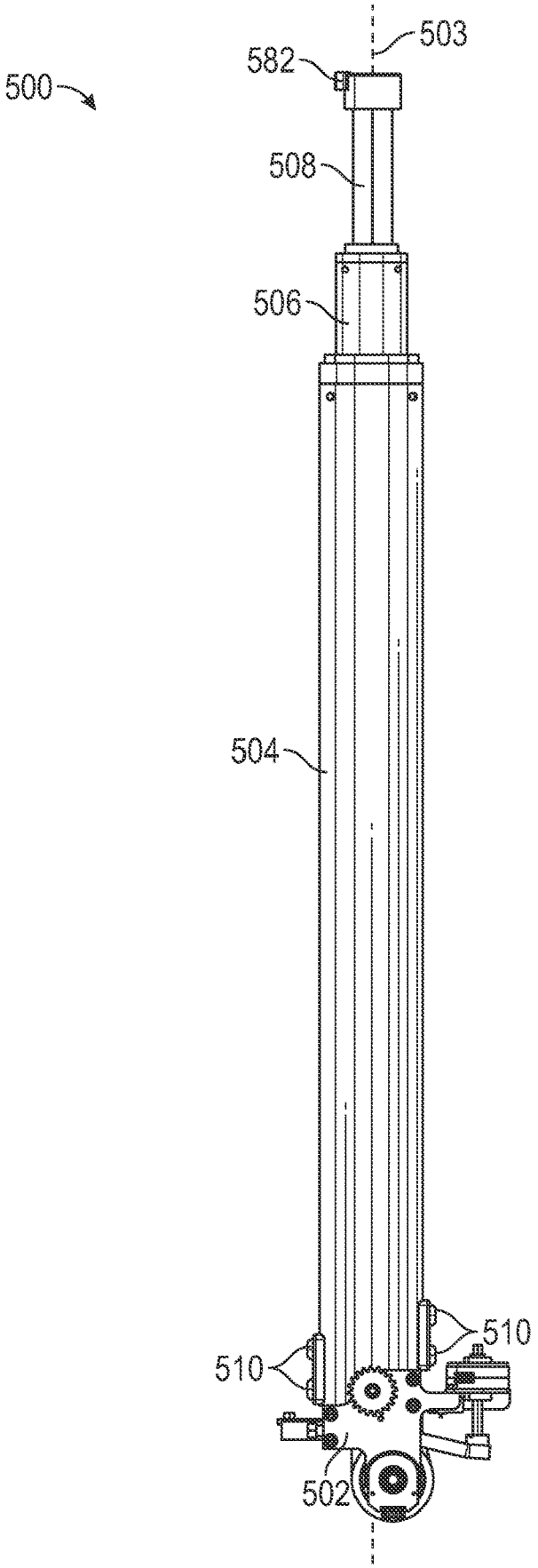
FIG. 18 is a side view of a shaft of the shoulder strengthening system of FIG. 14.
Figure 19:
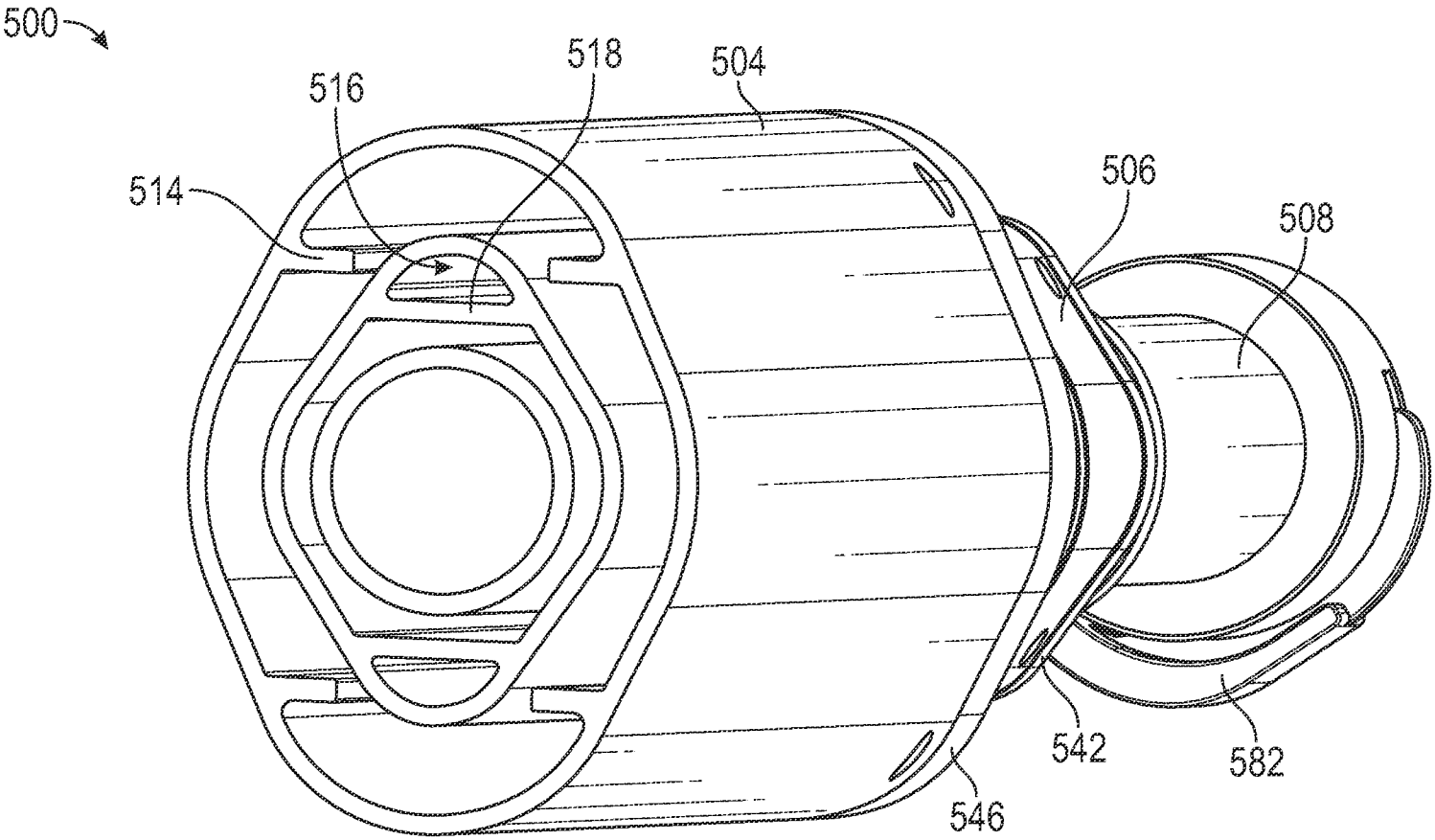
FIG. 19 is a cross-sectional view of a distal end portion of the shaft of FIG. 18.

The shaft assembly 444 can include a shaft 500 and a wrist-ring structure 600 coupled to the shaft 500, and the length of the shaft assembly 444 can be adjustable. Specifically, as depicted, the shaft 500 is adjustable in an axial direction along a longitudinal axis 503 (FIG. 18) of the shaft 500, such that a distance (e.g., height) between the joint assembly 442 and the wrist-ring structure 600 can be adjusted. With reference to FIGS. 18-19, the shaft 500 includes a base portion 502 and multiple concentric shafts or members that are coupled together. To adjust the length of the shaft 500, the concentric shafts or members are slidable relative to each other along longitudinal axis 503, as generally indicated by directional arrows D5 (FIG. 14). In this way, the shaft 500 can be said to be a telescoping shaft.

Figure 20:
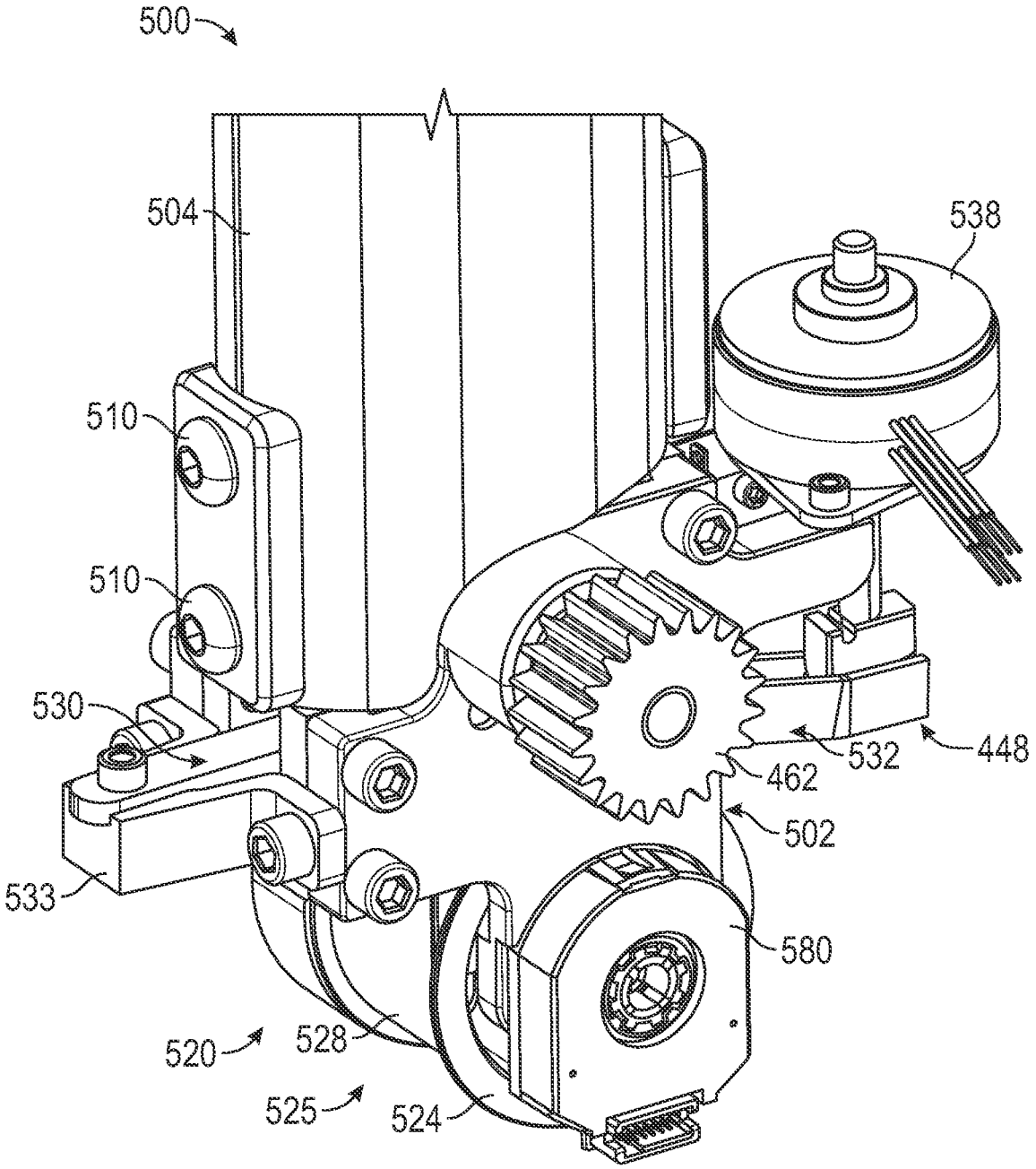
FIG. 20 is a perspective view of a proximal end portion of the shaft of FIG. 18.

The shaft 500 includes a first member 504 (or "outer member") that is coupled to the base portion 502, a second member 506 (or "middle member") disposed radially within the first member 504, and a third member 508 (or "inner member") disposed radially within the second member 506 and the first member 504. Although three members (e.g., first member 504, second member 506, third member 508) are shown in the illustrated example, in some examples, the shaft 500 can comprise a different number of members (e.g., 2, 4, etc.). As shown in FIGS. 18 and 20, a proximal end of the first member 504 can be coupled to the base portion 502 with fasteners 510 (e.g., screws, bolts, etc.), such that the first member 504 is fixed to the base portion 502 (e.g., cannot move axially along axis 503 relative to the base portion 502). In other instances, the base portion 502 and the first member 504 can be formed as a single, unitary piece.

FIG. 19 is a cross-sectional view of a distal end portion of the shaft 500. In some examples, as shown, the outer member 504 has a diamond shape cross-section having rounded apices and includes inner flanges 514 extending along a length of the outer member 504. The middle member 506 also has a diamond shape cross-section and includes inner walls 516 adjacent to two, opposite apices that define apex channels 518 extending along a length of the middle member 506. In some instances, the inner flanges 514 can serve as guides for the middle member 506, for example, to maintain alignment of the members as the middle member 506 and the inner member 508 move axially relative to the outer member 504. The inner member 508, in the illustrated example, has a circular cross-section and is disposed radially between the apex channels 518. In other examples, the members 504, 506, 508 can have different cross-sections, for example, all or a subset of the members can have circular cross-sections.

As introduced above, the base portion 502 can be coupled to the joint assembly 442. For example, as shown in FIG. 16, the base portion 502 is coupled to the second pinion 462 as well as the body 452 of the bracket 450. For example, one or more pins 512, which are coaxial with and rotatable about the second axis 451, can be used to couple the base portion 502 to the bracket 450. The pins 512 prevent the base portion 502 (and therefore the first member 504) from translating relative to the bracket 450 along the longitudinal axis 503 of the shaft 500.

Figure 21:
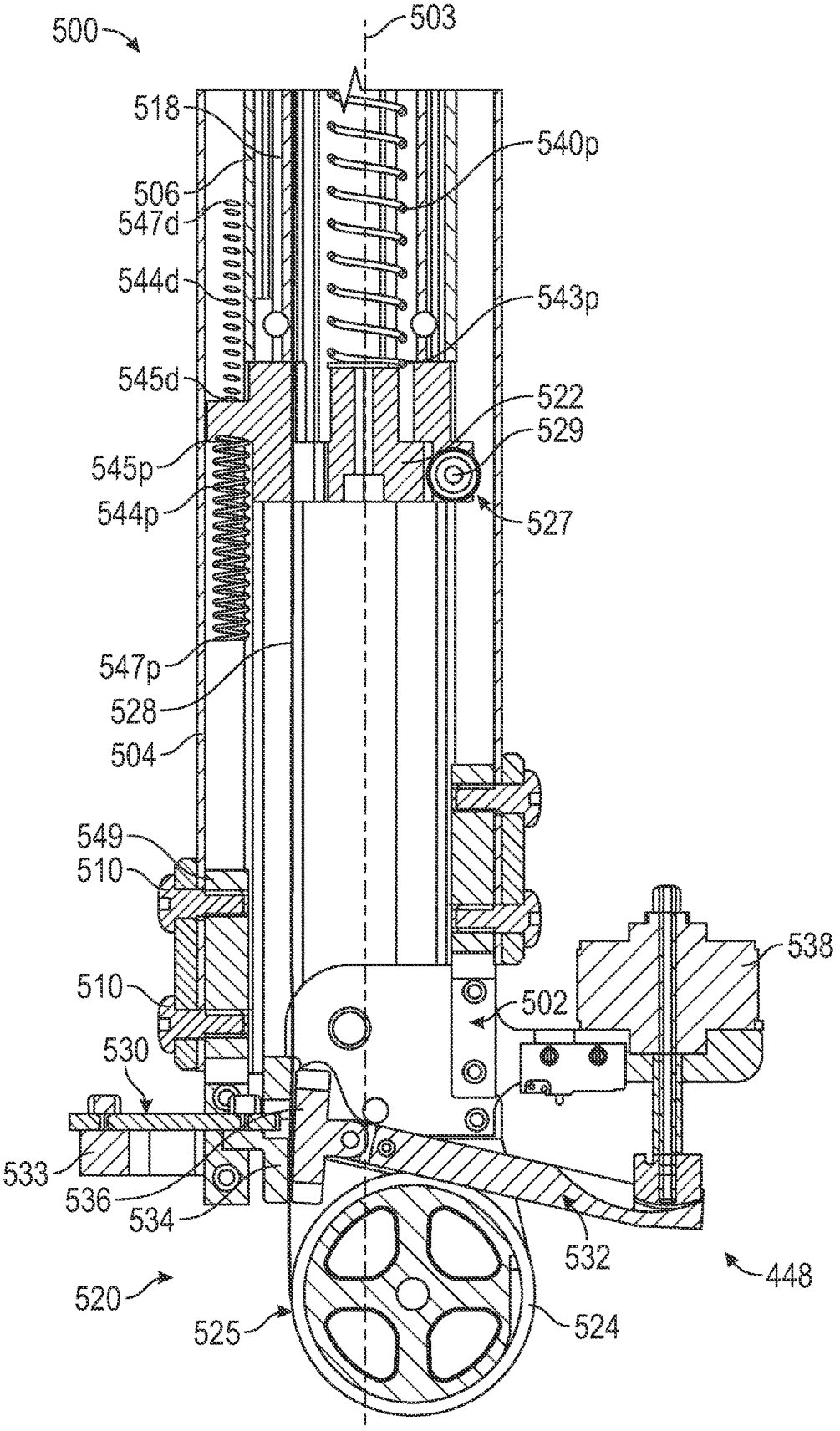
FIG. 21 is a cross-sectional view of the proximal end portion of the shaft of FIG. 18.
Figure 22:
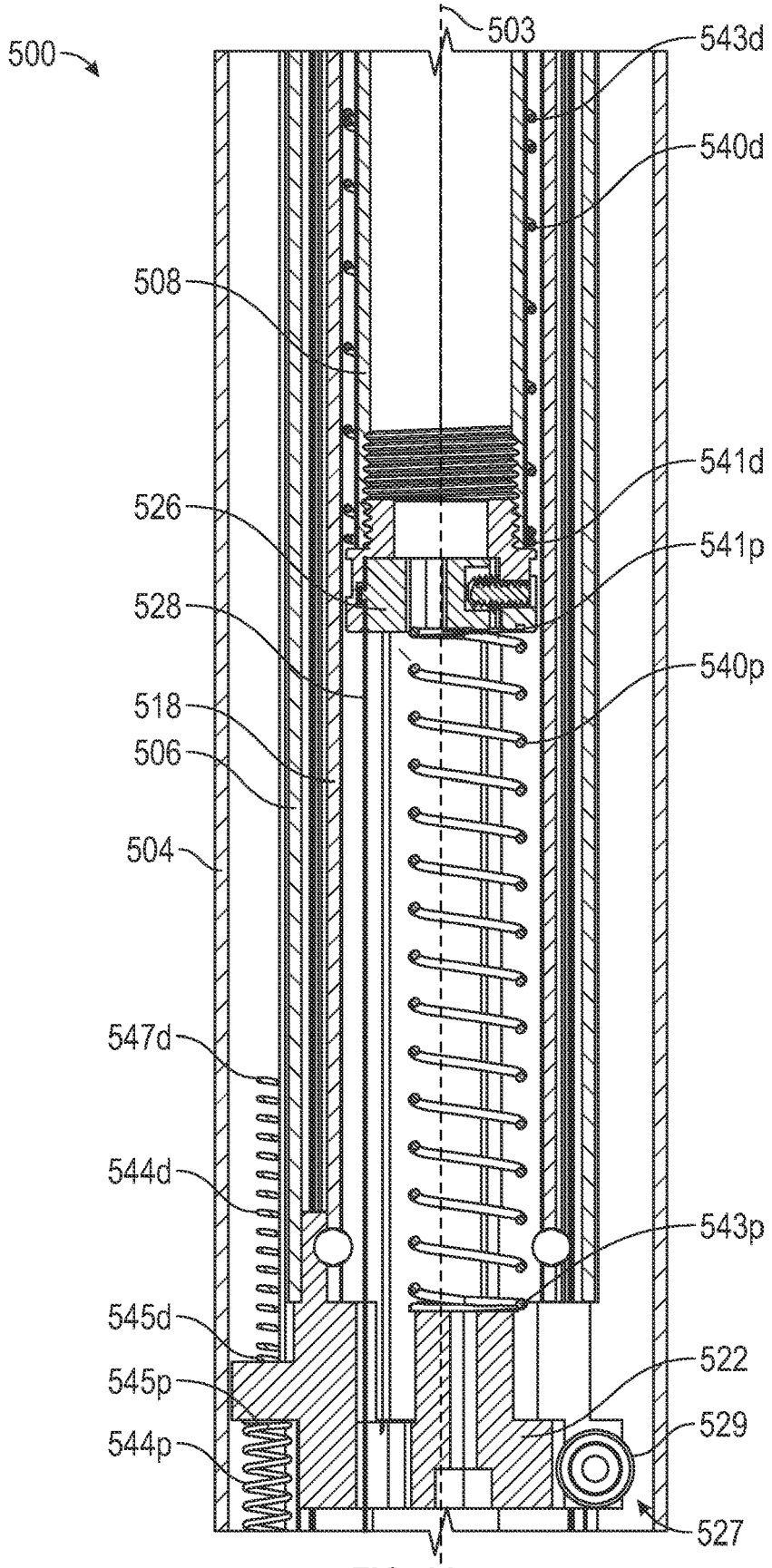
FIG. 22 is a cross-sectional view of a central portion of the shaft of FIG. 18.

FIG. 20 illustrates the base portion 502 as coupled to the first member 504. FIGS. 21-22 illustrate cross-sectional views of the shaft 500. Specifically, FIG. 21 depicts the connection between the base portion 502 and a proximal end of the first member 504 as well as the connection between the first member 504 and a proximal end of the second member 506. FIG. 22 depicts the connection between the first and second members 504, 506 as well as the connection between the second member 506 and a proximal end of the third member 508.

As shown in FIGS. 20-22, the first, second, and third members 504, 506, 508 can be coupled together and/or to the base portion 502 by a telescoping system 520 (also referred to herein as a linked system). The telescoping system 520 enables the third member 508 to translate relative to the base portion 502 and the first member 504, as well as relative to the second member 506, along the longitudinal axis 503. As described in more detail below, the first member 504 is fixed relative to the base portion 502, such that the first member 504 does not move relative to the base portion 502 (e.g., the two move together, etc.). The second and third members 506, 508 can each translate relative to the first member 504 at different rates, as described below.

The proximal ends of the second member 506 and the third member 508 can include proximal end caps configured to engage with the telescoping system 520. Specifically, the second member 506 can include a shuttle 522 coupled to the proximal end of the second member 506 and the third member 508 can include a clamp 526 coupled to the proximal end of the third member 508.

The telescoping system 520 can include a first pulley 525 coupled between the base portion 502 and the third member 508. The first pulley 525 couples the base portion 502 to the third member 508, such that the third member 508 can extend and retract relative to the base portion 502. The first pulley 525 can include a barrel 524 coupled to the base portion 502 and a belt 528 (e.g., tape, cable, rope, etc.) coupled to the barrel 524 and the clamp 526. The belt 528 can be wound about the barrel 524, such that a portion of the belt 528 is disposed on the barrel 524 (FIGS. 20-21). The remaining portion of the belt 528 extends in an axial direction, parallel to the longitudinal axis 503. Specifically, the belt 528 can extend from the barrel 524 through the shuttle 522 towards the third member 508. An end of the belt 528 is fixedly coupled to the proximal end of the third member 508 by the clamp 526 (FIG. 22). While illustrated as coupled to the base portion 502, in other examples, the barrel 524 can be coupled to other relatively fixed members of the shaft 500, such as the first member 504.

The telescoping system 520 can also include a second pulley 527 linking the first, second, and third members 504, 506, 508. Specifically, the second pulley 527 can be configured to link movement of the third member 504 with movement of the second member 506, such that movement of the third member 504 results in movement of the second member 506 (e.g., at different rates, etc.). The second pulley 527 can include one or more rollers 529 (one shown in FIGS. 21-22) and a pulley belt (omitted for purposes of illustration) (e.g., tape, cable, rope, etc.) disposed at least partially about the roller 529. The roller 529 is coupled to the second member 506, and in some examples, as depicted, to the shuttle 522 of the second member 506. The pulley belt can have one end coupled (e.g., fixed) to the base portion 502 and/or the first member 504 (e.g., to a distal end of the first member 504) and the other end of the pulley belt can be coupled to the third member 508 (e.g., to the clamp 526). In this way, the first, second, and third members 504, 506, 508 are linked together by the second pulley 527.

As the third member 508 translates distally relative to the base portion 502 (e.g., away from the base portion 502), the belt 528 unwinds from the barrel 524, such that a longer portion of the belt 528 is extended between the clamp 526 and the base portion 502. Similarly, as the third member 508 translates proximally relative to the base portion 502 (e.g., towards the base portion 502), the belt 528 winds around the barrel 524, such that a shorter portion of the belt 528 is extended between the clamp 526 and the base portion 502. In this way, the telescoping system 520 couples the third member 508 to the base portion 502, such that the third member 508 is permitted to translate relative to the base portion 502 (as well as the first member 504 and the second member 506), along the longitudinal axis 503.

As the third member 508 translates distally relative to the base portion 502 (e.g., away from the base portion 502), the second pulley 527 causes the second member 506 to also translate distally. Specifically, the pulley belt of the second pulley 527, which has an end coupled to the third member 508, rolls along the roller 529 as the third member 508 translates distally relative to the base portion 502, which causes the second pulley 527 (and therefore the second member 506) to move distally and away from the base portion 502. Similarly, as the third member 508 translates proximally relative to the base portion 502 (e.g., towards the base portion 502), the second pulley 527 causes the second member 506 to also translate proximally. In this way, the telescoping system 520 links the second member 506 to the third member 508.

In some examples, the translation of the second and third members 506, 508 can be at different rates. For example, the translation of the third member 508 can be twice as far as the corresponding translation of the second member 506 based on the configuration of the second pulley 527. Accordingly, the third member 508 and the second member 506 both translate along the longitudinal axis 503 at different (e.g., proportional) rates.

The first pulley 525 and the second pulley 527 of the telescoping system 520 can be configured to enable extension and retraction of the shaft 500 in a manner that can feel "weightless" (or at least less weighty) to a user operating the shaft 500. For example, the first pulley 525 and the second pulley 527 can be configured to exert zero force or nominal forces resisting the extension and retraction of the shaft 500. In other words, the force a user must exert to extend the shaft 500 to an extended configuration can be the same as the force a user must exert to retract the shaft 500 to a retracted or collapsed configuration. In some examples, the telescoping system 520 can include one or more additional pulleys to counteract the force of gravity (e.g., counteract the weight of various components of the system, such as the second and third members 506, 508 and their respective end caps 522, 526).

In some examples, a torsion spring can be coupled to the first pulley 525 (e.g., coupled to the barrel 524 and/or the belt 528). In some examples, the torsion spring can be configured such that unwinding of the belt 528 from the barrel 524 can cause the torsion spring to exert enough of a force to wind the belt 528 around the barrel 524 when the user translates the third member 508 axially towards the base portion 502. For example, the force can be relatively small such that the torsion spring does not retract the shaft 500 from an extended position towards a retracted position. In other words, the torsion spring does not assist the user in retracting the shaft 500 or translating the third member 508 axially relative to the first and second members 504, 506. Rather, the torsion spring can be included to ensure the belt 528 properly winds around the barrel 524. As such, the first pulley 525 can also be referred to as a spring or a bilateral spring.

In some examples (e.g., for exercise, rehabilitation, and/or therapeutic purposes), it may be beneficial to selectively add a resistance to the telescoping shaft 500. For example, after a user has made sufficient progress rehabilitating their shoulder using the shaft 500 in its "weightless" configuration, it may be beneficial to increase resistance to the telescoping functionality of the shaft 500 to strengthen the shoulder. As described above, the shoulder strengthening system 400 (via the resistance mechanism 448) is configured to selectively adjust resistance to the rotational functionality of the shaft 500. The shoulder strengthening system 400 can also be configured to selectively adjust resistance to the telescoping functionality of the shaft 500.

To apply a resistance to the telescoping system 520, the shaft 500 can include a pair of arms 530, 532 configured to function as a brake for the telescoping system 520. In some examples, as shown, the arms 530, 532 can function as a brake for the bilateral first pulley 525, by clamping around the belt 528. The arms 530, 532 can be coupled to the base portion 502 as shown in FIGS. 20-21. Specifically, the belt 528 is disposed between a receiver 534 of the arm 530 (or "receiver arm 530") and a pusher 536 of the arm 532 (or "pusher arm 532"). In some examples, as shown in FIG. 21, the receiver 534 is positioned at an end of the receiver arm 530 and has a concave surface. The pusher 536 is positioned at an end of the pusher arm 532 and has a corresponding convex surface, in some examples. The receiver 534 and the pusher 536 can be covered with a material or fabric, such as felt or leather. In some examples, the receiver 534 can be covered with leather and the pusher 536 can be covered with felt. As shown, the arms 530, 532 are generally perpendicular to the belt 528. The pusher arm 532 is operatively coupled to a motor 538 that is configured to move the pusher arm 532 towards the receiver arm 530, such that the pusher 536 compresses against the receiver 534, with the belt 528 sandwiched therebetween. In this way, the pusher 536 can selectively apply a resistive, frictional force to the belt 528 to prevent movement of the belt 528 relative to the arms 530, 532. In some examples, a force sensor 533 (e.g., a load cell) can be coupled to one of the arms (e.g., receiver arm 530) and configured to measure the force applied to the belt 528 (FIGS. 20-21). In some examples, the arms 530, 532 and the motor 538 are part of the resistance mechanism 448.

In some examples, the force sensor 533 and/or the motor 538 can be operatively coupled to the computer interface 439, such that a user can control and/or monitor the resistive load applied to the belt 528 by the motor 538 and the arms 530, 532 via the computer interface 439. In some examples, the computer interface 439 can track and display the resistance applied to and/or experience by the shaft 500 as a user retracts and/or extends the shaft 500. For example, the resistance applied to the belt 528 by the motor 538 and/or as detected by the force sensor 533 can be proportional to the resistance felt by the user as the user adjusts the length of the shaft 500 by translating the third member 508.

The telescoping system 520 can also include one or more dampers, shock absorbers, or the like. As shown in FIGS. 21-22, the second member 506 and the third member 508 each have a pair of springs disposed at its respective proximal end. As described in more detail below, the springs can act as dampening springs to improve the fluidity with which the members 504, 506, 508 of the telescoping shaft 500 extend and/or retract. Specifically, the third member 508 includes a distal spring 540*d* having a fixed end 541*d* coupled to a distal surface of the clamp 526 and a free end 543*d*. The third member 508 also includes a proximal spring 540*p* having a fixed end 541*p* coupled to a proximal surface of the clamp 526 and a free end 543*p*. In some examples, as shown, the distal spring 540*d* is disposed around an outer surface of the third member 508. The free end 543*d* of the distal spring 540*d* is configured to compress against an inner surface of the second member 506, for example, against an inner surface of a distal end cap 542 (FIG. 19) of the second member 506, when the third member 508 is translated distally relative to the second member 506 (e.g., to a fully extended configuration of the shaft 500). For example, when a user extends the third member 508 (e.g., by pulling on the wrist-ring structure 600 away from the base portion 502), the third member 508 can translate axially until the free end 543*d* of the distal spring 540*d* compresses against the distal end cap 542.

The free end 543*p* of the proximal spring 540*p* is also configured to compress against an inner surface of the second member 506 or an inner surface coupled to the second member 506, for example, against an inner, distal surface 566 of the shuttle 522, as shown in FIGS. 21-22. The free end 543*p* of the proximal spring 540*p* can compress against the distal surface 566 of the shuttle 522 when the third member 508 is translated proximally relative to the second member 506 (e.g., to a fully retracted configuration of the shaft 500). For example, when a user retracts the third member 508 (e.g., by pushing the wrist-ring structure 600 towards the base portion 502), the third member 508 can translate axially until the free end 543*p* of the proximal spring 540*p* compresses against the distal surface of the shuttle 522.

The second member 506 also includes a pair of springs 544*d*, 544*p*. Specifically, the second member 506 includes a distal spring 544*d* having a fixed end 545*d* coupled to a distal surface of the shuttle 522 and a free end 547*d*. The second member 506 can also include a proximal spring 544*p* having a fixed end 545*p* coupled to a proximal surface of the shuttle 522 and a free end 547*p*. The springs 544*d*, 544*p* are both disposed external to an outer surface of the second member 506. The free end 547*d* of the distal spring 540*d* is configured to compress against an inner surface of the first member 504, for example, against an inner surface of a distal end cap 546 (FIG. 19) of the first member 504, when the second member 506 is translated distally relative to the first member 504 (e.g., to the fully extended configuration of the shaft 500). For example, when the user has applied enough force to fully extend the third member 508 and the second member 506 (e.g., by pulling on the wrist-ring structure 600 away from the base portion 502), the second member 506 translates distally and can translate axially until the free end 547*d* of the distal spring 544*d* compresses against the distal end cap 546 of the first member 504.

The free end 547*p* of the proximal spring 544*p* is also configured to compress against an inner surface of the first member 504 or an inner surface coupled to the first member 504, for example, against a surface of the base portion 502. In some examples, as shown in FIG. 21, the free end 547*p* of the proximal spring 544*p* can compress against an extension 549 of the base portion 502 to which the first member 504 is coupled with fasteners 510, for example, when the shaft 500 is in a fully retracted configuration. For example, when the user has applied enough force to fully retract the third member 508 and the second member 506 (e.g., by pushing on the wrist-ring structure 600 towards the base portion 502), the second member 506 translates proximally and can translate until the free end 547*p* of the proximal spring 544*p* compresses against the base portion 502 (e.g., the extension 549).

It should be appreciated that one or more of the distal springs 540*d*, 544*d* can be configured to compress against other surfaces of the shaft 500 other than the end caps 542, 546 of the members 506, 504, respectively, to limit the translation of the members in the distal direction. For example, in some instances, the distal springs 540*d*, 544*d* can be configured to compress against other inner surfaces of the members 506, 504, respectively. Similarly, the proximal springs 540*p*, 544*p* can be configured to compress against other inner surfaces of the shaft 500 to limit the translation of the members in the proximal direction.

Figure 23:
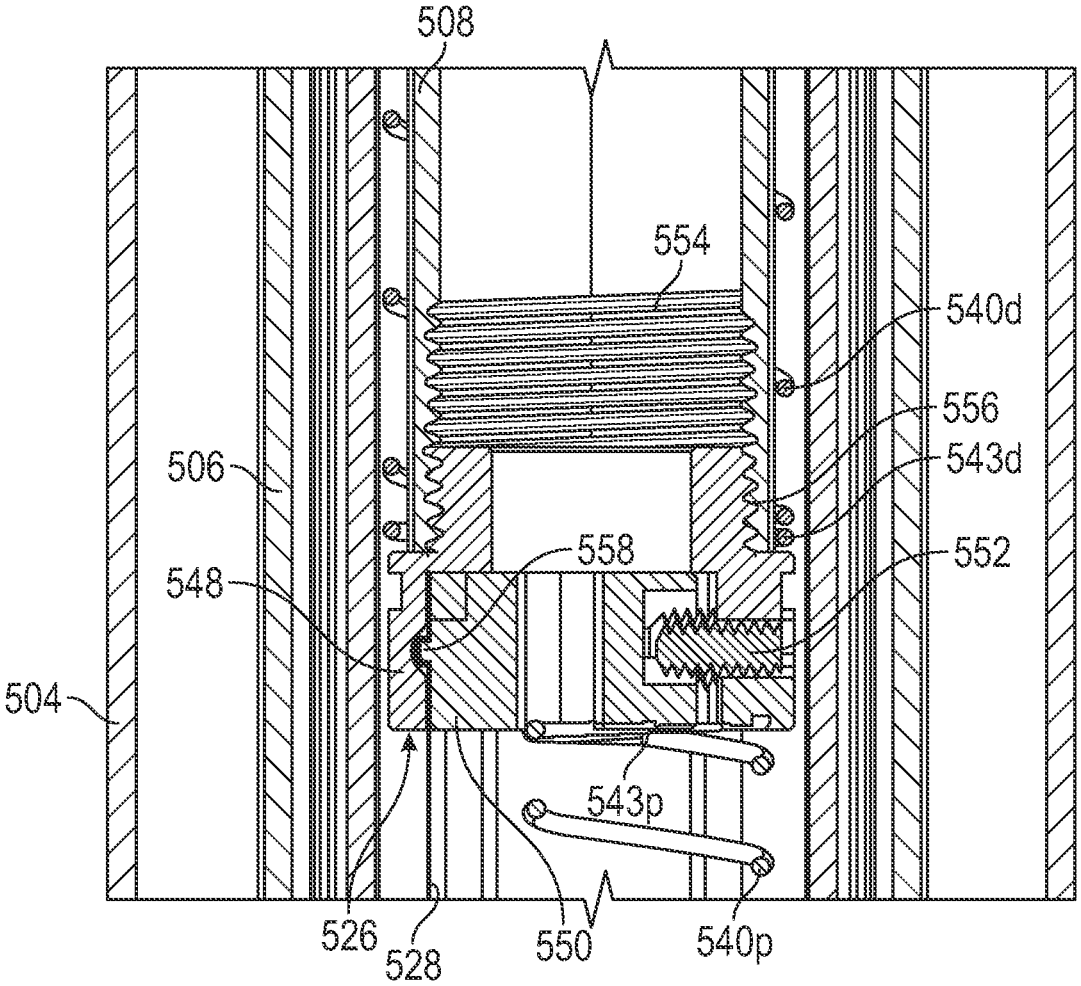
FIG. 23 is a cross-sectional view of the shaft of FIG. 18 showing additional details of a proximal end of an inner member of the shaft.

FIG. 23 illustrates the proximal end of the third member 508, and specifically, the clamp 526, in greater detail. The clamp 526 includes an outer member 548, an inner member 550, and a locking component 552 (e.g., a set screw, etc.) configured to retain a positioning of the inner member 550 relative to the outer member 548. As shown, the clamp 526 is coupled to the distal end of the third member 508 via a threaded connection. In some examples, as shown, an inner surface of the third member 508 includes internal threads 554 configured to receive external threads 556 disposed on an outer surface of the clamp 526, for example, on an outer surface of the outer member 548. In some examples, as shown, the fixed end 543*d* of the distal spring 540*d* is coupled to a distal face of the outer member 548 and the fixed end 543*p* of the proximal spring 540*p* can be coupled to proximal face(s) of the outer member 548 and/or the inner member 550.

As introduced above, an end of the belt 528 is coupled to the clamp 526 and fixedly retained therein. For example, as shown in FIG. 23, the belt 528 is compressed between the outer member 548 and a flange 558 of the inner member 550. The locking component 552 can maintain the compression between the flange 558 and the outer member 548 to sandwich the belt 528 therebetween. In some examples, the pulley belt of the second pulley 527 can also be coupled to the clamp 526 and fixedly retained therein in addition to the belt 528.

Figure 24:
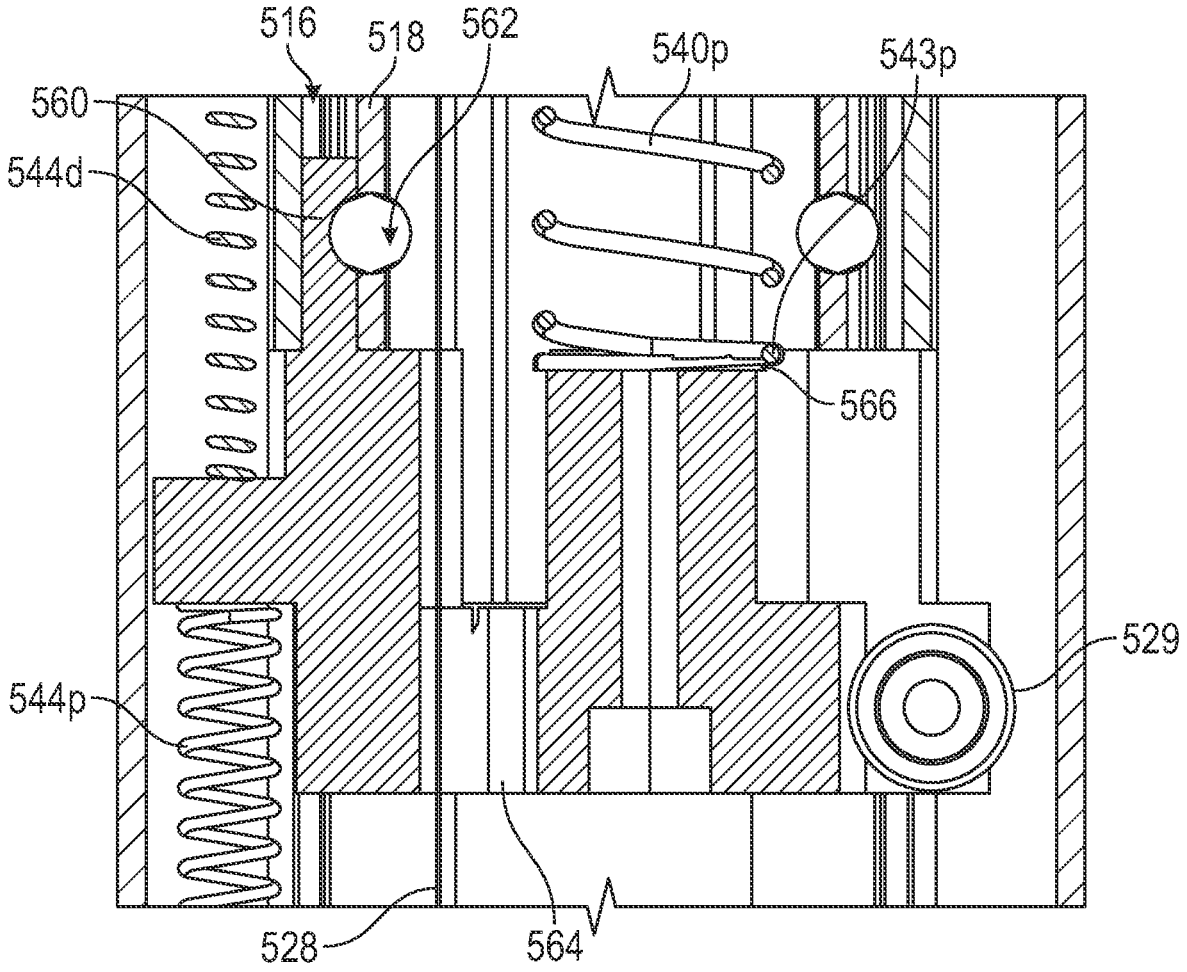
FIG. 24 is a cross-sectional view of the shaft of FIG. 18 showing additional details of a proximal end of a middle member of the shaft.
Figure 25:
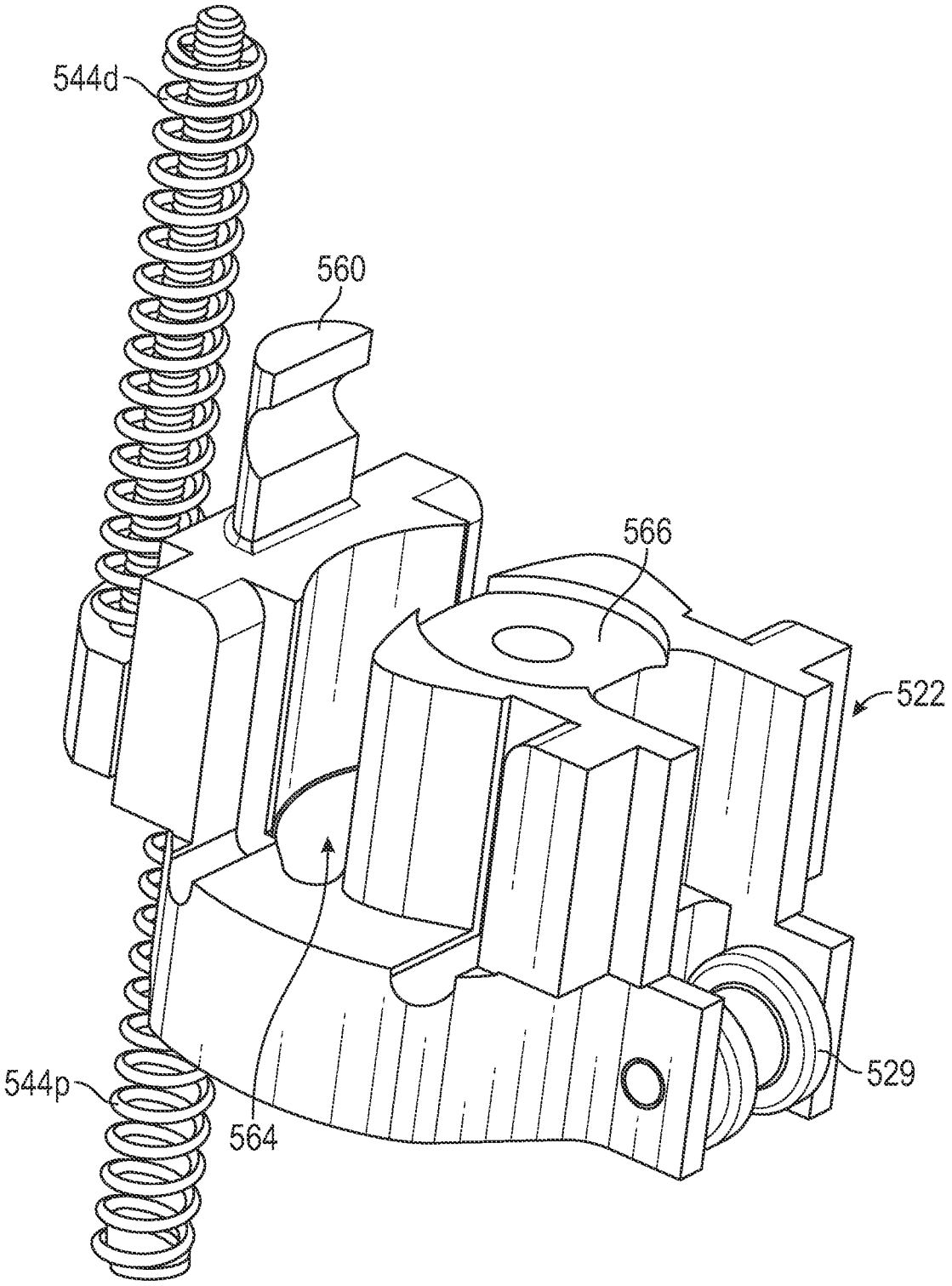
FIG. 25 is a perspective view of a shuttle coupled to the proximal end of the middle member of the shaft of FIG. 18.

As introduced above, the proximal end of the second member 506 is coupled to the shuttle 522. Specifically, as shown in FIGS. 24-25, the shuttle 522 includes a projection 560 that is configured to be inserted into one of the apex channels 518 (see also FIG. 19) of the second member 506. The projection 560 can be used to couple the second member 506 to the shuttle 522. For example, a pin can be inserted through an opening 562 of the second member 506 and engage with the projection 560, such that the second member 506 is prevented from translating and/or rotating relative to the shuttle 522. In some examples, as shown, the opening 562 can also extend through the inner wall 516 (see also FIG. 19). In some examples, the second member 506 can be coupled to the shuttle 522 in other manners, including but not limited to fasteners such as screws, bolts, or the like. In some examples, as shown, the springs 544*d*, 544*p* are coupled to one side of the shuttle 522, and the roller 529 is coupled to the opposite side of the shuttle 522, although the springs 544*d*, 544*p* and the roller 529 can be coupled to the shuttle 522 in other manners in other examples. For example, while only one roller 529 is shown in FIG. 25, in other examples, the shuttle 522 can include multiple rollers. The shuttle 522 can also include an opening or passageway 564 through which the belt 528 extends. In some examples, the pulley belt of the second pulley 527 can also extend through the passageway 564. As described above, in some examples, the proximal spring 540*p* coupled to the third member 508 can compress against the distal surface 566 as the third member 508 is retracted relative to the base portion 502.

Referring again to FIG. 20, the shaft 500 can also include one or more sensors. In some instances, a processor board can be coupled to the shaft 500, for example, to the base portion 502 and operatively coupled to the sensors and the computer interface 439. For example, as described above, the shaft 500 can include a force sensor 533 in some examples that is coupled to the receiver arm 530 to detect or measure the force applied to the belt 528. Additionally, in some examples, a position sensor 580 (e.g., a rotary sensor, an optical encoder, etc.) can be coupled to the barrel 524, and operatively coupled to a processor board and/or computer interface 439. The position sensor 580 can be configured to track and measure the telescoping position/motion of the second member 504 and the third member 506 relative to the base portion 502. The position sensor 580 can, for instance, detect a rotational position of the barrel 524 to measure a length of belt 528 that has been unwound from the barrel 524. This measurement can be used, for example, by the computer interface 439, to determine a position to which the shaft 500 has been extended or retracted. In some examples, data associated with the position sensor 580 (e.g., data corresponding to the telescoping position of the shaft 500, etc.), the motor 538, the force sensor 533 (e.g., data corresponding to the resistance applied to and/or experienced by the belt 528, etc.) and/or other components of the shaft 500 can be transmitted to the processor board and/or computer interface 439 (e.g., via a wired connection, via wireless communication, such as Bluetooth, etc.).

Although the disclosed shoulder strengthening system 400 is described as having one or more transducers, sensors, or gauges, it should be appreciated the system need not include these features to function but is enhanced by the added functionality and benefits they provide. Moreover, though quantities of individual components described herein are specified with particularity, it should be understood one or more components may be added or removed while still allowing the shoulder strengthening system to fully function in accordance with the present disclosure.

Figure 26A:
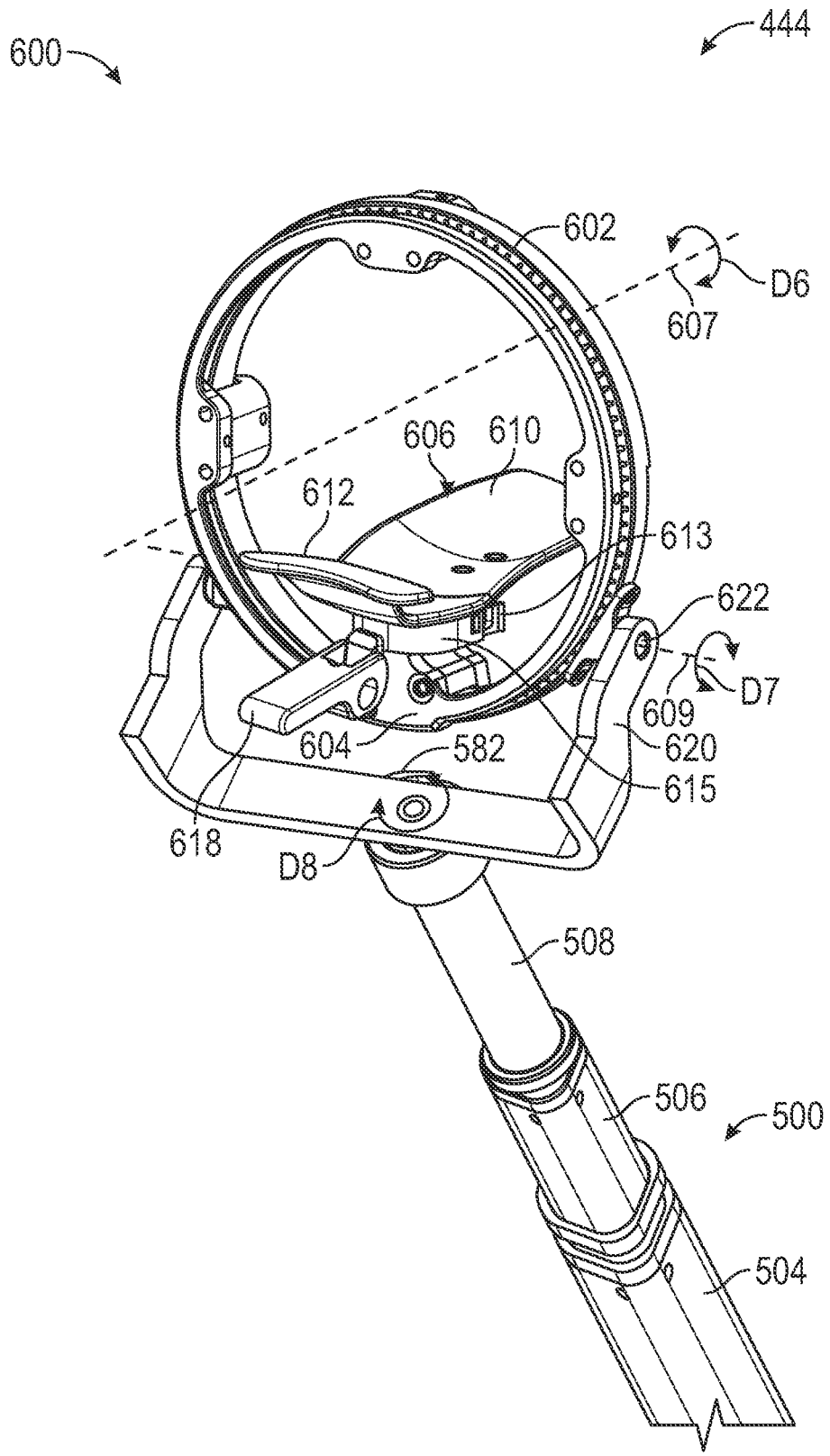
FIG. 26A is a perspective view of a shaft assembly including the shaft of FIG. 18 and a wrist-ring assembly coupled to the shaft.

FIG. 26A depicts the wrist-ring structure 600 coupled to a distal end of the third member 508 of the shaft 500. Specifically, the distal end of the third member 508 can include an opening configured to receive a portion of the wrist-ring structure 600 and a locking lever 582 (see also FIGS. 18-19) configured to releasably couple the wrist-ring structure 600 to the third member 508 (e.g., by transitioning the locking lever 582 between a locked position and an unlocked position). The wrist-ring structure 600 can be configured to brace the wrist and thereby the arm and hand of a user and permit the wrist to rotate and pivot about multiple axes. The wrist-ring structure 600 can also be configured to restrict or limit certain wrist movement, such as when certain wrist or arm movement is undesirable for a given exercise. As described above, the shaft assembly 444 (e.g., the shaft 500 and wrist-ring structure 600) is capable of multidirectional movement relative to the frame 408 and chair structure 406 via the operation of the joint assembly 442, for example, about first axis 449, about axis 451, and/or along axis 503. The resistance mechanism 448 can be operable to apply a resistive force to the joint assembly 442 and/or to the telescoping system 520 to restrict the movement of the shaft assembly 444 (e.g., the shaft 500 and wrist-ring structure 600) relative to the frame 408 and chair structure 406 as a user manipulates the shaft assembly 444 along the range of motion provided by the joint assembly 442.

Figure 26B:
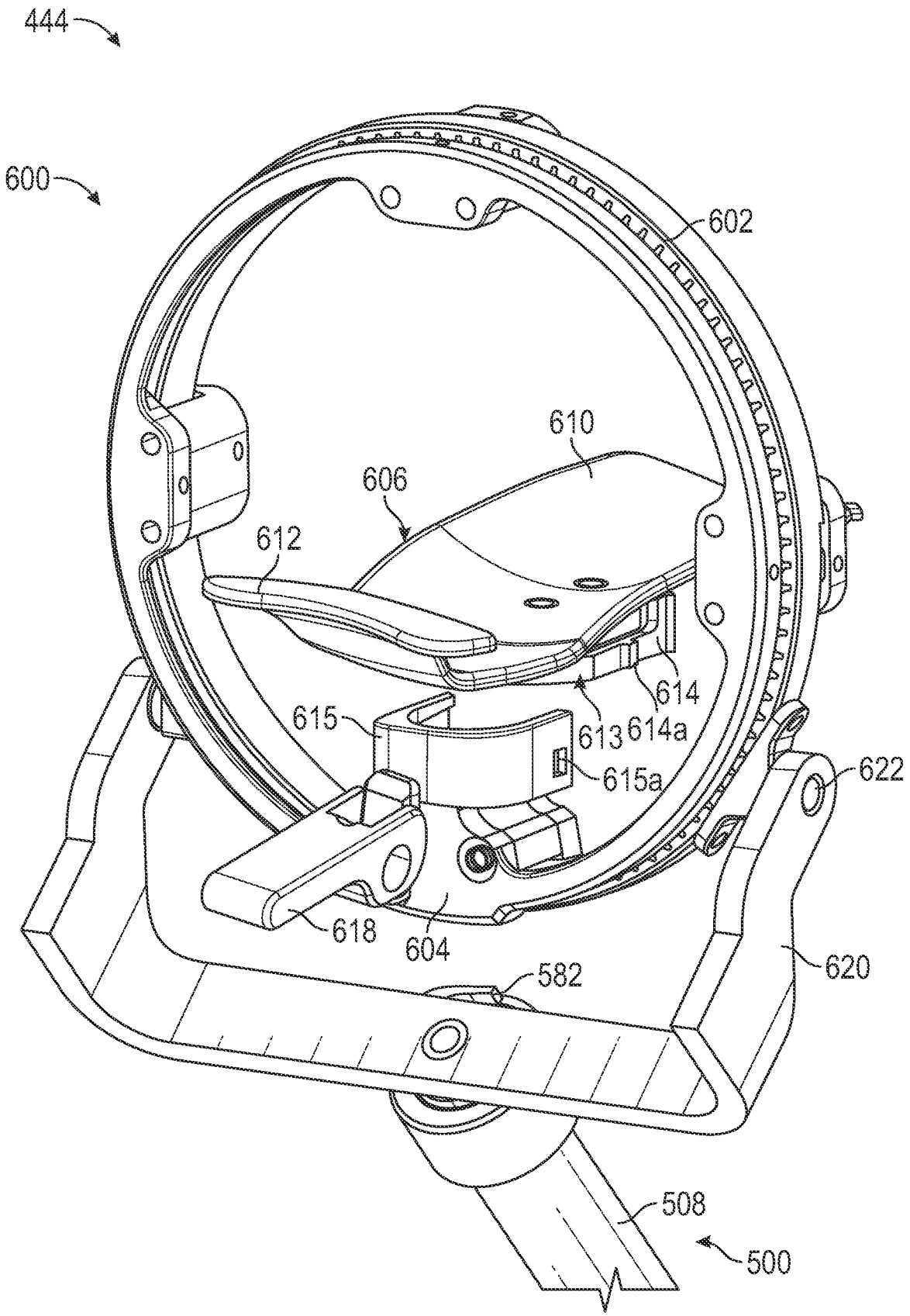
FIG. 26B is a perspective view of the shaft assembly of FIG. 26A with a brace detached from the wrist-ring assembly.
Figure 27:
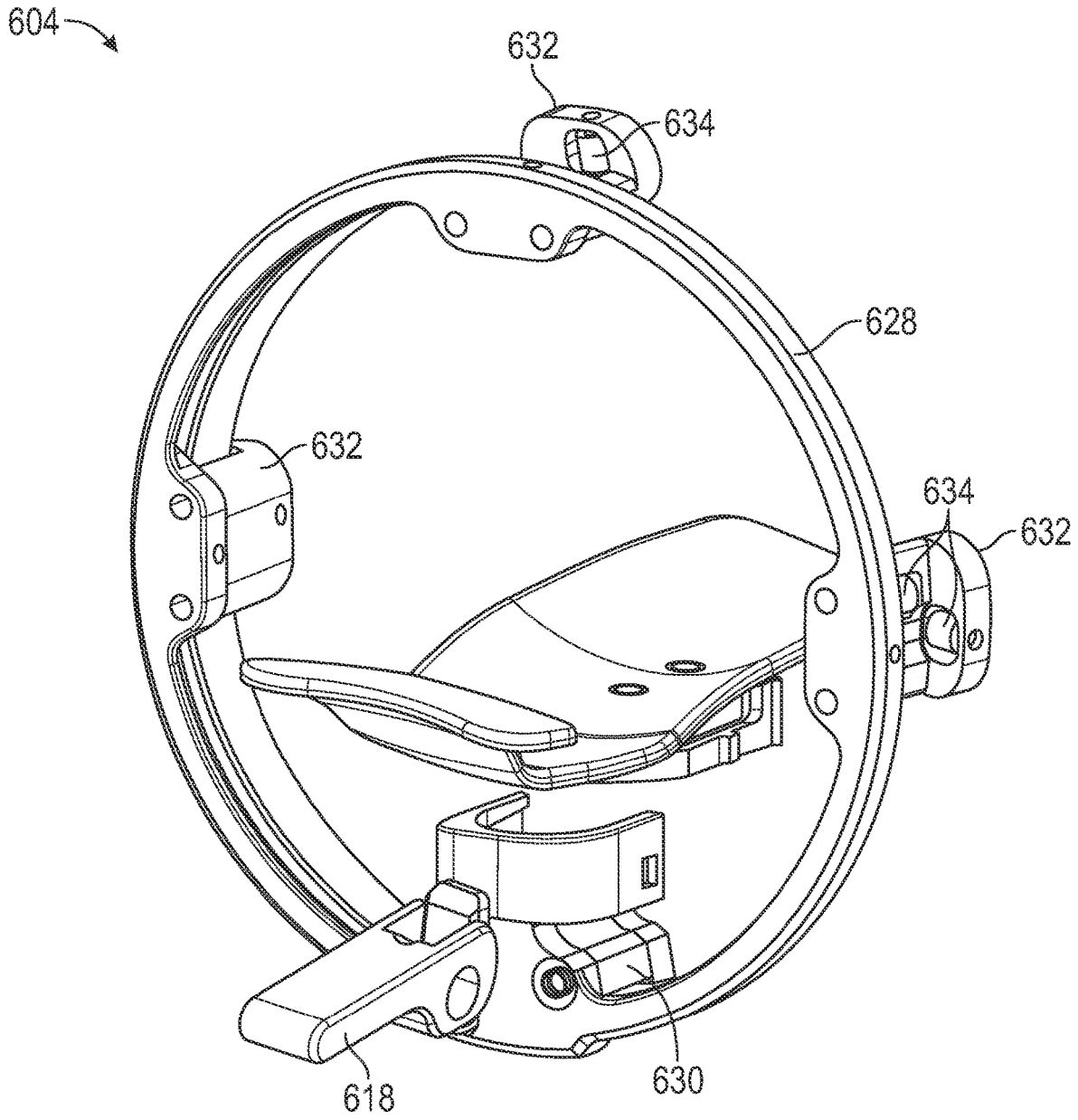
FIG. 27 is a perspective view of a shuttle of the wrist-ring assembly of FIGS. 26A-26B.
Figure 28:
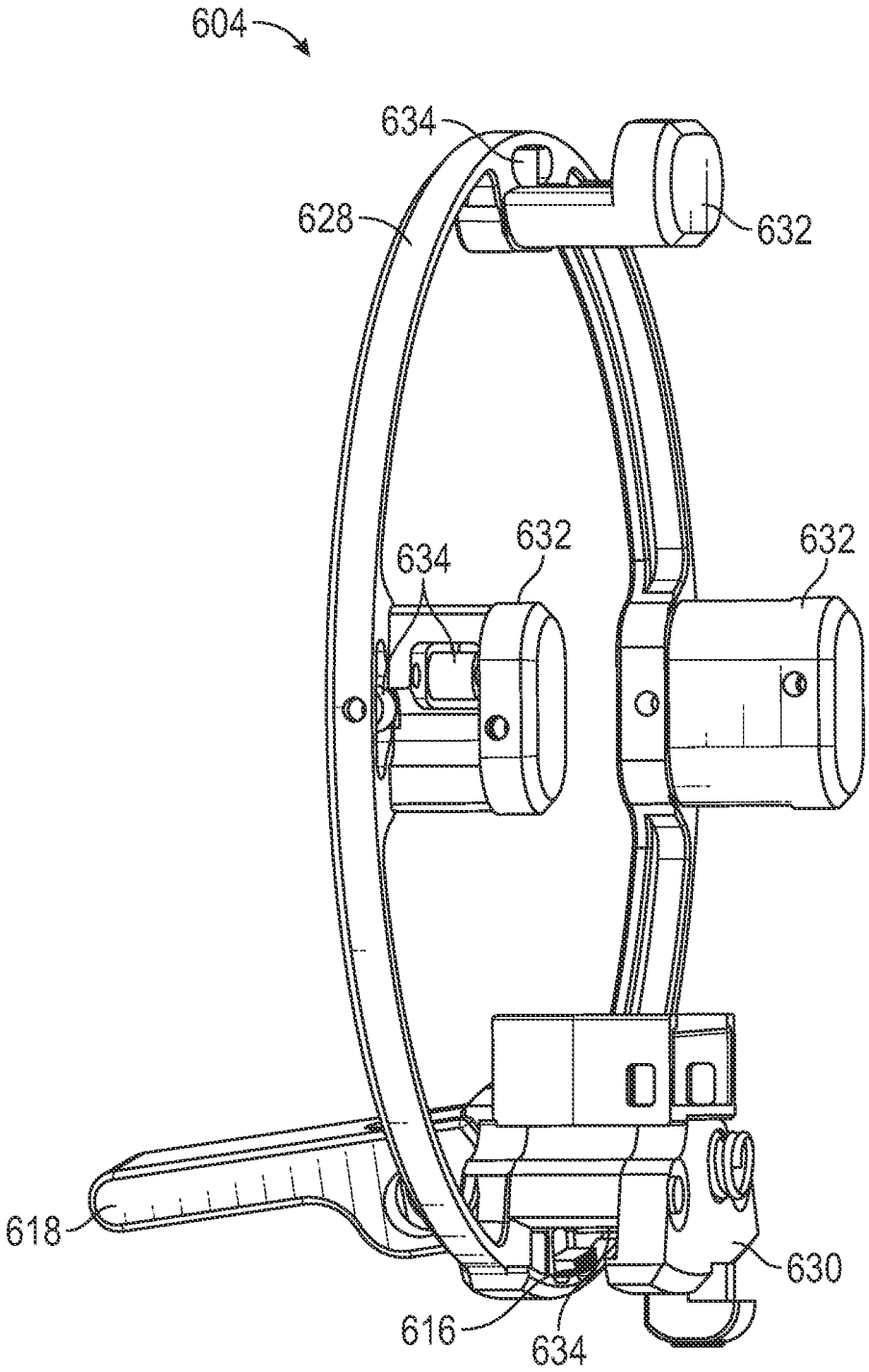
FIG. 28 is another perspective view of the shuttle of FIG. 27.

The wrist-ring structure 600 can include a ring 602, a shuttle 604 movably coupled to the ring 602, and a brace 606 coupled to the shuttle 604. As shown in FIGS. 26A-26B, the brace 606 can be configured to support and secure the hand and wrist of an individual user of the shoulder strengthening system 400. For instance, the brace 606 can include a rearward portion 610 configured to securely support the wrist and forearm of the user, and a frontward, curved portion 612 configured to securely support the palm and, in some instances, a portion of the fingers. In some examples, as shown, the curved portion 612 can include an opening for a thumb of the user. The curved portion 612 in this case, causes the palm and fingers to arc toward the forward end of the brace 606. This configuration of the frontward portion 612 which curls the palm and fingers of the user's hand can provide significant benefits, such as by ensuring the user's movement is primarily isolated to shoulder movement, rather than other parts of the arm. In particular, in their relaxed state, the flexor muscles of the hands and forearms flex the digits of the hand with greater force than the extensors, thus by allowing the hand to remain as ergonomically natural as possible, muscle tension and the forces across unwanted joints, such as in the wrist and elbow, decrease and allow further isolation of the shoulder joint.

The brace 606 can also include one or more fastening mechanisms (e.g., similar to fastening mechanisms 214), such as a strap or an elastic component to securely retain and restrict the movement of the user's arm, wrist, and hand relative to the brace 606. The fastening mechanisms in this configuration can retain the hand of the user against the brace 606, such as when the hand wants to draw or lift away from the surface of the brace 606, for example, to increase the length of the shaft 500 and/or adjust the positioning of the shaft 500. This also ensures user movement is directed primarily to isolated shoulder movement, as opposed to relying too heavily on hand movement to manipulate the positioning of the shaft 500 and thereby detracting from the intended dynamic 360-degree shoulder movement.

In some examples, the rearward portion 610 and/or the curved portion 612 can also be molded or formed to receive and better retain the corresponding anatomy. For example, the curved portion 612 can be shaped to receive a specific hand (e.g., a right hand) of the user. This is different than curved portion 212 (FIGS. 7A-7B), for example, which is generally configured to receive either hand of a user and is non-specific. This, among other things, allows the brace 606 to be suited for general support and comfort. Although described as a brace to support and secure the wrist and hand of the user, it should be appreciated the brace 606 can be configured in a variety of ways. For example, in addition to or in lieu of the brace 606, a brace can be constructed to securely support the upper forearm, the upper arm, and/or the elbow joint.

In some examples, as shown in FIG. 26B, the brace 606 can be detachable from the shuttle 604. For example, a user can remove the brace 606 from the shuttle 604 of the wrist-ring structure 600 for storage when the wrist-ring structure 600 and/or the shoulder strengthening system 400 is not in use, for cleaning the brace 606, and/or for attaching a different brace or other structure to the wrist-ring structure 600. Specifically, the brace 606 can include a base 613 coupled to a lower surface of the brace 606 (e.g., the surface opposite the one the user's hand engages with). The shuttle 604 can include a corresponding frame 615 for receiving the base 613 of the brace 606. Specifically, the frame 615 is configured to releasably couple the base 613 to the frame 615, such that the brace 606 is coupled to the shuttle 604.

In some examples, the base 613 can function similar to a side release buckle. For example, as shown in FIG. 26B, the base 613 can include prongs 614 on either side of the base 613. Each prong 614 can include a projection or pin 614*a* extending outwardly therefrom. The pins 614*a* correspond to openings 615*a* in the frame 615, such that the prongs 614 of the base 613 can clip into the frame 615, with the pins 614*a* positioned within the openings 615*a*. To release the base 613 from the frame 615, a user can compress (e.g., squeeze) the prongs 614 towards each other, until the pins 614*a* are released from the openings 615*a* and the base 613 can be removed from the frame 615.

The brace 606 can be coupled to the shuttle 604 and the shuttle 604 can be movably coupled to the ring 602. The shuttle 604 is shown alone in FIGS. 27-29. As shown, the shuttle 604 can include a ring frame 628 and a plurality of extensions (e.g., a base extension 630 and one or more supporting extensions 632) extending axially from the ring frame 628. As shown, the frame 615 is coupled to the base extension 630. Each of the extensions 630, 632 can include one or more rollers 634 to engage the surface of the ring 602. In some examples, as shown, the supporting extensions 632 include three rollers 634. The base extension 630 can include two rollers 634 configured to receive and engage with the edges of the ring 602. A different number of rollers 634 and/or supporting extensions 632 can be included in other examples.

The rollers 634 enable the shuttle 604 to move along the path formed by the edges and teeth of the ring 602 in a smooth continuous motion. As such, the shuttle 604 and the brace 606 can be free to move clockwise and counterclockwise along the circumference of the ring 602 (e.g., about a central axis of the ring 602). As such, as shown in FIG. 26A, the brace 606 and shuttle 604 can be configured to rotate, as indicated by directional arrow D6, about a central axis 607 of the ring 602 extending through the center of the ring 602 and perpendicular to the plane of the ring 602. In this way, the shuttle 604 and brace 606 can be said to move or rotate about a first axis (e.g., axis 607) of the wrist-ring structure 600.

Figure 29:
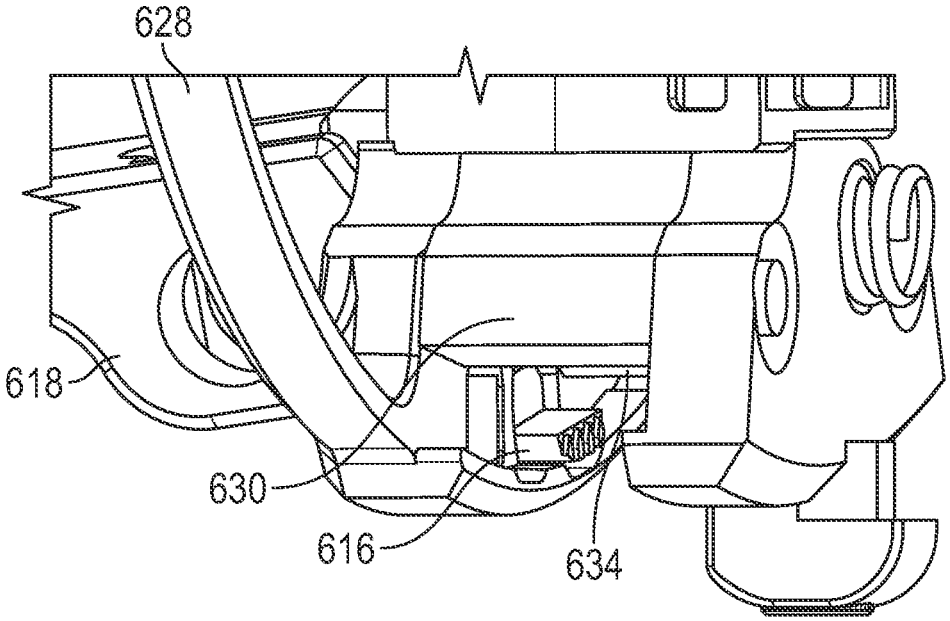
FIG. 29 is a detailed perspective view of a base portion of the shuttle of FIG. 27.

The base extension 630 can also include a jaw structure 616 and a control lever 618. The jaw structure 616 can be configured to selectively clamp or lock the base extension 630 (and therefore the shuttle 604) to the ring 602, to prevent relative movement between the shuttle 604 and the ring 602. As shown in FIG. 29, the jaw structure 616 can include one or more teeth to selectively engage with corresponding teeth on the ring 602. In some examples, the jaw structure 616 can include structures other than teeth to engage with the ring 602 including, for example, rubber blocks or stoppers, a material with a relatively high coefficient of friction, etc. The control lever 618 can be configured to both fix the positioning of the shuttle 604 relative to the ring 602 and to enable the shuttle 604 to move freely about the circumference of the ring 602. The control lever 618 can control the movement of the shuttle 604 about the ring 602, for example, by selectively engaging the teeth of the jaw structure 616 with the teeth on the ring 602.

In some examples, when the control lever 618 is in an upward, first position (FIGS. 26A-29), the shuttle 604 and thereby the brace 606 can be in a fixed position relative to the ring 602. In this way, the shuttle 604 and brace 606 can be positioned and fixed at any point along the circumference of the ring 602. Inversely, while the control lever 618 is in a second, downward position, the shuttle 604 and brace 606 can be in a "free rotation" state, meaning the shuttle and brace are free to rotate about the first axis of the wring structure 600 and circumference of the ring 602 (e.g., with the teeth of the jaw structure 616 spaced apart from the teeth of the ring 602).

The control lever 618 can also be configured to toggle between the first position and a third position such that the shuttle 604 can be quickly switched between a fixed state and a free rotation state. Specifically, the control lever 618 can be pulled upward from the first position and into the third position (e.g., toward the brace 606), to switch the shuttle 604 from a fixed state to a momentarily free rotation state until the control level 618 is returned to the first position. In this case, the control lever 618 can be spring loaded to automatically return the control lever 618 to the first position from the third position. The control lever 618 configured to toggle in this way can, for example, allow an individual user whose hand and wrist are secured to the brace 606 to switch between the fixed state and free rotation state by pulling up on the control lever 618 with one or more fingers extending past the frontward end of the brace 606.

As depicted in FIGS. 26A and 26B, the ring 602 can be coupled to a pair of upwardly extending arms of a bracket 620 (e.g., a U-shaped bracket). The ring 602 can be coupled to the bracket 620 via the openings 622 of the arms. Each opening 622 of the bracket 620 can, for example, include a bushing such that the ring 602 is configured to pivot relative to the bracket 620 in a fore-and-aft motion about an axis 609 extending through the openings 622. This fore-and-aft motion is indicated by directional arrows D7 (FIG. 26A). As such, the shuttle 604 and brace 606 are also configured to pivot backward and forward relative to bracket 620 as the ring 602 pivots about the axis extending through the openings 622. In this way, the ring 602, shuttle 604, and brace 606 can all be said to move or pivot about a second axis of the wrist-ring structure 600.

Still referring to FIGS. 26A-26B, the wrist-ring structure 600 can be coupled to the upper end of the third member 508 via the locking lever 582 (FIG. 26B). For example, the bracket 620 can be positioned within an opening of the third member 508 and the locking lever 582 can be configured to releasably couple the bracket 620 within the opening of the third member 508 (e.g., by transitioning the locking lever 582 between a locked position and an unlocked position). In the unlocked position, the bracket 620 (and therefore the wrist-ring structure 600) can translate axially relative to the axis 503 of the shaft 500 as well as rotate about the axis 503. In this way, the positioning of the wrist-ring structure 600 can also be adjustable relative to the shaft 500. The locking lever 582 can be configured to lock at least the axial position of the wrist-ring structure 600 relative to the shaft 500 in the locked position. For example, in the locked position, the bracket 620 (and therefore the wrist-ring structure 600) can rotate relative to the shaft 500 (e.g., about axis 503) in some instances as indicated by directional arrows D8 (FIG. 26A), but not translate relative to the shaft 500. In other examples, the bracket 620 is fixed relative to the shaft 500 in the locked position (e.g., cannot rotate or translate relative to the shaft 500).

Figure 30A:
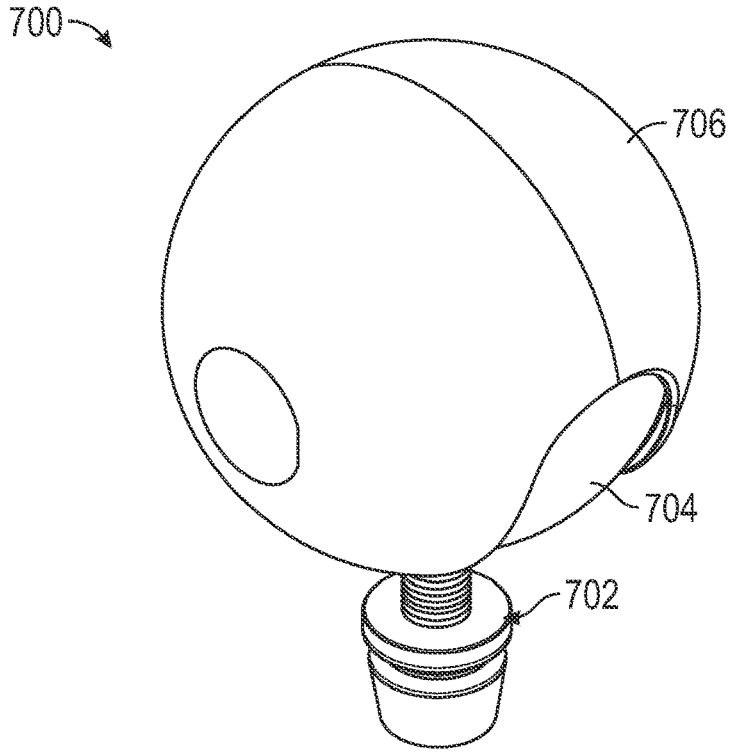
FIG. 30A is a perspective view of a ball structure that can be coupled to a shaft of a shoulder strengthening system.
Figure 30B:
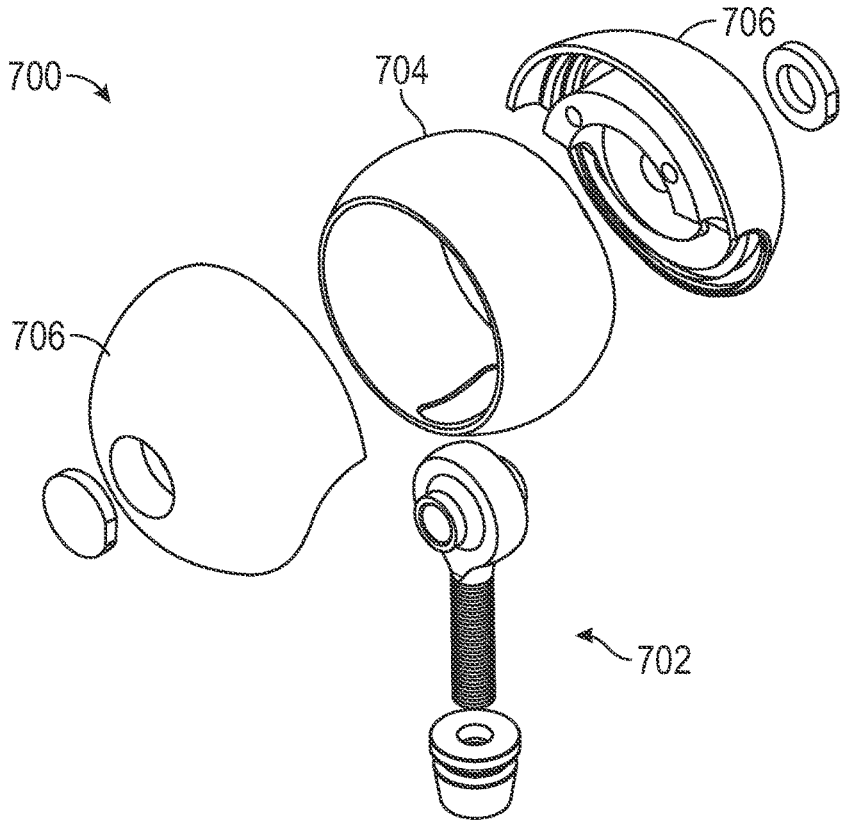
FIG. 30B is an exploded view of the ball structure of FIG. 30A.

Although the shaft 500 is described as being coupled to a wrist-ring structure (e.g., wrist-ring structure 600 or any wrist-ring structure described herein), it should be appreciated that, in some examples, the shafts described herein (e.g., shaft 500) can instead be coupled to a different member or structure, such as rotatable ball 700 (FIGS. 30A-30B), or another structure which is stationary relative to the shaft. As shown in FIGS. 30A-30B, the rotatable ball 700 includes a base 702 that can be coupled to the upper end of the third member 508 via the locking lever 582 (FIG. 26B). For example, the base 702 can be positioned within an opening of the third member 508 and the locking lever 582 can be configured to releasably couple the base 702 within the opening of the third member 508 (e.g., by transitioning the locking lever 582 between a locked position and an unlocked position). The ball 700 can also include an inner member 704 that is coupled to the base 702 and an outer member 706 that is coupled to the inner member 704. In some examples, as depicted, the outer member 706 can comprise multiple segments coupled together. The outer member 706 can be configured to rotate relative to the inner member 704. For example, a user can grip the outer member 706 of the ball 700 and rotate the outer member 706 relative to the inner member 704 as well as move a shaft to which the ball 700 is coupled (e.g., shaft 500), for example, to extend, retract, and/or angle the shaft.

Figure 31A:
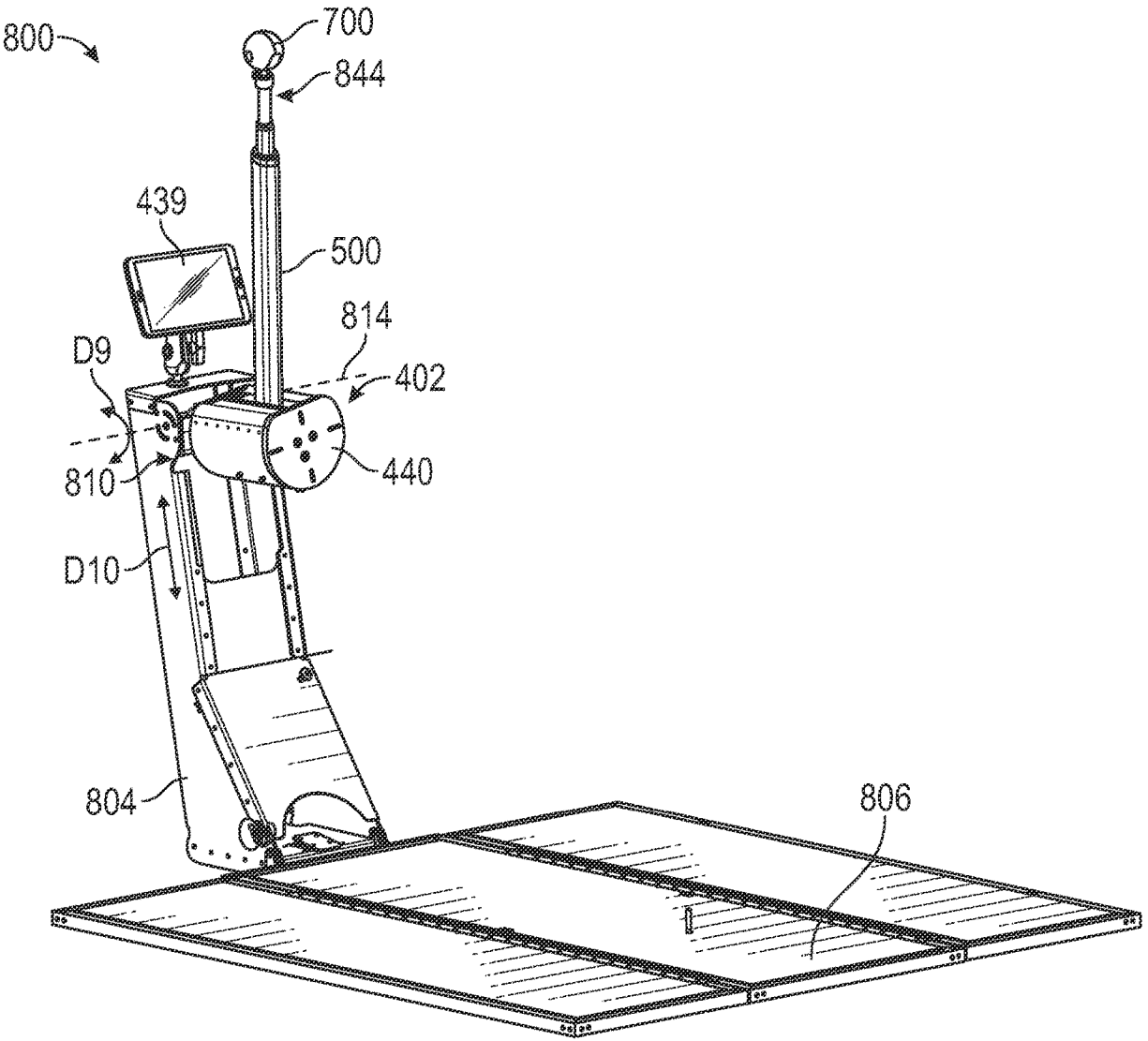
FIG. 31A is a perspective view of a shoulder strengthening system, according to one example, with a resistance system in a first position.
Figure 31B:
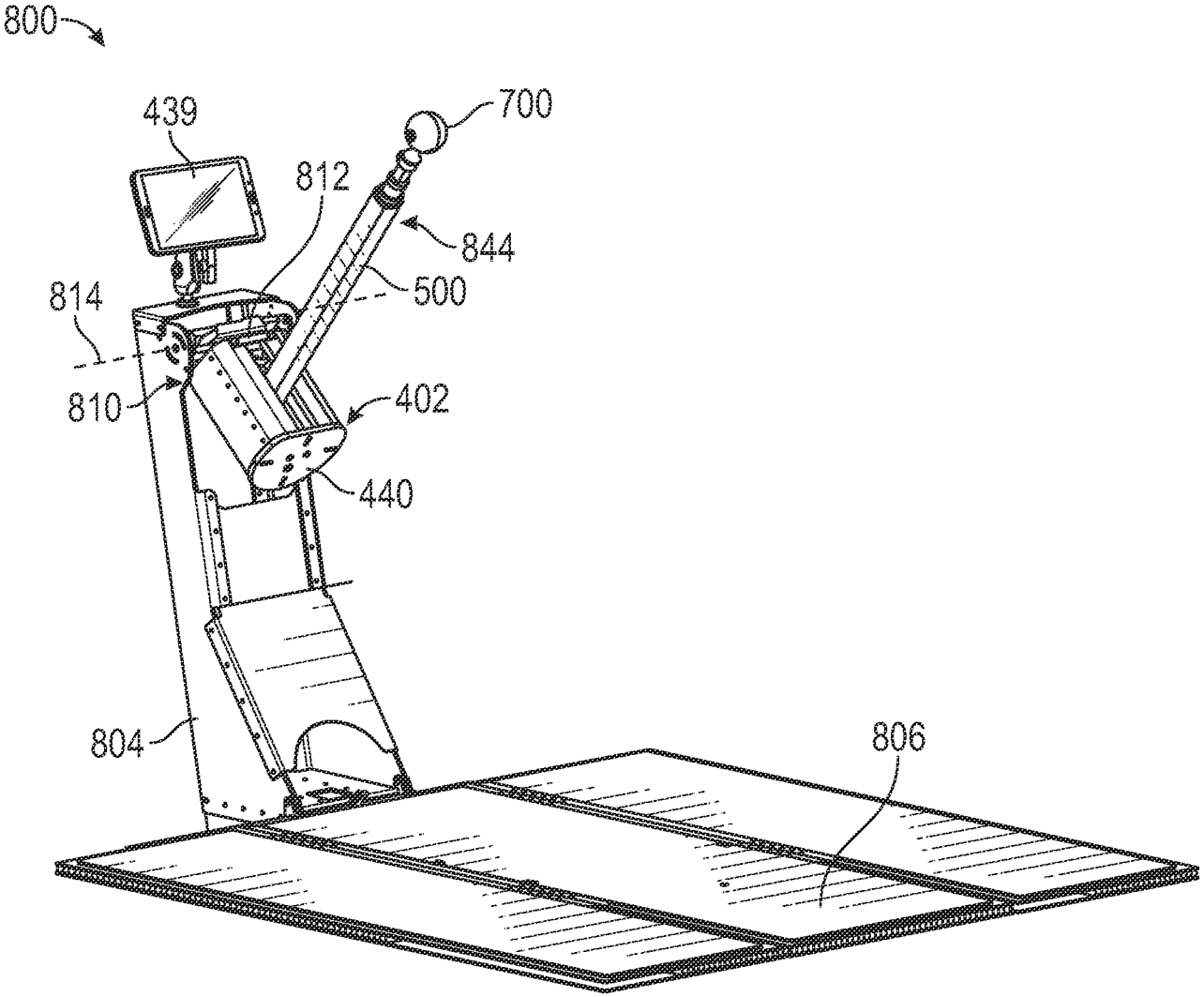
FIG. 31B is a perspective view of the shoulder strengthening system of FIG. 31A, with the resistance system in a second position.
Figure 32:
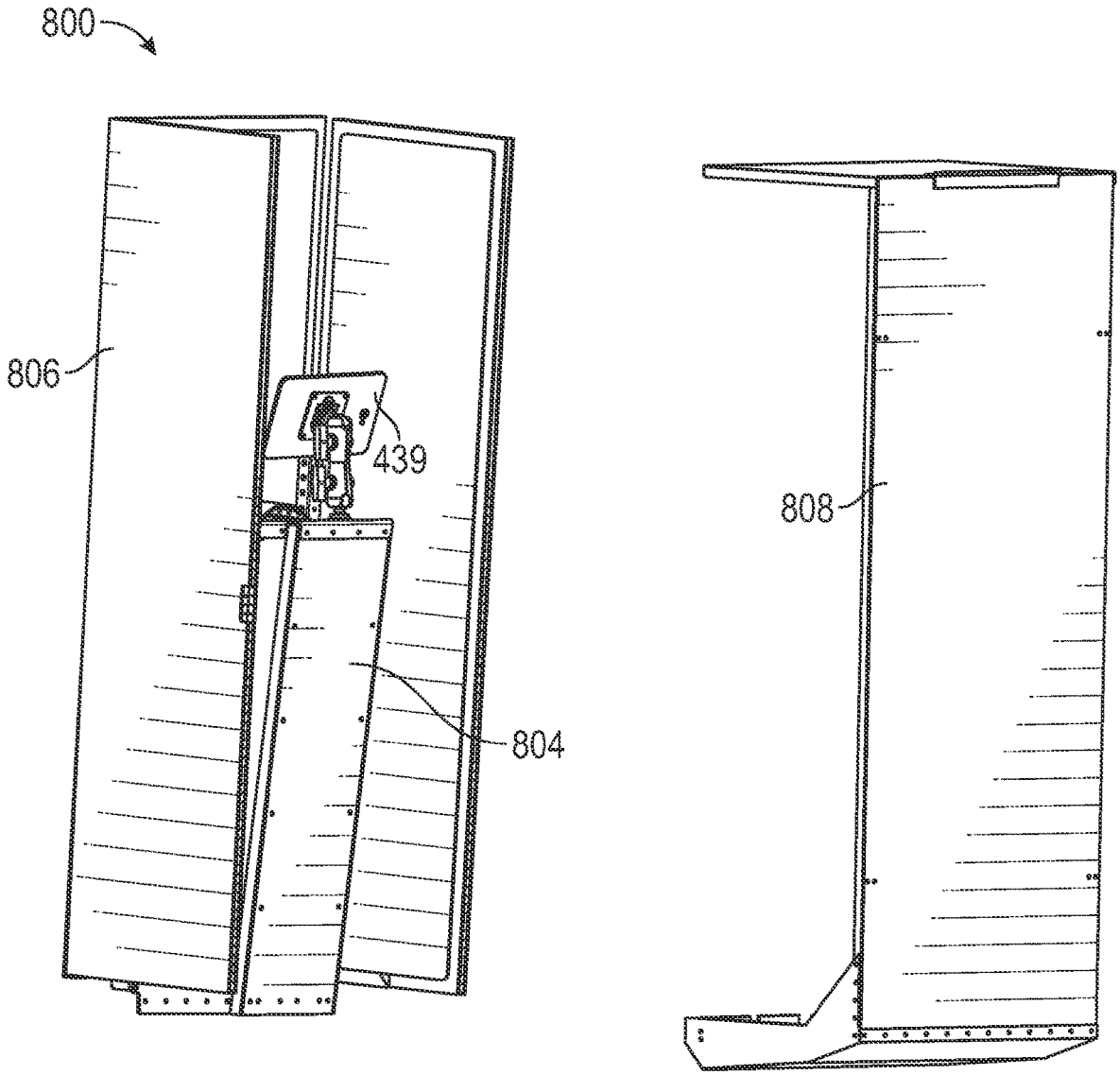
FIG. 32 is a perspective view of the shoulder strengthening system of FIG. 31A in a stowable configuration and a case for the shoulder strengthening system.

FIGS. 31A-32 depict a shoulder strengthening system 800 according to another example. As shown, the shoulder strengthening system 800 can include the resistance system 402, a frame 804, and a platform 806 movably coupled to the frame 804. In this example, the resistance system 402 includes the outer housing 440, the joint assembly 442 (FIGS. 15-17) and the resistance mechanism 448 (FIGS. 15-17) disposed within the housing 440. Instead of shaft assembly 444, the resistance system 402 of the illustrated example includes shaft assembly 844 coupled to the joint assembly 442. In some examples, as depicted, the shaft assembly 844 includes the shaft 500 and the ball 700 coupled to the shaft 500. As shown in FIGS. 31A-32, the shoulder strengthening system 800 also includes the computer interface 439 coupled to the frame 804 (e.g., by an adjustable arm).

The platform 806 can be pivotably coupled (e.g., hinged) to the frame 804 such that the platform 806 can be moved between a stowable state (FIG. 32) and an operational state (FIGS. 31A-31B). The platform 806 can also be segmented into multiple, foldable segments (e.g., three segments shown in FIGS. 31A-31B), such that the platform 806 can fold around the frame 804 in the stowable state (FIG. 32). In some examples, the shoulder strengthening system 800 can also include a case 808 configured to encase as least a portion of the shoulder strengthening system 800 in the stowable state.

As shown in FIG. 32, while in the stowable state, the platform 806 can be positioned in a "vertical" or longitudinal orientation such that the shoulder strengthening system 800 has a relatively low profile and decreased footprint for stowing or packing the system 800. The shoulder strengthening system 800 can, for example, be packed and stowed in the case 808 for storage or transport when in the stowable state. The total depth of the shoulder strengthening system 800 while in the stowable state can also be relatively equal or nearly equal to the depth of the frame 804 and/or the other components described herein. In some examples, the platform 806, the frame 804, and/or the case 808 can include one or more wheels and/or handles such that the shoulder strengthening system 800 can be readily moved from one location to another. A locking assembly can be included and used to lock in and move the platform 806 between the stowable and operational states.

Referring to FIGS. 31A-31B, when in the operational state, the platform 806 can be positioned in a "horizontal" orientation, i.e., parallel to the ground surface, to provide users a place to stand and position themselves while interacting with the resistance system 402. In some examples, the weight of the user atop the platform 806 can be suitable to provide stability and anchor the shoulder strengthening system 800 to the ground surface while the user is interacting with the resistance system 402. In such examples, the overall weight of the shoulder strengthening system 800 can be reduced, such as to optimize the weight of the system for stowing and packing, while taking advantage of users' weight to anchor the strengthening system 800 to the ground surface. In other examples, the weight of the platform 806 and/or surface area of the platform 806 in contact with the ground can itself be suitable to stabilize and anchor the shoulder strengthening system 800. Other components such as ties, fasteners, or weights can also be included and used to secure the strengthening system 800 to the ground surface.

Although described as including a movable platform 806, in some examples, the platform 806 need not be coupled to the frame or movable. For instance, the platform 806 can be secured to the ground surface separately of the frame 804 and/or immovably coupled to the frame 804 during setup of the strengthening system 800. In other examples, the platform 806 need not be included and the frame 804 can be secured to the local ground surface and/or be sized and weighted to stabilize and anchor the shoulder strengthening system 800.

As shown in FIG. 31A-31B, the frame 804 can include an adjustment mechanism 810 that is coupled to the resistance system 402. Specifically, the adjustment mechanism 810 can include a bracket 812 that is coupled to the base 428 of the joint assembly 442 (see FIGS. 16-17). The adjustment mechanism 810 can be configured to pivot the resistance system 402 relative to the frame 804 (as indicated by directional arrows D9 (FIG. 31A)) and/or adjust a height of the resistance system 402 relative to the platform 806 (as indicated by directional arrows D10 (FIG. 31A)). For instance, the bracket 812 can move axially along a height of the frame 804. As such, the height or vertical positioning of the resistance system 402 relative to the frame 804 and platform 806 can be adjusted by moving the bracket 812 and resistance system 402 in an axial "upward" direction away from the platform 806 and in an axial "downward" direction toward the platform 806.

The bracket 812 can enable the resistance system 402 to be angled relative to the frame 804, for example, pivoted about axis 814. As shown in FIG. 31A, the resistance system 402 is positioned in a first angled position relative to the frame 804 (e.g., approximately 90 degrees). FIG. 31B illustrates the resistance system 402 in a second angled position relative to the frame 804 (e.g., approximately 30 degrees). In some examples, a locking mechanism can be coupled to the bracket 812, such that the resistance system 402 can be locked into position relative to the frame 804 at various angles. For example, the bracket 812 can be hinged to the frame 804 and configured to incrementally adjust within a range of angles between the frame 804 and the resistance system 402 (e.g., between 0 degrees and 180 degrees, 0-90 degrees, 30-90 degrees, etc.).

Configured in this way, any shaft or shaft assembly (e.g., shaft assembly 844) of a resistance system (e.g., resistance system 402) that is coupled to the frame 804 is able to translate relative to an axis of the frame 804 (along D10) as well as rotate relative to the frame 804 about three axes, specifically first axis 449 (FIGS. 16-17), second axis 451 (FIGS. 16-17), and third axis 814. The third axis 814 is formed by the hinged or other suitable connection between the bracket 812 and the frame 804. This third axis 814 can be used to position the resistance system 402 at a sloped, downward angle suitable for particular arm and shoulder movements. A user, for instance, can position themselves in a standing position on the platform 806, with their back and/or side directed toward the frame 804. In this position, the user can securely grasp the ball 700 (or a wrist-ring structure coupled to the shaft 500) and engage in overhand, sidearm, and/or underhand pitching motions. This configuration is desirable, for example, for diagnosing the extent of a pitcher's shoulder injury and/or monitoring the health of the pitcher's shoulder through movement which reproduces a natural pitching motion. The same or similar orientations of the resistance system 402 can be used for other athletic and/or occupational movements.

FIGS. 33-40 illustrate another example of a shaft 900 that can be used in any of the shoulder strengthening apparatuses described herein (e.g., included in any resistance system 102, 302, 402, etc. described herein). The shaft 900 is generally similar to shaft 500, although the shaft 900 includes a telescoping system 920 that includes some additional and/or alternative components to telescoping system 520. It should be appreciated that one or more components of telescoping system 920 (e.g., the additional and/or alternative components) can be included in telescoping system 520.

Figure 33:
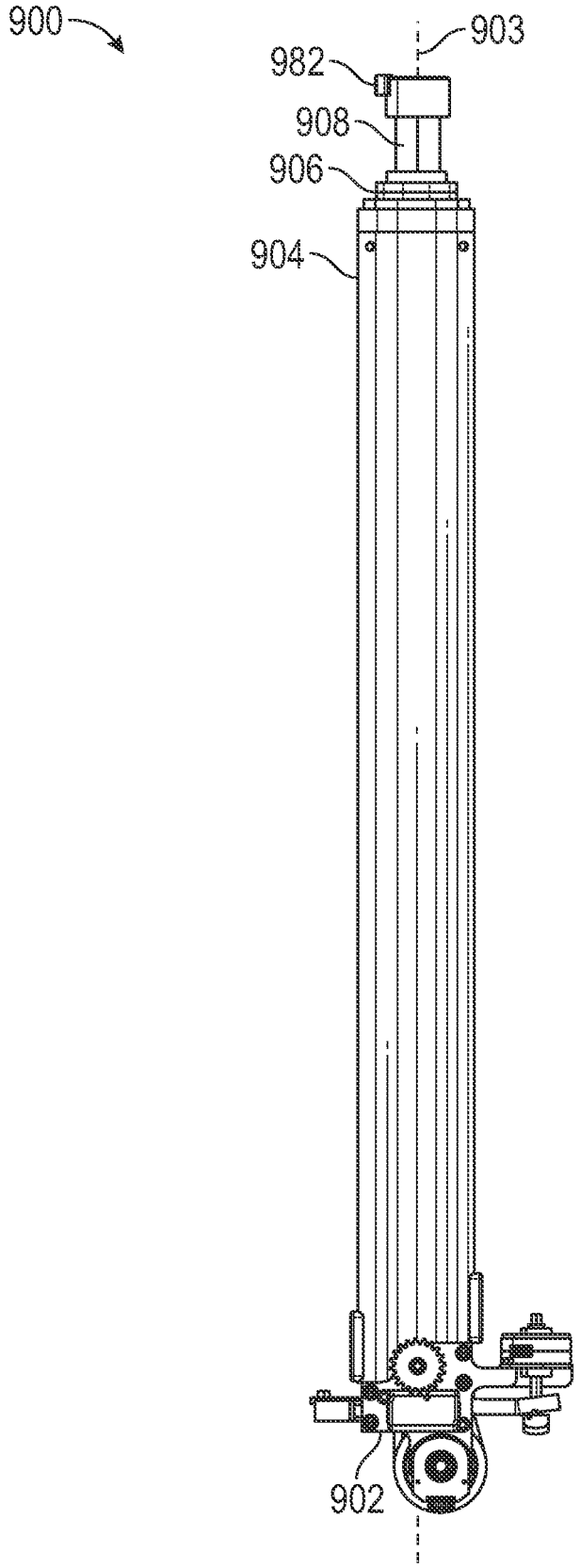
FIG. 33 is a side view of a shaft for a shoulder strengthening system, according to one example.
Figure 35:
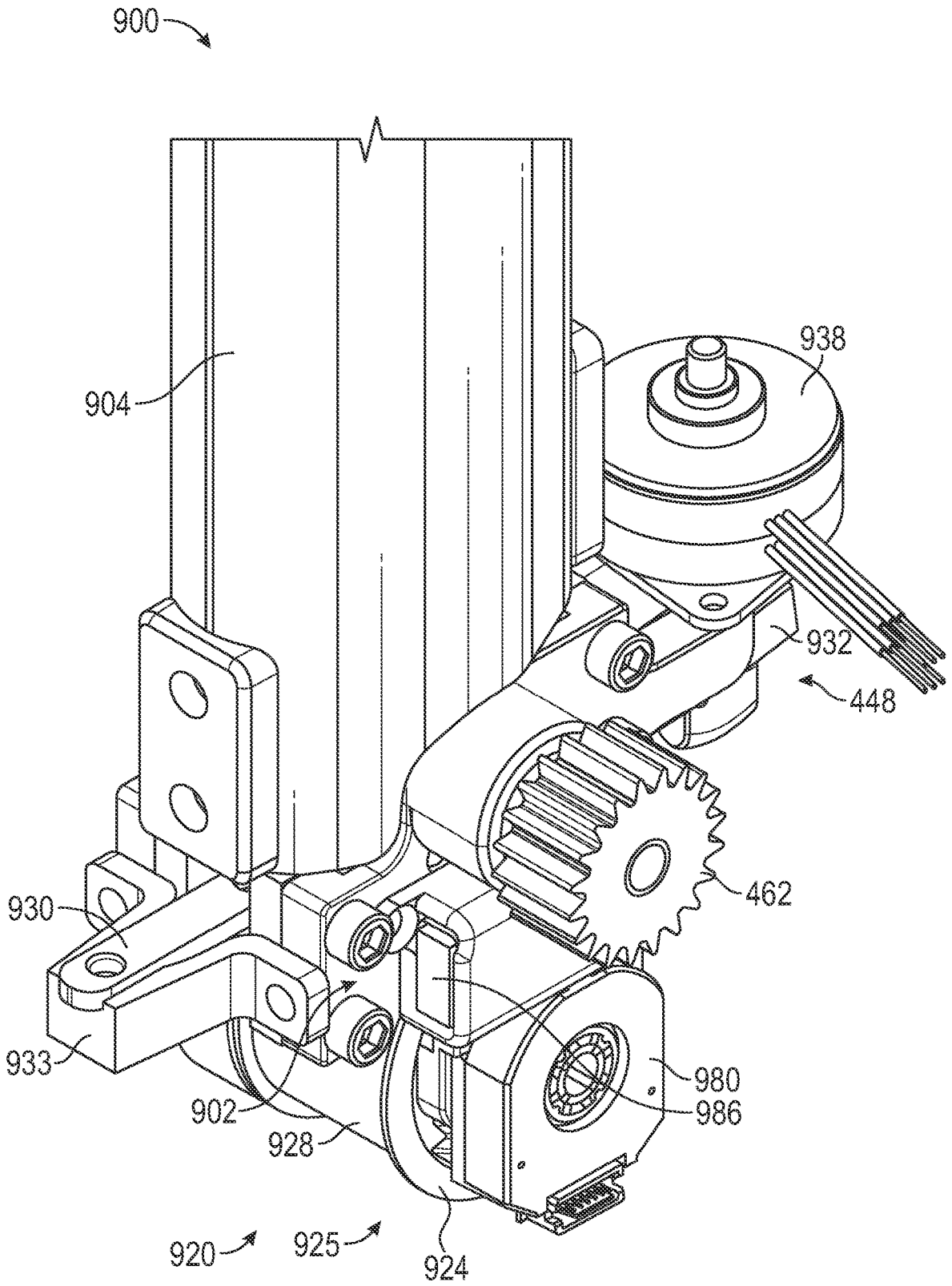
FIG. 35 is a perspective view of a proximal end portion of the shaft of FIG. 33.

The shaft 900 includes a base portion 902, a first member 904 (or "outer member") that is coupled to the base portion 902, a second member 906 (or "middle member") disposed radially within the first member 904, and a third member 908 (or "inner member") disposed radially within the second member 906 and the first member 904. Although three members (e.g., first member 904, second member 906, third member 908) are shown in the illustrated example, in some examples, the shaft 900 can comprise a different number of members (e.g., 2, 4, etc.). As shown in FIGS. 33 and 35, a proximal end of the first member 904 can be coupled to the base portion 902 with fasteners (e.g., fasteners 510, etc.), such that the first member 904 is fixed to the base portion 902 (e.g., cannot move axially along axis 903 relative to the base portion 902). In other instances, the base portion 902 and the first member 904 can be formed as a single, unitary piece. The base portion 902 can be coupled to a joint assembly (e.g., joint assembly 442) similar to base portion 502, as described above. For example, the second pinion 462 can be coupled to the base portion 902 (FIG. 35).

Figure 34:
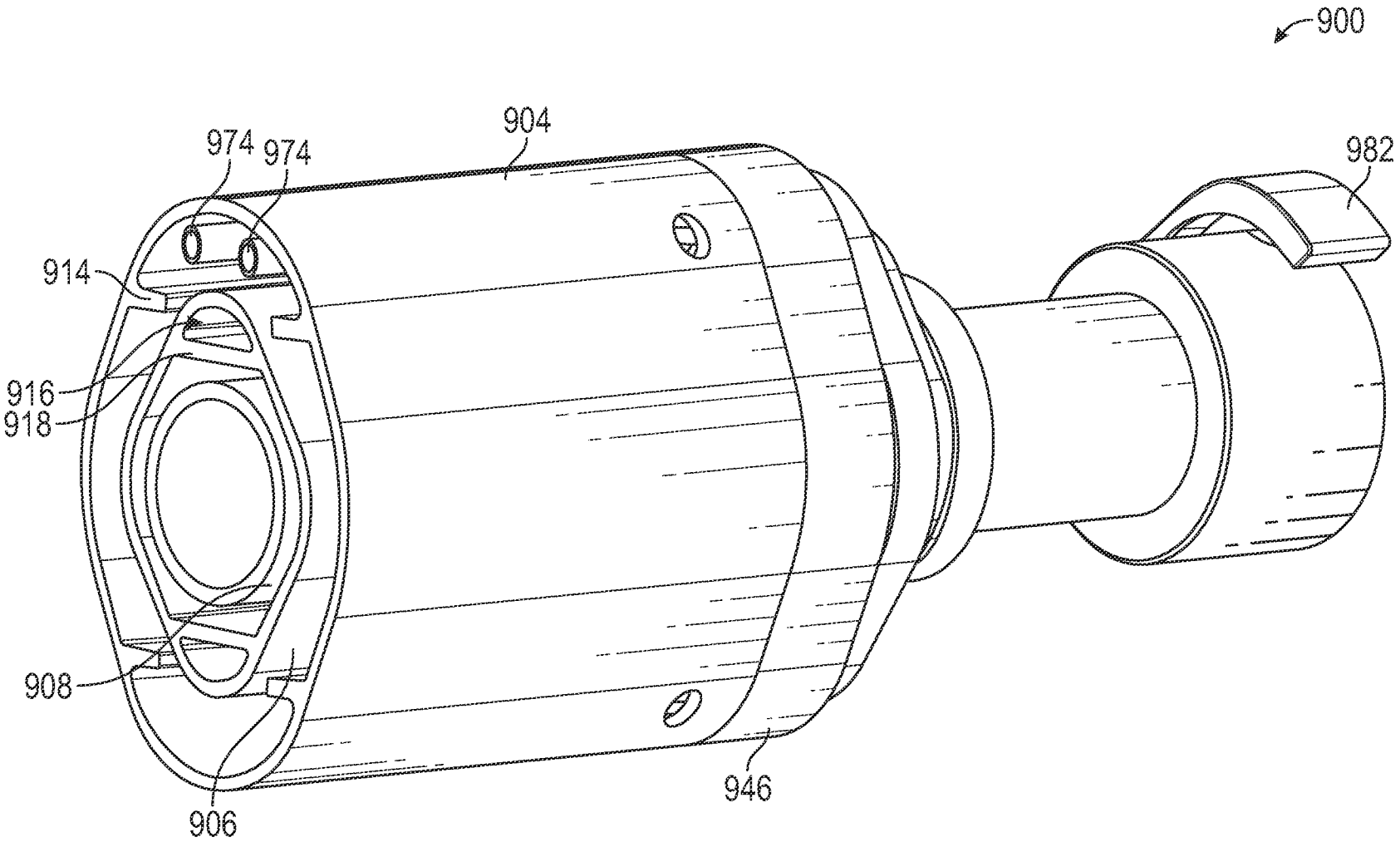
FIG. 34 is a cross-sectional view of a distal end portion of the shaft of FIG. 33.

FIG. 34 is a cross-sectional view of a distal end portion of the shaft 900. In some examples, as shown, the outer member 904 has a diamond shape cross-section having rounded apices and includes inner flanges 914 extending along a length of the outer member 904. The middle member 906 also has a diamond shape cross-section and includes inner walls 916 adjacent to two, opposite apices that define apex channels 918 extending along a length of the middle member 906. In some instances, the inner flanges 914 can serve as guides for the middle member 906, for example, to maintain alignment of the members as the middle member 906 and the inner member 908 move axially relative to the outer member 904. The inner member 908, in the illustrated example, has a circular cross-section and is disposed radially between the apex channels 918. In other examples, the members 904, 906, 908 can have different cross-sections, for example, all or a subset of the members can have circular cross-sections.

Figure 36:
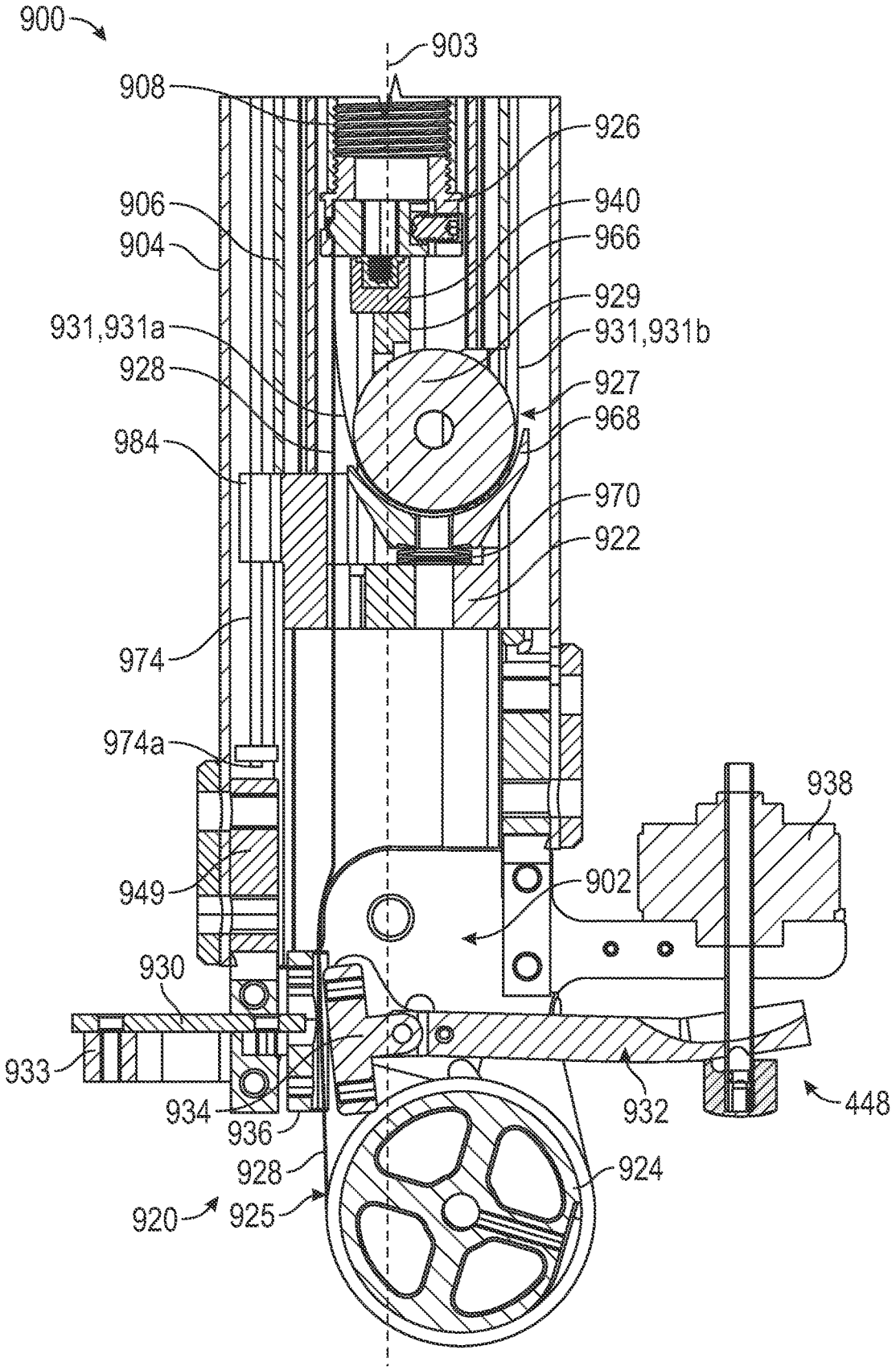
FIG. 36 is a cross-sectional view of the proximal end portion of the shaft of FIG. 33.

FIG. 35 illustrates the base portion 902 as coupled to the first member 904. FIG. 36 illustrates a cross-sectional view of the shaft 900 and depicts the connection between the base portion 902 and the members 904, 906, 908. As shown in FIG. 36, the first, second, and third members 904, 906, 908 can be coupled together and/or to the base portion 902 by a telescoping system 920 (also referred to herein as a linked system). The telescoping system 920 enables the third member 908 to translate relative to the base portion 902 and the first member 904, as well as relative to the second member 906, along the longitudinal axis 903. As described in more detail below, the first member 904 is fixed relative to the base portion 902, such that the first member 904 does not move relative to the base portion 902 (e.g., the two move together, etc.). The second and third members 906, 908 can each translate relative to the first member 904 at different rates, as described below.

The proximal ends of the second member 906 and the third member 908 can include proximal end caps configured to engage with the telescoping system 920. Specifically, the second member 906 can include a shuttle 922 coupled to the proximal end of the second member 906 and the third member 908 can include a clamp 926 coupled to the proximal end of the third member 908.

The telescoping system 920 can include a first pulley 925 coupled between the base portion 902 and the third member 908. The first pulley 925 couples the base portion 902 to the third member 908, such that the third member 908 can extend and retract relative to the base portion 902. The first pulley 925 can include a barrel 924 coupled to the base portion 902 and a belt 928 (e.g., tape, cable, rope, etc.) coupled to the barrel 924 and the clamp 926. The belt 928 can be wound about the barrel 924, such that a portion of the belt 928 is disposed on the barrel 924. The remaining portion of the belt 928 extends in an axial direction, parallel to the longitudinal axis 903. Specifically, the belt 928 can extend from the barrel 924 through the shuttle 922 towards the third member 908. An end of the belt 928 is fixedly coupled to the proximal end of the third member 908 by the clamp 926. While illustrated as coupled to the base portion 902, in other examples, the barrel 924 can be coupled to other relatively fixed members of the shaft 900, such as the first member 904.

The telescoping system 920 can also include a second pulley 927 linking the first, second, and third members 904, 906, 908. Specifically, the second pulley 927 can be configured to link movement of the third member 904 with movement of the second member 906, such that movement of the third member 904 results in movement of the second member 906 (e.g., at different rates, etc.). The second pulley 927 can include one or more rollers 929 (one shown in FIGS. 36-38) and a pulley belt 931 (e.g., tape, cable, rope, etc.) disposed at least partially about the roller 929. The roller 929 is coupled to the second member 906, and in some examples, as depicted, to the shuttle 922 of the second member 906. In some examples, as shown, the roller 929 can be disposed on a base 968 that is coupled to the shuttle 922, for example, with a spring 970. The base 968 is configured to hold the roller 929 such that the roller 929 can rotate relative to the base 968. The pulley belt 931 can have one end coupled (e.g., fixed) to the first member 904 (e.g., to a distal end cap 946 coupled to the first member 504 (FIG. 40)) and the other end of the pulley belt can be coupled to the third member 908 (e.g., to the clamp 926). In this way, the first, second, and third members 904, 906, 908 are linked together by the second pulley 927.

As the third member 908 translates distally relative to the base portion 902 (e.g., away from the base portion 902), the belt 928 unwinds from the barrel 924, such that a longer portion of the belt 928 is extended between the clamp 926 and the base portion 902. Similarly, as the third member 908 translates proximally relative to the base portion 902 (e.g., towards the base portion 902), the belt 928 winds around the barrel 924, such that a shorter portion of the belt 928 is extended between the clamp 926 and the base portion 902. In this way, the telescoping system 920 couples the third member 908 to the base portion 902, such that the third member 908 is permitted to translate relative to the base portion 902 (as well as the first member 904 and the second member 906), along the longitudinal axis 903.

As the third member 908 translates distally relative to the base portion 902 (e.g., away from the base portion 902), the second pulley 927 causes the second member 906 to also translate distally. Specifically, the pulley belt 931 has a first portion 931*a* extending between the roller 929 and the clamp 926 of the third member 908 and a second portion 931*b* extending between the roller 929 and the distal end cap 946 of the first member 904. As the third member 908 pulls (e.g., translates) the first portion 931*a* distally, the roller 929 rotates in a first direction (e.g., clockwise, etc.) and at least some of the second portion 931*b* of the pulley belt 931 moves along the roller 929. This increases the length of the first portion 931*a* and decreases the length of the second portion 931*b*, such that the distance between the distal end cap 946 and the second pulley 927 is decreased. In this way, the second pulley 927 (and therefore the second member 906) moves distally and away from the base portion 902. In some examples, the surface of the roller 929 and/or the surface of the base 968 can be configured to prevent the pulley belt 931 from slipping relative to the roller 929 as the second pulley 927 operates, for example, by including a felt surface.

Similarly, as the third member 908 translates proximally relative to the base portion 902 (e.g., towards the base portion 902), the second pulley 927 causes the second member 906 to also translate proximally. Specifically, as the third member 908 pushes (e.g., translates) the first portion 931*a* proximally, the roller 929 rotates in a second direction (e.g., counter-clockwise, etc.) and at least some of the first portion 931*a* moves along the roller 929. This decreases the length of the first portion 931*a* and increases the length of the second portion 931*b*, such that the distance between the distal end cap 946 and the second pulley 927 is increased. In this way, the second pulley 927 (and therefore the second member 906) moves proximally and towards the base portion 902.

In some examples, as shown, translation of the second and third members 906, 908 can occur at different rates. For example, translation of the third member 908 can be twice as far as the corresponding translation of the second member 906 based on the configuration of the second pulley 927. In this way, the telescoping system 920 links the second member 906 to the third member 908, such that the third member 908 and the second member 906 both translate along the longitudinal axis 903 at different (e.g., proportional) rates.

The telescoping system 920 can be configured to enable extension and retraction of the shaft 900 in a manner that can feel "weightless" (or less weighty) to a user operating the shaft 900. For example, the first pulley 925 and the second pulley 927 can be configured to exert zero force or nominal forces resisting the extension and retraction of the shaft 900. In other words, the force a user must exert to extend the shaft 900 to an extended configuration can be the same as the force a user must exert to retract the shaft 900 to a retracted or collapsed configuration. In some examples, the telescoping system 920 can include one or more pulleys to counteract the force of gravity (e.g., counteract the weight of various components of the system, such as the second and third members 906, 908 and their respective end caps 922, 926, etc.).

Figure 40:
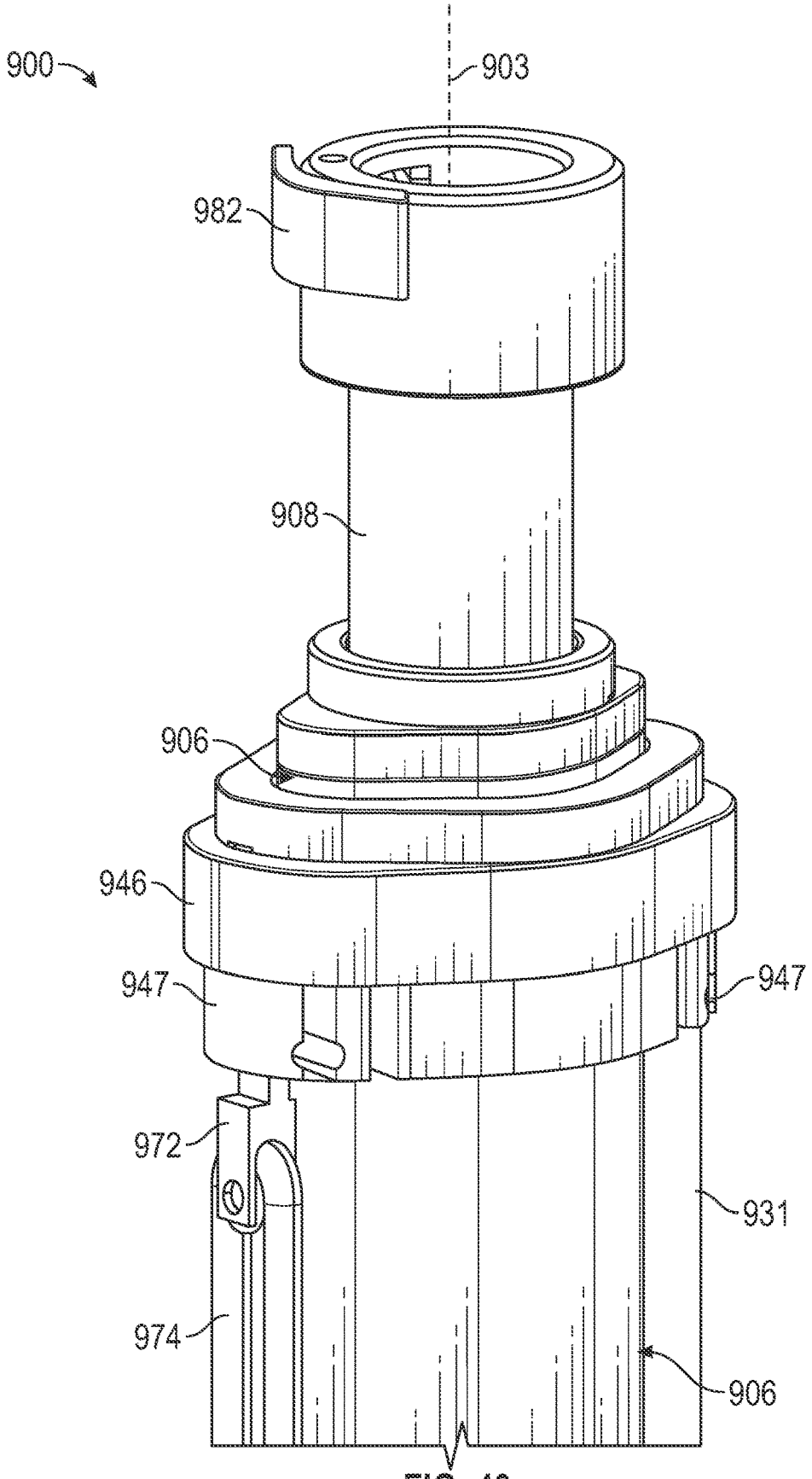
FIG. 40 is a perspective view of the distal end portion of the shaft of FIG. 33 with an outer member of the shaft removed for illustration purposes.

For example, the telescoping system 920 can include a third pulley 972 (FIG. 40) and a belt or cord 974 coupled to the third pulley 972. The third pulley 972 can be coupled to the distal end cap 946 of the first member 904 (FIG. 40). The cord 974 can extend between a fixed portion of the shaft 900 (e.g., the base portion 902), the third pulley 972, and a translatable portion of the shaft 900 (e.g., the second member 906). Specifically, the cord 974 has a first end portion 974*a* coupled to an extension 949 of the base portion 902 and a second end portion 974*b* coupled to the shuttle 922 of the second member 906. The cord 974 can be tensioned to counteract the force of gravity acting upon the translatable portions of the shaft 900 (e.g., second member 906, third member 908, etc.). In this way, the third pulley 972 and the cord 974 of the telescoping system 920 create a "weightless" sensation for the user, such that the translatable portions of the shaft 900 can feel "weightless" or "floating" as the user extends and/or retracts the shaft 900.

In some examples, a torsion spring can be coupled to the first pulley 925 (e.g., coupled to the barrel 924 and/or the belt 928) and/or the first pulley 925 can include a torsion spring. In some examples, the torsion spring can be configured such that unwinding of the belt 928 from the barrel 924 can cause the torsion spring to exert enough of a force to wind the belt 928 around the barrel 924 when the user translates the third member 908 axially towards the base portion 902. For example, the force can be relatively small such that the torsion spring does not retract the shaft 900 from an extended position towards a retracted position. In other words, the torsion spring does not assist the user in retracting the shaft 900 or translating the third member 908 axially relative to the first and second members 904, 906. Rather, the torsion spring can be included to ensure the belt 928 properly winds around the barrel 924. As such, the first pulley 925 can also be referred to as a spring or a bilateral spring.

Similar to shaft 500, the shaft 900 can apply a resistance to the telescoping system 920 using a pair of arms 930, 932. For example, the arms 930, 932 configured to function as a brake for the telescoping system 920. In some examples, as shown, the arms 930, 932 can function as a brake for the bilateral first pulley 925, by clamping around the belt 928. The arms 930, 932 can be coupled to the base portion 902 as shown in FIG. 36. Specifically, the belt 928 is disposed between a receiver 934 of the arm 930 (or "receiver arm 930") and a pusher 936 of the arm 932 (or "pusher arm 932"). In some examples, as shown in FIG. 36, the receiver 934 is positioned at an end of the receiver arm 930 and has a concave surface. The pusher 936 is positioned at an end of the pusher arm 932 and has a corresponding convex surface, in some examples. The receiver 934 and the pusher 936 can be covered with a material or fabric, such as felt or leather. In some examples, the receiver 934 can be covered with leather and the pusher 936 can be covered with felt. As shown, the arms 930, 932 are generally perpendicular to the belt 928. The pusher arm 932 is operatively coupled to a motor 938 that is configured to move the pusher arm 932 towards the receiver arm 930, such that the pusher 936 compresses against the receiver 934, with the belt 928 sandwiched therebetween. In this way, the pusher 936 can selectively apply a resistive, frictional force to the belt 928 to prevent movement of the belt 928 relative to the arms 930, 932. In some examples, a force sensor 933 (e.g., a load cell) can be coupled to one of the arms (e.g., receiver arm 930) and configured to measure the force applied to the belt 928 (FIGS. 35-36). In some examples, the arms 930, 932 and the motor 938 are part of the resistance mechanism 448.

In some examples, the force sensor 933 and/or the motor 938 can be operatively coupled to a computer interface (e.g., computer interface 439), such that a user can control and/or monitor the resistive load applied to the belt 928 by the motor 938 and the arms 930, 932 via the computer interface, similar to shaft 500.

Figure 37:
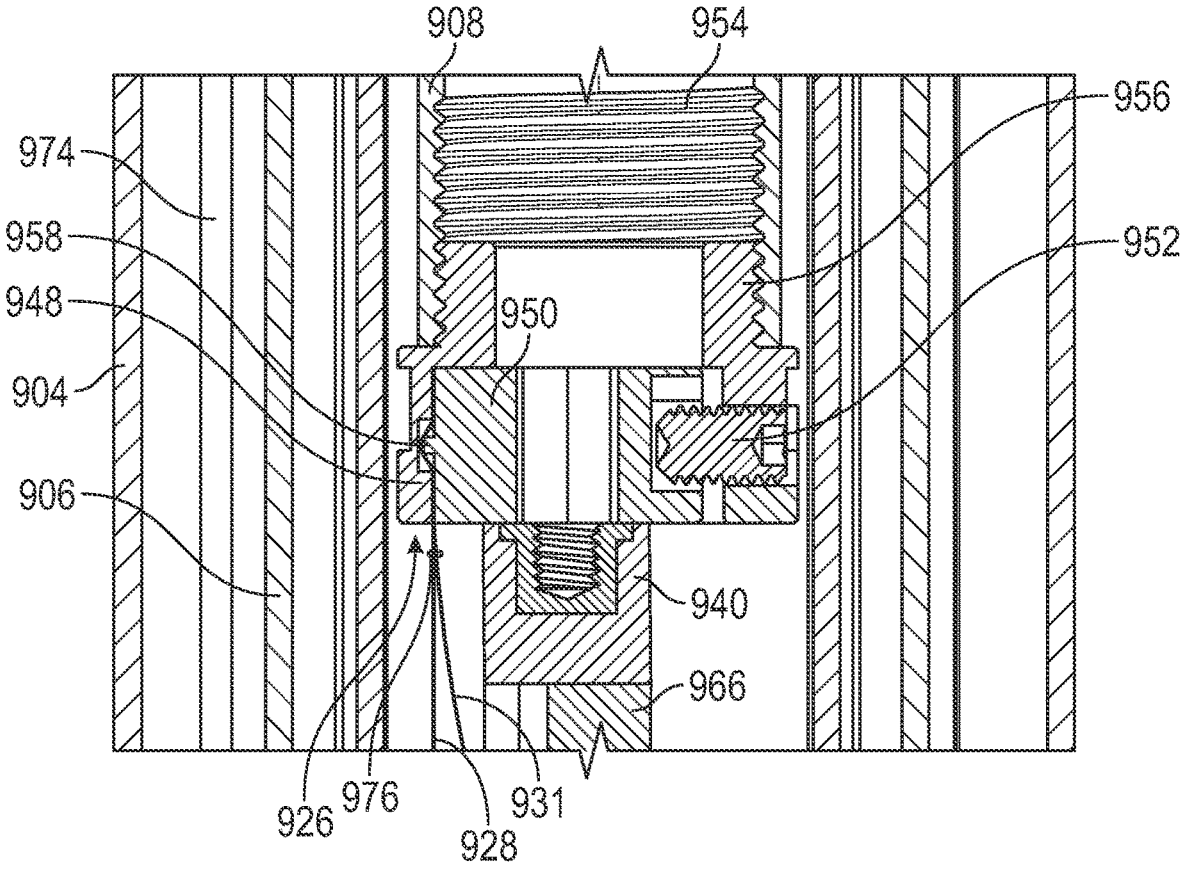
FIG. 37 is a cross-sectional view of the shaft of FIG. 33 showing additional details of a proximal end of an inner member of the shaft.
Figure 38:
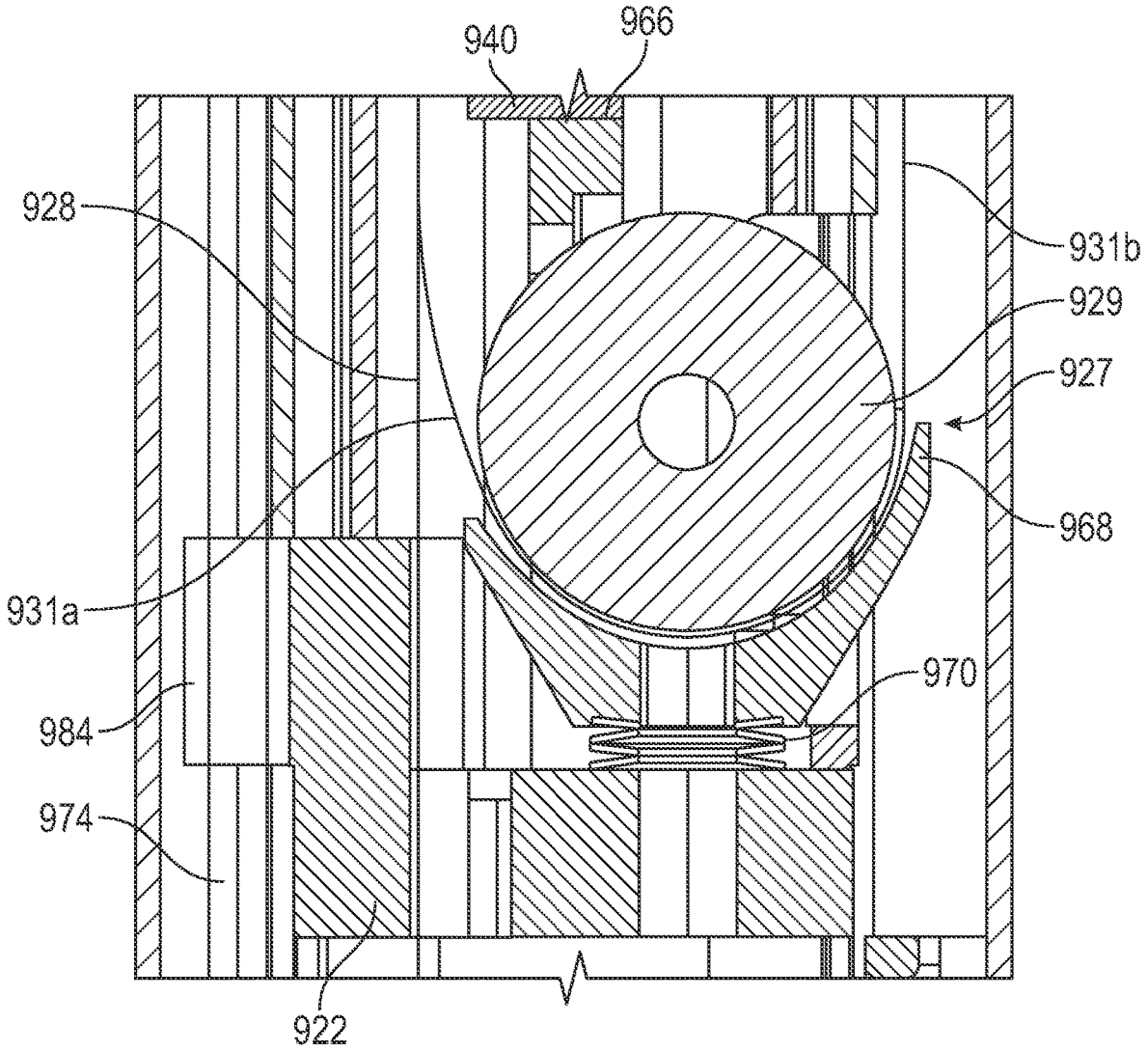
FIG. 38 is a cross-sectional view of the shaft of FIG. 33 showing additional details of a proximal end of a middle member of the shaft.

The telescoping system 920 can also include one or more dampers, shock absorbers, or the like. As shown in FIGS. 36-38, the third member 908 can include a damper 940 (e.g., a rubber block, a spring, etc.) configured to improve the fluidity with which the telescoping shaft 900 retracts. Specifically, the damper 940 is coupled to a proximal surface of the clamp 926. The damper 940 is configured to compress against an inner surface of the second member 906 or an inner surface coupled to the second member 906, for example, against an inner, distal surface 966 of the shuttle 922, as shown in FIGS. 36-38. The damper 940 can compress against the distal surface 966 of the shuttle 922 when the third member 908 is translated proximally relative to the second member 906 (e.g., to a fully retracted configuration of the shaft 900). For example, when a user retracts the third member 908, the third member 908 can translate axially until the damper 940 compresses against the distal surface 966 of the shuttle 922.

It should be appreciated that the shaft 900 can include one or more dampers (e.g., damper 940) that can be configured to compress against surfaces of the shaft 900 other than the distal surface 966 of the shuttle 922. For example, in some instances, the shaft 900 can include distal dampers (e.g., similar to distal springs 540*d*, 544*d*) that can be configured to limit the translation of the members of the shaft 900 in the distal direction.

FIG. 37 illustrates the proximal end of the third member 908, and specifically, the clamp 926, in greater detail. The clamp 926 includes an outer member 948, an inner member 950, and a locking component 952 (e.g., a set screw, etc.) configured to retain a positioning of the inner member 950 relative to the outer member 948. As shown, the clamp 926 is coupled to the distal end of the third member 908 via a threaded connection. In some examples, as shown, an inner surface of the third member 908 includes internal threads 954 configured to receive external threads 956 disposed on an outer surface of the clamp 926, for example, on an outer surface of the outer member 948. In some examples, as shown, the damper 940 can be coupled to a proximal face of the inner member 950.

As introduced above, an end of the belt 928 and an end of the pulley belt 931 are coupled to the clamp 526 and fixedly retained therein. For example, as shown in FIG. 37, the belt 928 and the pulley belt 931 are compressed between the outer member 948 and a flange 958 of the inner member 950. The locking component 952 can maintain the compression between the flange 958 and the outer member 948 to sandwich the belt 928 therebetween. In some examples, as depicted, a fastener 976 (e.g., a clamp, etc.) can be used to couple the ends of the belt 928 and the pulley belt 931 together (e.g., proximal to the clamp 926, etc.).

Figure 39:
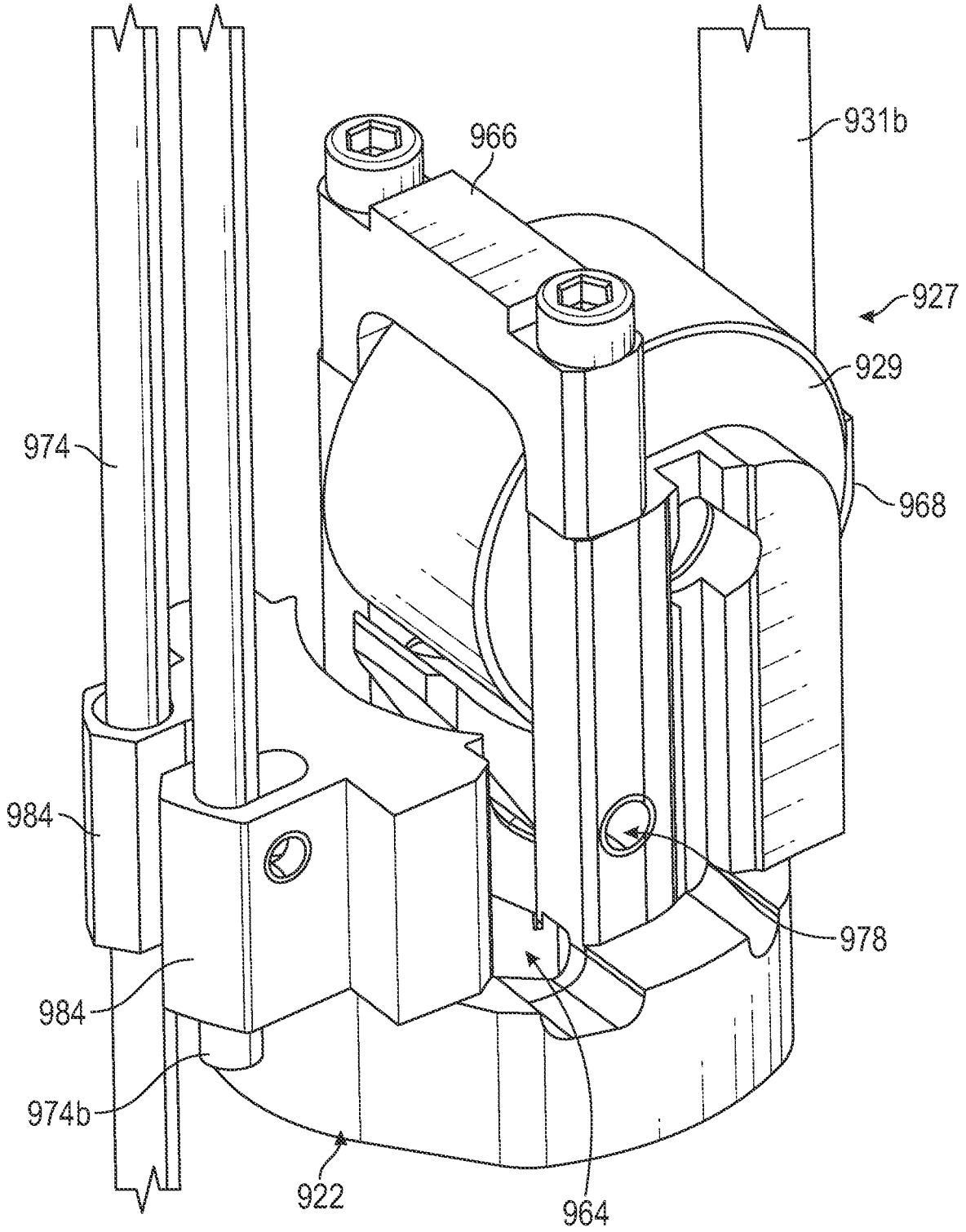
FIG. 39 is a perspective view of a shuttle coupled to the proximal end of the middle member of the shaft of FIG. 33.

As introduced above, the proximal end of the second member 906 is coupled to the shuttle 922. Specifically, as shown in FIGS. 38-39, the second member 906 can be coupled to the shuttle 922, for example, using fasteners such as screws, bolts, or the like. For example, a fastener can be coupled through an opening 978 of the shuttle 922 and a corresponding opening of the second member 906. The shuttle 922 can also include an opening or passageway 964 through which the belt 928 extends. As described above, in some examples, the damper 940 coupled to the third member 908 can compress against the distal surface 966 as the third member 908 is retracted relative to the base portion 902. As shown, the distal surface 966 is formed on a bridge portion of the shuttle 522 that extends partially around (e.g., over) the second pulley 927.

In some examples, as shown, the cord 974 is coupled to one side of the shuttle 922, and the second pulley 927 is coupled to the opposite side of the shuttle 922. Specifically, the cord 974 extends through two flanges 984 extending from the shuttle 922. Each flange 984 includes an opening through which the cord 974 extends. As shown in FIG. 39, the end portion 974*b* of the cord 974 can be coupled to the flange 984 of the shuttle 922. In FIG. 39, the first portion 931*a* of the pulley belt 931 is not shown for purposes of illustration. As described above, the base 968 of the second pulley 927 can be coupled to the shuttle 922 with the spring 970. In other examples, the cord 974 and the second pulley 927 can be coupled to the shuttle 922 in other manners.

FIG. 40 illustrates a perspective view of the distal end of the shaft 900 with the first member 904 removed for purposes of illustration. As shown, the third pulley 972 is coupled to the distal end cap 946 of the first member 904. The cord 974 extends proximally from the third pulley 972. The second pulley 927 can also be coupled to the distal end cap 946. Specifically, an end of the pulley belt 931 (e.g., an end of the second portion 931*b* of the pulley belt 931) is coupled to the distal end cap 946. In some examples, as shown, the third pulley 972 and the pulley belt 931 can be coupled to extensions 947 of the distal end cap 946. For example, the third pulley 972 and the pulley belt 931 can slide into a channel of the extensions 947 (e.g., in a direction perpendicular to the axis 903) that prevents the components from moving axially in a direction parallel to the axis 903. Similar to the shaft 500, the distal end of the third member 908 can include an opening configured to receive a portion of a wrist-ring structure (any wrist-ring structure described herein) or other user-facing structure (e.g., rotatable ball 700) and a locking lever 982 configured to releasably couple the wrist-ring (or other) structure to the third member 908 (e.g., by transitioning the locking lever 982 between a locked position and an unlocked position).

Referring again to FIG. 35, the shaft 900 can also include one or more sensors. In some instances, a processor board 986 can be coupled to the shaft 900, for example, to the base portion 902 and operatively coupled to the sensors and a computer interface (e.g., computer interface 439). For example, as described above, the shaft 900 can include a force sensor 933 in some examples that is coupled to the receiver arm 930 to detect or measure the force applied to the belt 928. Additionally, in some examples, a position sensor 980 (e.g., a rotary sensor, an optical encoder, etc.) can be coupled to the barrel 924, and operatively coupled to the processor board 986 and/or computer interface 439. The position sensor 980 can be configured to track and measure the telescoping position/motion of the second member 904 and the third member 906 relative to the base portion 902. The position sensor 980 can, for instance, detect a rotational position of the barrel 924 to measure a length of belt 928 that has been unwound from the barrel 924. This measurement can be used, for example, by the computer interface 439, to determine a position to which the shaft 900 has been extended or retracted. In some examples, data associated with the position sensor 980 (e.g., data corresponding to the telescoping position of the shaft 900, etc.), the motor 938, the force sensor 933 (e.g., data corresponding to the resistance applied to and/or experienced by the belt 928, etc.) and/or other components of the shaft 900 can be transmitted to the processor board and/or computer interface 439 (e.g., via a wired connection, via wireless communication, such as Bluetooth, etc.).

Although the disclosed shaft 900 is described as having one or more transducers, sensors, or gauges, it should be appreciated the system need not include these features to function but is enhanced by the added functionality and benefits they provide. Moreover, though quantities of individual components described herein are specified with particularity, it should be understood one or more components may be added or removed while still allowing the shoulder strengthening system to fully function in accordance with the present disclosure.

It should be appreciated that the shoulder strengthening systems 100, 300, 400, and 800 can include all and/or any combination of components described in reference to the other. As an example, in some examples, the shoulder strengthening system 800 can include the shaft assembly 444, instead of the shaft assembly 844. As another example, the shoulder strengthening system 100 can include the shaft 900 instead of shaft 132.

Although the resistance systems described herein can include hydraulic mechanisms to provide resistance, it should be appreciated that the materials making up the individual components of the resistance systems can also provide adequate resistance without a resistive force applied by the hydraulic mechanisms. For instance, in some cases, the weight and rigidity of the components of the resistance systems 102, 302, and 402 can provide ample resistance, particularly to those users just beginning rehabilitation. For this reason, one or more of the components of the resistance systems can be constructed of relatively light weight materials so as to ensure the components are able to be manipulated by a user whose shoulder is in a weakened state and vulnerable to injury and/or reinjury. As one example, the members of shaft 132, 326, 500, and 900 can be made of a lightweight, anodized aluminum which provides little weight to the resistance system.

Additional Examples of the Disclosed Technology

In view of the above-described implementations of the disclosed subject matter, this application discloses the additional examples enumerated below. It should be noted that one feature of an example in isolation or more than one feature of the example taken in combination and, optionally, in combination with one or more features of one or more further examples are further examples also falling within the disclosure of this application.

Example 1: An exercise apparatus comprising: a frame; a joint pivotably coupled to the frame; a resistance mechanism coupled to the joint; a shaft coupled to the joint; and a wrist-ring structure coupled to the shaft, wherein the shaft and the wrist-ring structure are configured to move together relative to the frame, and wherein the resistance mechanism is configured to restrict movement of the joint relative to the frame.

Example 2: The apparatus of any example herein, particularly example 1, wherein the resistance mechanism comprises a first hydraulic member and a second hydraulic member, the first hydraulic member configured to restrict relative motion of the joint about a first axis and the second hydraulic member configured to restrict relative motion of the joint about a second axis.

Example 3: The apparatus of any example herein, particularly any one of examples 1-2, wherein the joint is a universal joint, the universal joint having a first pivot axis and a second pivot axis perpendicular to the first pivot axis.

Example 4: The apparatus of any example herein, particularly any one of examples 2-3, wherein the resistance mechanism further comprises a first rotational position sensor and a second rotational position sensor, the first rotational position sensor configured to measure the angular rotation of the joint about the first axis and the second rotational position sensor configured to measure the angular rotation of the joint about the second axis.

Example 5: The apparatus of any example herein, particularly any one of examples 1-4, wherein the shaft is a telescoping shaft assembly comprising a first member coupled to the joint and a second member coaxially aligned with and slidably coupled to the first member.

Example 6: The apparatus of any example herein, particularly example 5, wherein the telescoping shaft assembly further comprises an adjustment ring coupled to the first member and the second member and configured to restrict relative movement between the first member and the second member.

Example 7: The apparatus of any example herein, particularly example 6, wherein the first member comprises a plurality of leaf springs, and wherein the adjustment ring is coaxially aligned with and extending over the leaf springs.

Example 8: The apparatus of any example herein, particularly example 7, wherein rotation of the adjustment ring relative to the first member produces relative axial motion between the adjustment ring and both the leaf springs and the first member such that the leaf springs contact and apply a resistive force to the second member.

Example 9: The apparatus of any example herein, particularly example 8, wherein the relative resistive force applied to second member is proportional to the axial travel of the adjustment ring relative to the first member.

Example 10: The apparatus of any example herein, particularly any one of examples 8-9, wherein the first member comprises one or more sensors configured to measure the resistive force applied to the second member.

Example 11: The apparatus of any example herein, particularly any one of examples 5-10, wherein the first member comprises one or more sensors configured to track the position of the second member relative to the first member.

Example 12: The apparatus of any example herein, particularly any one of examples 1-11, wherein the wrist-ring structure comprises a ring, a shuttle movably coupled to the ring, and a brace coupled to the shuttle, the shuttle and brace configured to move along a circumference of the ring and about a first axis of the wrist-ring structure.

Example 13: The apparatus of any example herein, particularly example 12, wherein the ring is configured to pivot about a second axis of the wrist-ring structure such that the shuttle and brace also pivot about the second axis.

Example 14: The apparatus of any example herein, particularly example 13, wherein the ring, shuttle, and brace rotate about a third axis of the wrist-ring structure.

Example 15: The apparatus of any example herein, particularly any one of examples 1-14, the apparatus further comprising a support coupled to the frame and configured to abut an arm of a user of the apparatus.

Example 16: The apparatus of any example herein, particularly example 15, wherein the support is rotatably coupled to the frame such that the support is configured to rotate 360 degrees about a vertical axis of the frame.

Example 17: The apparatus of any example herein, particularly any one of examples 15-16, wherein the support comprises a telescoping shaft comprising a first member and a second member coaxially aligned with and slidably coupled to the first member.

Example 18: The apparatus of any example herein, particularly any one of examples 1-17, wherein the joint is rotatably coupled to the frame such that joint is configured to rotate 360 degrees about a vertical axis of the frame.

Example 19: The apparatus of any example herein, particularly example 18, wherein the shaft and the wrist-ring structure are configured to move in multiple directions relative to the frame.

Example 20: The apparatus of any example herein, particularly any one of examples 1-19, wherein the joint comprises a base coupled to the frame and a movable component pivotably coupled to the base.

Example 21: The apparatus of any example herein, particularly example 20, wherein the joint is coupled to the frame by an adjustable arm such that the relative distance between the joint and the frame can be increased and decreased.

Example 22: An exercise apparatus comprising: a frame; a joint pivotably coupled to the frame; a resistance mechanism coupled to the joint and comprising a first hydraulic member and a second hydraulic member, the first hydraulic member configured to restrict relative motion of the joint about a first axis and the second hydraulic member configured to restrict relative motion of the joint about a second axis; a shaft coupled to the joint; and a wrist-ring structure coupled to the shaft, wherein the shaft and the wrist-ring structure are configured to move together relative to the frame about the first and second axes.

Example 23: The apparatus of any example herein, particularly example 22, wherein the first hydraulic member and the second hydraulic member are hydraulic cylinders.

Example 24: The apparatus of any example herein, particularly example 22, wherein the first hydraulic member and the second hydraulic member are hydraulic gear assemblies.

Example 25: The apparatus of any example herein, particularly any one of examples 22-24, wherein the first hydraulic member and the second hydraulic member are coupled to one or more flow valves configured to increase and/or decrease a flow rate of hydraulic fluid delivered to the first and second hydraulic members.

Example 26: The apparatus of any example herein, particularly example 25, wherein the flow rate of hydraulic fluid modifies the degree in which the relative motion of the joint is restricted by the first hydraulic member and the second hydraulic member.

Example 27: The apparatus of any example herein, particularly any one of examples 25-26, wherein the degree in which the relative motion of the joint is restricted is directly proportional to the flow rate of hydraulic fluid delivered to the first and second hydraulic members.

Example 28: The apparatus of any example herein, particularly any one of examples 22-27, wherein the resistance mechanism further comprises a first rotational position sensor and a second rotational position sensor, the first rotational position sensor configured to measure the angular rotation of the joint about the first axis and the second rotational position sensor configured to measure the angular rotation of the joint about the second axis.

Example 29: The apparatus of any example herein, particularly any one of examples 22-28, wherein the joint is a universal joint, the universal joint having a first pivot axis and a second pivot axis perpendicular to the first pivot axis.

Example 30: The apparatus of any example herein, particularly any one of examples 22-29, wherein the first hydraulic member is aligned with the first pivot axis and the second hydraulic member is aligned with the second pivot axis.

Example 31: The apparatus of any example herein, particularly any one of examples 22-30, wherein the first hydraulic member and the second hydraulic member form a 90-degree angle relative to one another.

Example 32: An exercise apparatus comprising: a frame; a joint pivotably coupled to the frame; a resistance mechanism coupled to the joint; a shaft assembly coupled to the joint, the shaft assembly comprising a first member and a second member coaxially aligned with and slidably coupled to the first member; and a wrist-ring structure coupled to the shaft assembly, wherein the shaft assembly and the wrist-ring structure are configured to move together relative to the frame, and wherein the resistance mechanism is configured to restrict movement of the joint relative to the frame.

Example 33: The apparatus of any example herein, particularly example 32, wherein first member is coupled to the joint and the wrist-ring structure is coupled to the second member.

Example 34: The apparatus of any example herein, particularly example 32, wherein the second member is coupled to the joint and the wrist-ring structure is coupled to the first member.

Example 35: The apparatus of any example herein, particularly any one of examples 32-34, wherein one of the first member and the second member has a diameter less than a diameter of the other of the first member and second member.

Example 36: The apparatus of any example herein, particularly any one of examples 30-35, wherein the shaft assembly further comprises an adjustment mechanism rotatably coupled to the first member and the second member and configured to restrict relative movement between the first member and the second member.

Example 37: The apparatus of any example herein, particularly example 36, wherein one of the first member and the second member comprises a plurality of leaf springs, and wherein the adjustment mechanism is coaxially aligned with and extending over the leaf springs.

Example 38: The apparatus of any example herein, particularly any one of examples 36-37, wherein rotation of the adjustment mechanism relative to the first member and the second member produces relative axial motion between the adjustment mechanism and the leaf springs such that the leaf springs contact and apply a frictional force to one of the first member and the second member.

Example 39: The apparatus of any example herein, particularly example 38, wherein the relative frictional force applied to one of the first member and the second member is proportional to the axial travel of the adjustment mechanism relative to the leaf springs.

Example 40: The apparatus of any example herein, particularly any one of examples 38-39, wherein one of the first member and the second member comprises one or more sensors configured to measure the frictional force applied to the other of the first member and the second member.

Example 41: The apparatus of any example herein, particularly any one of examples 32-40, wherein one of the first member and the second member comprises one or more sensors configured to track the position of the second member relative to the first member.

Example 42: An exercise apparatus comprising: a frame; a joint pivotably coupled to the frame; a resistance mechanism coupled to the joint; a shaft coupled to the joint; and a wrist-ring structure coupled to the shaft and comprising a ring, a shuttle movably coupled to the ring, and a brace coupled to the shuttle, the shuttle and brace configured to move along a circumference of the ring and about a first axis of the wrist-ring structure, wherein the shaft and the wrist-ring structure are configured to move together relative to the frame, and wherein the resistance mechanism is configured to restrict movement of the joint relative to the frame.

Example 43: The apparatus of any example herein, particularly example 42, wherein the ring is configured to pivot about a second axis of the wrist-ring structure such that the shuttle and brace also pivot about the second axis.

Example 44: The apparatus of any example herein, particularly example 43, wherein the ring, shuttle, and brace rotate about a third axis of the wrist-ring structure.

Example 45: The apparatus of any example herein, particularly any one of examples 42-44, wherein the wrist-ring structure comprises a lever configured to control the relative movement of the shuttle and brace along the circumference of the ring.

Example 46: The apparatus of any example herein, particularly example 45, wherein the lever is configured to switch the brace and shuttle between a fixed state and a free rotation state.

Example 47: The apparatus of any example herein, particularly example 46, wherein the lever is configured to switch the brace and shuttle between a fixed state and a momentarily free rotation state.

Example 48: The apparatus of any example herein, particularly example 45, wherein the lever in a first position is configured to fix the relative position of the brace and shuttle along the circumference of the ring.

Example 49: The apparatus of any example herein, particularly example 48, wherein the lever in a second position is configured to allow the brace and shuttle to move freely along the circumference of the ring.

Example 50: The apparatus of any example herein, particularly example 49, wherein the lever is configured to move between the first position and a third position such that the brace and shuttle are momentarily free to move along the circumference of the ring when the lever is in a third position and fixed when the lever is in the first position.

Example 51: The apparatus of any example herein, particularly any one of examples 42-50, wherein the wrist-ring structure is coupled to a release mechanism and the release mechanism is coupled to the shaft.

Example 52: An exercise apparatus comprising: a frame; a joint moveably coupled to the frame; a resistance mechanism coupled to the joint; a shaft coupled to the joint; and a wrist-ring structure coupled to the shaft, wherein the shaft and the wrist-ring structure are configured to move together relative to the frame about first, second, and third axes, and wherein the resistance mechanism is configured to restrict movement of the joint relative to the frame.

Example 53: The apparatus of any example herein, particularly example 52, further comprising a platform moveably coupled to the frame.

Example 54: The apparatus of any example herein, particularly example 53, wherein when the platform is in a first orientation the apparatus is in a stowable state and wherein when the platform is in a second orientation the apparatus is in an operational state.

Example 55: The apparatus of any example herein, particularly any one of examples 52-54, wherein a vertical positioning of the shaft, the wrist-ring structure, and the joint relative to the frame is adjustable via an adjustment mechanism.

Example 56: The apparatus of any example herein, particularly any one of examples 52-55, wherein the frame comprises a first adjustment member and a second adjustment member moveably coupled to the first adjustment member and the joint, the second adjustment member being configured to move axially relative to the first adjustment member.

Example 57: The apparatus of any example herein, particularly any one of examples 52-56, wherein the wrist-ring structure comprises a ring, a shuttle movably coupled to the ring, and a ball portion coupled to the shuttle, the shuttle and ball portion configured to move along a circumference of the ring and about a first axis of the wrist-ring structure.

Example 58: The apparatus of any example herein, particularly any one of examples 57, wherein the ring is configured to pivot about a second axis of the wrist-ring structure such that the shuttle and ball portion also pivot about the second axis.

Example 59: The apparatus of any example herein, particularly example 58, wherein the ring, shuttle, and ball portion rotate about a third axis of the wrist-ring structure.

Example 60: An exercise apparatus comprising: a frame; a joint pivotably coupled to the frame; a resistance mechanism coupled to the joint and comprising a first hydraulic member and a second hydraulic member, the first hydraulic member configured to restrict relative motion of the joint about a first axis and the second hydraulic member configured to restrict relative motion of the joint about a second axis; and a shaft coupled to the joint, wherein the shaft is configured to move relative to the frame about the first and second axes.

Example 61: The apparatus of any example herein, particularly example 60, wherein the first hydraulic member and the second hydraulic member are coupled to one or more flow valves configured to increase and/or decrease a flow rate of hydraulic fluid delivered to the first and second hydraulic members.

Example 62: The apparatus of any example herein, particularly any one of examples 60-61, wherein the flow rate of hydraulic fluid modifies the degree in which the relative motion of the joint is restricted by the first hydraulic member and the second hydraulic member.

Example 63: The apparatus of any example herein, particularly any one of examples 60-62, wherein the degree in which the relative motion of the joint is restricted is directly proportional to the flow rate of hydraulic fluid delivered to the first and second hydraulic members.

Example 64: The apparatus of any example herein, particularly any one of examples 60-63, wherein the resistance mechanism further comprises a first rotational position sensor and a second rotational position sensor, the first rotational position sensor configured to measure the angular rotation of the joint about the first axis and the second rotational position sensor configured to measure the angular rotation of the joint about the second axis.

Example 65: The apparatus of any example herein, particularly any one of examples 60-64, wherein the joint is a universal joint, the universal joint having a first pivot axis and a second pivot axis perpendicular to the first pivot axis.

Example 66: The apparatus of any example herein, particularly any one of examples 60-65, further comprising a wrist-ring structure coupled to the shaft, wherein the wrist-ring structure is configured to move with the shaft about the first and second axes.

Example 67: The apparatus of any example herein, particularly example 66, wherein the wrist-ring structure comprises a ring, a shuttle movably coupled to the ring, and a brace coupled to the shuttle, the shuttle and brace configured to move along a circumference of the ring and about a first axis of the wrist-ring structure.

Example 68: The apparatus of any example herein, particularly example 67, wherein the ring is configured to pivot about a second axis of the wrist-ring structure such that the shuttle and brace also pivot about the second axis.

Example 69: The apparatus of any example herein, particularly example 68, wherein the ring, shuttle, and brace rotate about a third axis of the wrist-ring structure.

Example 70: The apparatus of any example herein, particularly any one of examples 60-69, wherein the shaft is a telescoping shaft assembly comprising at least a first member coupled to the joint and a second member coaxially aligned with and slidably coupled to the first member.

Example 71: The apparatus of any example herein, particularly any one of examples 60-70, wherein the telescoping shaft assembly further comprises an adjustment mechanism configured to restrict relative movement between the first member and the second member.

Example 72: The apparatus of any example herein, particularly any one of examples 60-71, further comprising a support coupled to the frame and configured to abut an arm of a user of the apparatus.

Example 73: The apparatus of any example herein, particularly example 72, wherein the support is rotatably coupled to the frame such that the support is configured to rotate 360 degrees about a vertical axis of the frame.

Example 74: The apparatus of any example herein, particularly any one of examples 60-73, wherein the shaft and the joint are configured to move together relative to the frame about a third axes.

Example 75: An exercise apparatus comprising: a frame; a joint coupled to the frame; a resistance mechanism coupled to the joint; and a shaft assembly coupled to the joint, wherein the shaft assembly comprises a telescoping shaft, wherein the shaft assembly is configured to move together relative to the frame, and wherein the resistance mechanism is configured to restrict movement of the joint relative to the frame.

Example 76: The apparatus of any example herein, particularly example 75, wherein the telescoping shaft comprises multiple members and a telescoping system linking the multiple members together, wherein the multiple members include an outer member, a middle member, and an inner member.

Example 77: The apparatus of any example herein, particularly example 76, wherein the telescoping system comprises at least one belt and at least one pulley.

Example 78: The apparatus of any example herein, particularly example 77, wherein the telescoping system comprises a first pulley coupled to the outer member and a first belt at least partially disposed on the first pulley, wherein the first belt has a first end coupled to the inner member and a second end coupled to the first pulley.

Example 79: The apparatus of any example herein, particularly either example 77 or example 78, wherein the telescoping system comprises a second pulley coupled to the middle member and a second belt at least partially disposed on the second pulley, wherein the second belt has a first end coupled to the inner member and a second end coupled to the outer member.

Example 80: The apparatus of any example herein, particularly any one of examples 77-79, wherein the telescoping system comprises a third pulley and a third belt, wherein the third pulley is coupled to the outer member, wherein the third belt is at least partially disposed on the third pulley, wherein the third belt is coupled to the outer member and at least one of: the inner member and the middle member, wherein the third belt is tensioned to counteract the weight of at least the inner member and the middle member.

Example 81: The apparatus of any example herein, particularly any one of examples 75-80, wherein the telescoping shaft includes at least one damper.

Example 82: The apparatus of any example herein, particularly any one of examples 75-81, wherein the shaft assembly further comprises a wrist-ring structure coupled to the telescoping shaft, wherein the wrist-ring structure comprises a ring, a shuttle movably coupled to the ring, and a brace detachably coupled to the shuttle, the shuttle and brace configured to move along a circumference of the ring and about a first axis of the wrist-ring structure.

In view of the many possible embodiments to which the principles of the disclosed technology may be applied, it should be recognized that the illustrated embodiments are only examples of the technology and should not be taken as limiting the scope of the technology. Rather, the scope of the technology is defined by the following claims and their equivalents.

The invention claimed is:

1. An exercise apparatus comprising:

a frame;

a base coupled to the frame;

a shaft assembly that is moveable around each of a first axis and a second axis relative to the base; wherein the first axis and the second axis are unaligned;

a joint assembly coupling the telescoping shaft assembly to the base, the joint assembly comprising:

a bracket, wherein the bracket is rotatable about the first axis;

a pinion shaft comprising a shaft portion and a pinion portion, wherein the shaft portion is coupled to the bracket, and wherein the pinion portion is rotatably coupled to the base;

a rack having a plurality of teeth meshed with the pinion portion; and a resistance mechanism comprising a hydraulic member coupled to the rack, wherein the hydraulic member is configured to restrict movement of the rack relative to the base.

2. The exercise apparatus of claim 1, wherein the first axis is coaxial with a longitudinal axis of the pinion shaft.

3. The exercise apparatus of claim 1, wherein the hydraulic member comprises a housing and a rod, wherein the rod is coupled to the base and the housing is coupled to the rack, and wherein the housing and the rack are moveable in a direction that is perpendicular to the first axis.

4. The exercise apparatus of claim 1, wherein the pinion shaft is a first pinion shaft, the shaft portion is a first shaft portion, the pinion portion is a first pinion portion, the rack is a first rack having a first plurality of teeth meshed with the first pinion portion, and the hydraulic member is a first hydraulic member; and wherein the joint assembly further comprises:

a second pinion shaft comprising a second shaft portion and a second pinion portion, wherein the second shaft portion is coupled to a base portion of the shaft assembly and the pinion portion is rotatably coupled to the bracket; and a second rack having a second plurality of teeth meshed with the second pinion portion.

5. The exercise apparatus of claim 4, wherein the second axis is coaxial with a longitudinal axis of the second pinion shaft.

6. The exercise apparatus of claim 4, wherein the hydraulic member is a first hydraulic member; and wherein the resistance mechanism further comprises a second hydraulic member coupled to the second rack, wherein the second hydraulic member is configured to restrict movement of the second rack relative to the bracket.

7. The exercise apparatus of claim 6, wherein the second hydraulic member comprises a housing and a rod, wherein the rod is coupled to the bracket and the housing is coupled to the second rack, and wherein the housing and the second rack are moveable in a direction that is perpendicular to the second axis.

8. The exercise apparatus of claim 6, wherein the first and second hydraulic members are each coupled to one or more flow valves configured to control a flow rate of hydraulic fluid delivered the first and second hydraulic members, wherein the flow rate of hydraulic fluid modifies a degree in which relative motion of the bracket relative to the base is restricted by the first hydraulic member and a degree in which relative motion of the base portion of the shaft assembly relative to the base is restricted by the second hydraulic member.

9. The exercise apparatus of claim 8, wherein each of the first and second hydraulic members includes two fluid ports and is a double-acting hydraulic member.

10. The exercise apparatus of claim 4, further comprising a first position sensor including a first toothed gear meshed with the first rack and a second position sensor including a second toothed gear meshed with the second rack, wherein the first position sensor is configured to measure rotation of the shaft assembly around the first axis and wherein the second position sensor is configured to measure rotation of the shaft assembly around the second axis.

11. The exercise apparatus of claim 1, wherein the shaft assembly is a telescoping shaft assembly comprises a plurality of members and a telescoping system linking the plurality of members together, wherein the plurality of members include a first member, a second member, and a third member, wherein the first member is a lower member, the third member is an upper member, and the second member is disposed between the first and third members.

12. The exercise apparatus of claim 11, wherein the telescoping system comprises a first pulley coupled to the first member and a first belt, wherein at least a portion of the first belt is disposed on the first pulley, wherein the first belt has a first end coupled to the third member and a second end coupled to the first pulley, and wherein the first belt is configured to be wound on the first pulley as the third member translates proximally relative to the first member and to be unwound from the first pulley as the third member translates distally relative to the first member.

13. The exercise apparatus of claim 12, wherein the telescoping system comprises a second pulley coupled to the second member and a second belt, wherein at least a portion of the second belt is disposed on the second pulley, wherein the second belt has a first end coupled to the first member and a second end coupled to the third member, wherein the second pulley and the second belt are configured such that translational movement of the third member relative to the first member results in translational movement of the second member.

14. The exercise apparatus of claim 12, wherein the telescoping system comprises a clamp, wherein the clamp is configured to engage the first belt to restrict movement of the first belt relative to the first member.

15. The exercise apparatus of claim 11, wherein the telescoping system comprises a first dampening spring coupled to the third member and a second dampening spring coupled to the second member, wherein the first dampening spring is configured to be compressed between the third member and the second member as the third member is translated proximally relative the first member, and wherein the second dampening spring is configured to be compressed between the second member and the third member as the third member is translated distally relative to the first member.

16. An exercise apparatus comprising:

a frame;

a base coupled to the frame;

a shaft assembly that is moveable around each of a first axis and a second axis relative to the base;

a joint assembly coupling the telescoping shaft assembly to the base, the joint assembly comprising:

a bracket, wherein the bracket is rotatable about the first axis;

a first pinion shaft comprising a first shaft portion and a first pinion portion, wherein the first shaft portion is coupled to the bracket, and wherein the first pinion portion is rotatably coupled to the base;

a first rack having a plurality of teeth meshed with the first pinion portion;

a second pinion shaft comprising a second shaft portion and a second pinion portion, wherein the second shaft portion is coupled to a base portion of the shaft assembly and the second pinion portion is rotatably coupled to the bracket; and a second rack having a second plurality of teeth meshed with the second pinion portion; and a resistance mechanism comprising:

a first hydraulic member comprising a first housing coupled to the first rack and a first shaft coupled to the base; and a second hydraulic member comprising a second housing coupled to the second rack and a second shaft coupled to the bracket;

wherein the first and second hydraulic members are each coupled to one or more flow valves configured to control a flow rate of hydraulic fluid delivered the first and second hydraulic members, wherein the flow rate of hydraulic fluid modifies a degree in which relative motion of the bracket relative to the base is restricted by the first hydraulic member and a degree in which relative motion of the base portion of the shaft assembly relative to the base is restricted by the second hydraulic member.

* * * * *